US006505024B2

(12) United States Patent
Kayahara et al.

(10) Patent No.: US 6,505,024 B2
(45) Date of Patent: Jan. 7, 2003

(54) METHOD AND APPARATUS FOR IMAGE FORMING PERFORMING IMPROVED CLEANING AND DISCHARGING OPERATIONS ON IMAGE FORMING ASSOCIATED MEMBERS

(75) Inventors: Shin Kayahara, Urayasu (JP); Hideo Yu, Tama (JP); Mitsuru Takahashi, Kawasaki (JP); Takeshi Shintani, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/828,851

(22) Filed: Apr. 10, 2001

(65) Prior Publication Data

US 2002/0034405 A1 Mar. 21, 2002

Related U.S. Application Data

(62) Division of application No. 09/448,760, filed on Nov. 24, 1999, now Pat. No. 6,269,228.

(30) Foreign Application Priority Data

| | | |
|---|---|---|
| Nov. 24, 1998 | (JP) | 10-333074 |
| Dec. 7, 1998 | (JP) | 10-346334 |
| Dec. 7, 1998 | (JP) | 10-346365 |
| Dec. 7, 1998 | (JP) | 10-346435 |

(51) Int. Cl.[7] ..... G03G 15/01; G03G 15/16
(52) U.S. Cl. ..... 399/302; 399/308
(58) Field of Search ..... 399/302, 308, 399/310, 314, 315, 297

(56) References Cited

U.S. PATENT DOCUMENTS

| | | | | |
|---|---|---|---|---|
| 4,760,427 A | | 7/1988 | Oyama et al. | |
| 5,083,160 A | | 1/1992 | Suzuki et al. | |
| 5,701,566 A | | 12/1997 | Bisaiji et al. | |
| 5,758,226 A | * | 5/1998 | Motohashi | 399/302 X |
| 5,899,610 A | * | 5/1999 | Enomoto et al. | 399/302 |
| 5,946,538 A | * | 8/1999 | Takeuchi et al. | 399/302 |
| 5,983,060 A | | 11/1999 | Namekata et al. | |
| 5,995,793 A | * | 11/1999 | Enomoto et al. | 399/302 |
| 5,995,794 A | * | 11/1999 | Osada et al. | 399/302 |
| 6,006,062 A | | 12/1999 | Takahashi et al. | |
| 6,061,543 A | | 5/2000 | Kayahara et al. | |
| 6,078,773 A | * | 6/2000 | Shimojo et al. | 399/302 |
| 6,212,351 B1 | | 4/2001 | Kawagoe et al. | |
| 6,223,008 B1 | | 4/2001 | Takahashi et al. | |
| 6,269,228 B1 | | 7/2001 | Kayahara et al. | |
| 6,278,858 B1 | * | 8/2001 | Nakazawa et al. | 399/302 |

* cited by examiner

*Primary Examiner*—Sandra Brase
(74) *Attorney, Agent, or Firm*—Oblon, Spivak, McClelland, Maier & Neustadt, P.C.

(57) ABSTRACT

An image forming apparatus includes an image carrying member, intermediate transfer member, charger, transfer mechanism, discharger, direct current voltage source, and direct current voltage controller. The intermediate transfer member contacts the image carrying member and receives a toner image therefrom during a first transfer operation. The charger charges the intermediate transfer member to generate an electric field where the image carrying member and the intermediate transfer member contact each other for initiating the first transfer operation. The transfer mechanism performs a second transfer operation to transfer the toner image from the intermediate transfer member to a transfer sheet. The discharger discharges a charge remaining on the intermediate transfer member after completing the second transfer operation by the direct current voltage source applying a direct current voltage to the discharger. The direct current voltage controller controls the direct current voltage based on a volume resistivity of the intermediate transfer member.

7 Claims, 33 Drawing Sheets

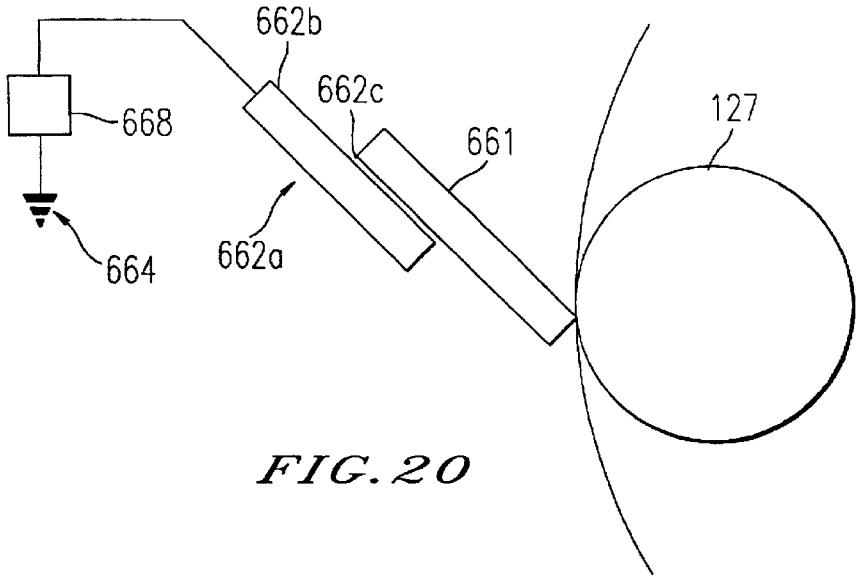
FIG. 20
FIG. 21
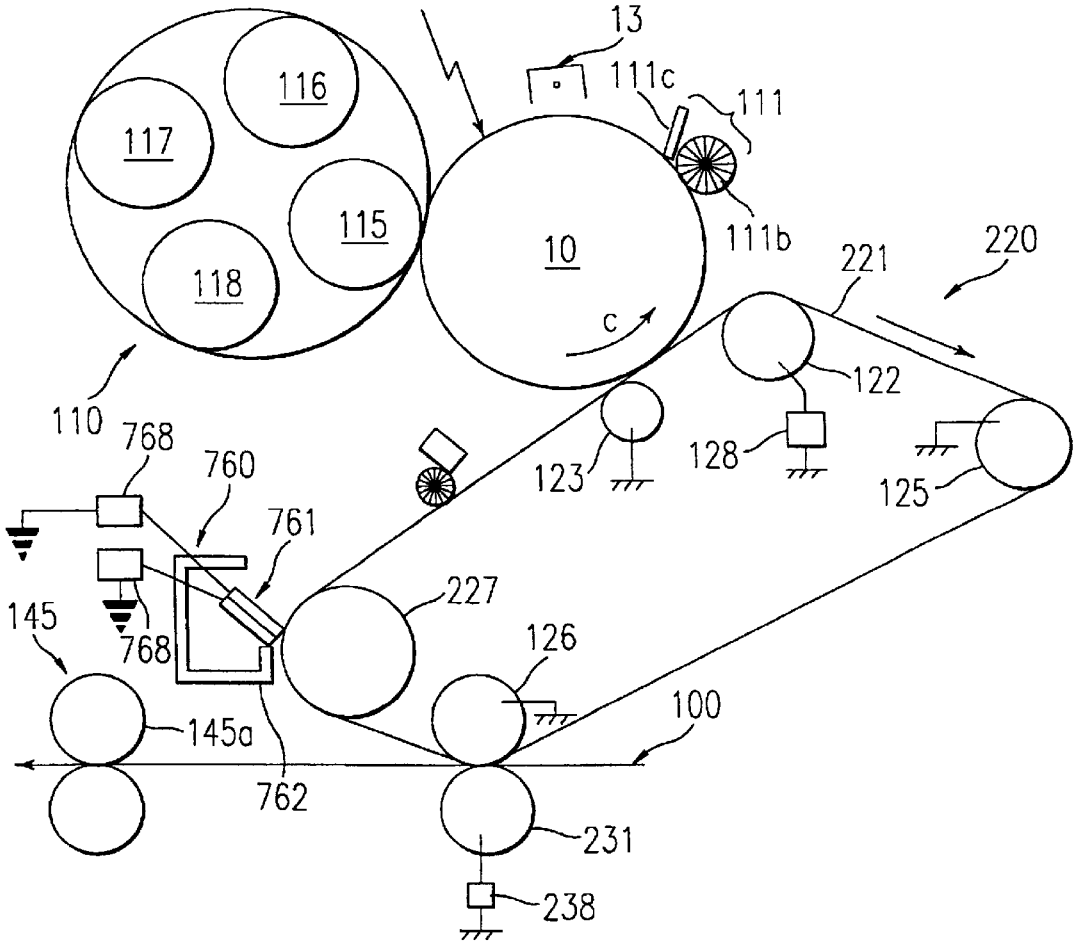

13
10
111
111c
111b
851
C
850
852
859
854
170
120
D
121
122
123
124
125
126
127
128
100
134
135a
135b
135c
130
131
132
139
136
137
110
115
116
117
118
145
145a

METHOD AND APPARATUS FOR IMAGE FORMING PERFORMING IMPROVED CLEANING AND DISCHARGING OPERATIONS ON IMAGE FORMING ASSOCIATED MEMBERS

This application is a division of application Ser. No. 09/448,760, filed Nov. 24, 1999, now U.S. Pat. No. 6,269, 228.

CROSS-REFERENCE TO FOREIGN APPLICATION

This application claims priority rights of and is based on Japanese patent applications respectively filed in the Japanese Patent Office as listed below, the entire contents of which are hereby incorporated by reference.

JPAP10-333074 filed on Nov. 24, 1998

JPAP10-346365 filed on Dec. 7, 1998

JPAP10-346334 filed on Dec. 7, 1998

JPAP10-346435 filed on Dec. 7, 1998

JPAPxx-xxxxxx filed on Oct. xx, 1999

BACKGROUND OF THE INVENTION

1. Field of the Invention

This invention generally relates to a method and apparatus for image forming, and more particularly to a method and apparatus for image forming in which cleaning and discharging operations are efficiently performed relative to an image carrying member, an intermediate transfer member, and associated members.

2. Discussion of the Background

In image forming apparatuses such as copying machines, facsimile machines, printers, etc., a large number of techniques have been introduced, relating to cleaning and discharging of members associated with an image forming operation involving usage of toner. In particular, cleaning and discharging are important in a full-color image forming apparatus which is provided with an intermediate transfer member in addition to a commonly-used image carrying member. In such a full-color image forming apparatus, primary and secondary transfer operations are in turn performed so as to transfer a plurality of mono-color-toner images separately formed on the image carrying member onto a transfer sheet at one time via the intermediate transfer member.

More specifically, the image carrying member and the intermediate transfer member are arranged to contact each other so as to perform a primary transfer operation for transferring each mono-color-toner image from the image carrying member to the intermediate transfer member. For this, the full-color image forming apparatus is provided with a charge applying member for applying a charge to the intermediate transfer member to generate an electric field which generates a force to help such primary transfer operation. After a number of times of the primary transfer operation, a plurality of mono-color-toner images are overlaid with precision as one full-color-toner image on the intermediate transfer member. Then, a secondary transfer operation is performed to transfer this full-color-toner image held on the intermediate transfer member onto a transfer sheet which is also in contact with the intermediate transfer member.

The above-described intermediate transfer member is often used in a belt shape or a drum shape. An intermediate transfer belt, for example, typically has a medium range of a volume resistivity from about $10^8$ Ωcm to about $10^{11}$ Ωcm, which normally does not require operations for discharging the surface of the intermediate transfer belt. This helps the cost reduction.

In using such an intermediate transfer member having a medium range of volume resistivity, the surface of the intermediate transfer member is applied with a bias to perform the primary transfer operation and thus has a charge thereon. However, this charge will leak through members in contact with the rear surface of the intermediate transfer member and no charge will therefore remain on the surface of the intermediate transfer member in a relatively short time period after the application of the charge.

As a result, the intermediate transfer member has the voltage which is 0 and greatly different from the voltage of the toner image transferred through the primary transfer operation. Due to this voltage difference, toner particles forming the toner image, particularly the topmost-laid mono-color-toner image, are attracted to the surface of the intermediate transfer member. This results in a toner dispersion in which the toner particles are dispersed on the surface of the intermediate transfer member. Such a toner dispersion may badly cause a dirty background of an image, a blur of an image such as letters, and so forth and therefore make an image deteriorated in quality.

To avoid this problem, the image forming apparatus has used the intermediate transfer member which has a high volume resistivity of about $10^{13}$ Ωcm. In using the intermediate transfer member having the high volume resistivity, the surface of the intermediate transfer member charges during the primary transfer operation due to an occurrence of discharge from the image carrying member and thus increases the voltage on the surface. Because of the high volume resistivity, the charge on the surface of the intermediate transfer member will not leak through the members in contact with the rear surface of the intermediate transfer member. Thereby, the difference of voltages between the intermediate transfer member and the toner image held on the intermediate transfer member is made relatively smaller. This helps to prevent the above-described toner dispersion.

In this case using the intermediate transfer member having the high volume resistivity, or the volume resistivity of at least $10^{11}$ Ωcm, the charge will remain on the surface of the intermediate transfer member till the time when the next primary transfer operation starts. This makes it difficult to generate the same electric field as made during the previous primary transfer operation. In this case, accordingly, the charge remaining on the surface of the intermediate transfer member needs to be discharged before starting the next primary transfer operation.

In addition, when a transfer sheet is jammed during the image forming operation in the image forming apparatus, the toner image held on the intermediate transfer member may pass a region where the secondary transfer operation is conducted, without being actually transferred onto a transfer sheet. This toner image needs, of course, to be removed before the next toner image is formed on the intermediate transfer member. However, a common cleaning member such as a cleaning blade alone cannot sufficiently remove the toner because the full-color image forming apparatus uses a relatively large amount of toner during one time of the image forming process.

Conventionally, a corona charger is widely used as a non-contact-type discharging member for discharging the image carrying member and other members associated with the image forming process in an image forming apparatus. Such a non-contact type of discharging member typically generates ozone during discharging, which is undesired from the environmental aspect. In addition, the discharging member needs an application of discharging bias which is generated from an expensive high voltage AC (alternating current) power source. This increase a manufacturing cost.

In addition, the above-described intermediate transfer member having a relatively high volume resistivity changes its volume resistivity in accordance with various environmental factors such as temperature, humidity, and so forth. The intermediate transfer member also changes a charger level on the surface thereof in accordance with a number of layers of mono-color toner image. With these changes, if the discharging bias is not variable, the discharging operation may not sufficiently be performed, causing a reduction of efficiency of the primary transfer operation.

As for the cleaning in the full-color image forming apparatus, it is required a relatively high level of cleaning performance, as described above. Conventionally, this is achieved by pressing the cleaning member relative to the intermediate transfer member. However, since the intermediate transfer member is rotating, the adjustment of pressure by the cleaning member has a relatively narrow margin and therefore it cannot be adjusted in a satisfactory manner.

In addition, the above-described discharging operation is needed to be performed relative to a transfer sheet carrying member as well as the intermediate transfer member. The transfer sheet carrying member carries a transfer sheet having a toner image transferred from the intermediate transfer member through the secondary transfer operation. During the secondary transfer operation, the transfer sheet carrying member is commonly applied with a bias to help the performance of the secondary transfer operation. This bias may remain on the transfer sheet carrying member after the secondary transfer operation and interferes the generation of the electric field for the next secondary transfer operation, resulting in an inferior image quality. Such a charge problem on the transfer sheet carrying member is addressed by employing a non-contact-type discharging member which involves an ozone problem.

SUMMARY OF THE INVENTION

The present application relates to a novel image forming apparatus which includes an image carrying member, an intermediate transfer member, a charging member, a transfer mechanism, a discharging member, a direct current voltage source, and a direct current voltage controller. The image carrying member rotates and carries a toner image on a rotating surface thereof. The intermediate transfer member is deposited at a position facing and in contact with the image carrying member, rotates and receives the toner image from the image carrying member during a first transfer operation. The charging member applies a charge to the intermediate transfer member to cause an electric field around a region where the image carrying member and the intermediate transfer member contact with each other, where the electric field generates a force for initiating the first transfer operation. The transfer mechanism performs a second transfer operation for transferring the toner image from the intermediate transfer member to a transfer sheet. The discharging member performs a discharging operation for discharging the charge remaining on the intermediate transfer member with contacting the intermediate transfer member after a completion of the second transfer operation. The direct current voltage source applies a direct current voltage to the discharging member to cause the discharging member to perform the discharging operation. The direct current voltage controller controls the direct current voltage in accordance with a volume resistivity of the intermediate transfer member.

The above-mentioned volume resistivity of the intermediate transfer member may be in a range of about $10^{11}$ Ωcm to about $10^{14}$·Ωcm, or in a range of about $10^{12}$ Ωcm to about $10^{13}$ Ωcm.

The present application also relates to a novel method of image forming which includes the steps of providing, rotating, charge applying, performing, direct current voltage applying, and controlling. The providing step provides a toner image to an carrying member for rotating and carrying the toner image on a rotating surface thereof. The rotating step rotates an intermediate transfer member which is arranged at a position facing and in contact with the image carrying member. The charge applying step applies a charge to the intermediate transfer member to cause an electric field around a region where the image carrying member and the intermediate transfer member contact with each other so that the electric field generates a force for initiating a first transfer operation for transferring the toner image from the image carrying member to the intermediate transfer member. The performing step performs a second transfer operation for transferring the toner image from the intermediate transfer member to a transfer sheet. The direct current voltage applying step applies a direct current voltage to the discharging member to cause the discharging member which discharges the charge remaining on the intermediate transfer member with contacting the intermediate transfer member after a completion of the second transfer operation. The controlling step controls the direct current voltage in accordance with a volume resistivity of the intermediate transfer member.

Further, the present application relates to another novel image forming apparatus which includes an image carrying member, an intermediate transfer member, a charging member, a transfer mechanism, a discharging member, a direct current voltage source, a voltage detect sensor, and a direct current voltage controller. The image carrying member rotates and carries a toner image on a rotating surface thereof. The intermediate transfer member which is deposited at a position facing and in contact with the image carrying member, rotates and receives the toner image from the image carrying member during a first transfer operation. The charging member applies a charge to the intermediate transfer member to cause an electric field around a region where the image carrying member and the intermediate transfer member contact with each other, where the electric field generates a force for initiating the first transfer operation. The transfer mechanism performs a second transfer operation for transferring the toner image from the intermediate transfer member to a transfer sheet. The discharging member performs a discharging operation for discharging the charge remaining on the intermediate transfer member with contacting the intermediate transfer member after a completion of the second transfer operation. The direct current voltage source applies a direct current voltage V to the discharging member to cause the discharging member to perform the discharging operation. The voltage detect sensor detects a surface voltage Va of the intermediate transfer member. The direct current voltage controller controls the direct current voltage V in a way such that the direct current voltage V relative to the surface voltage Va satisfies a range of $$[-1.3Va-650 \leqq V \leqq -1.3va+550].$$

Further, the present application also relates to a method of image forming which includes the steps of providing, rotating, charge applying, performing, detecting, direct current voltage applying, and controlling. The providing step provides a toner image to a carrying member for rotating and carrying the toner image on a rotating surface thereof. The rotating step rotates an intermediate transfer member which is arranged at a position facing and in contact with the image carrying member. The applying step applies a charge to the intermediate transfer member to cause an electric field around a region where the image carrying member and the intermediate transfer member contact with each other so that the electric field generates a force for initiating a first transfer operation for transferring the toner image from the image carrying member to the intermediate transfer member. The performing step performs a second transfer operation for transferring the toner image from the intermediate transfer member to a transfer sheet. The detecting step detects a surface voltage Va of the intermediate transfer member. The applying step applies a direct current voltage V to the discharging member to cause the discharging member which discharges the charge remaining on the intermediate transfer member with contacting the intermediate transfer member after a completion of the second transfer operation. The controlling step controls the direct current voltage V in a way such that the direct current voltage V relative to the surface voltage Va satisfies a range of $$[-1.3\mathrm{Va}-650 \leqq V \leqq -1.3va+550].$$

Further, the present application also relates to a novel image forming apparatus which includes an image carrying member, an intermediate transfer member, a charging member, a transfer mechanism, a discharging member, a direct current voltage source, a judging mechanism, and a direct current voltage controller. The image carrying member rotates and carries a toner image on a rotating surface thereof. The intermediate transfer member which is deposited at a position facing and in contact with the image carrying member, rotates and receives the toner image from the image carrying member during a first transfer operation which is performed for one time in a mono color mode and is repeated for a plurality of times in a multiple color mode to overlay a plurality of mono color toner images in turn on the intermediate transfer member. The charging member applies a charge to the intermediate transfer member to cause an electric field around a region where the image carrying member and the intermediate transfer member contact with each other, where the electric field generates a force for initiating the first transfer operation. The transfer mechanism performs a second transfer operation for transferring the toner image from the intermediate transfer member to a transfer sheet. The discharging member performs a discharging operation for discharging the charge remaining on the intermediate transfer member with contacting the intermediate transfer member after a completion of the second transfer operation. The direct current voltage source applies a direct current voltage to the discharging member to cause the discharging member to perform the discharging operation. The judging mechanism judges as to whether the apparatus is in the mono color mode or in the multiple color mode. The direct current voltage controller controls the direct current voltage in accordance with a result of judgement by the judging mechanism.

Further, the present application also relates to a novel method of image forming which includes providing, rotating, charge applying, performing, judging, direct current voltage applying, and controlling. The providing step provides a toner image to an carrying member for rotating and carrying the toner image on a rotating surface thereof. The rotating step rotates an intermediate transfer member which is arranged at a position facing and in contact with the image carrying member. The charge applying step applies a charge to the intermediate transfer member to cause an electric field around a region where the image carrying member and the intermediate transfer member contact with each other so that the electric field generates a force for initiating a first transfer operation for transferring the toner image from the image carrying member to the intermediate transfer member. The above-mentioned first transfer operation is performed for one time in a mono color mode and is repeated for a plurality of times in a multiple color mode to overlay a plurality of mono color toner images in turn on the intermediate transfer member. The performing step performs a second transfer operation for transferring the toner image from the intermediate transfer member to a transfer sheet. The judging step judges as to whether the apparatus is in the mono color mode or in the multiple color mode. The direct current voltage applying step applies a direct current voltage to the discharging member to cause the discharging member to discharge the charge remaining on the intermediate transfer member with contacting the intermediate transfer member after a completion of the second transfer operation. The controlling step controls the direct current voltage in accordance with a result of judgement by the judging mechanism.

Further, the present application also relates to a novel lubricant applying apparatus for applying a lubricant to an intermediate transfer member in an image forming apparatus. The above-mentioned novel lubricant applying apparatus includes a lubricant applying member for applying a lubricant to the intermediate transfer member and discharging a charge remaining on the intermediate transfer member.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 20 illustrates an enlarged cleaning blade of a belt cleaning unit of FIG. 19;

FIG. 21 illustrates a main portion of a printer of an image forming apparatus according to a ninth embodiment of the present invention;

DESCRIPTION OF THE PREFERRED EMBODIMENTS

Figure 1:
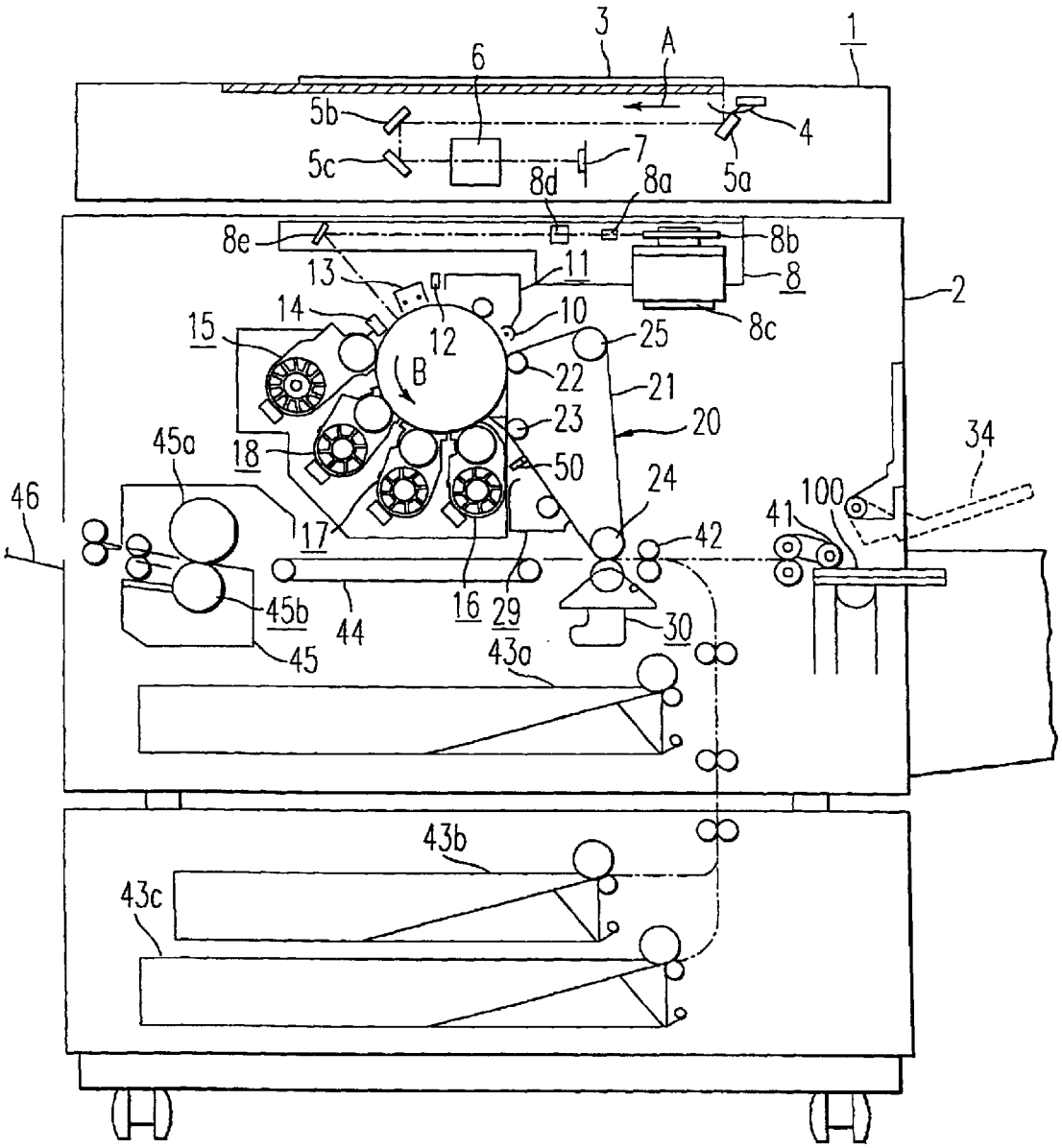
FIG. 1 illustrates an exemplary configuration of an image forming apparatus according to a first embodiment of the present invention.

In describing preferred embodiments of the present invention illustrated in the drawings, specific terminology is employed for the sake of clarity. However, the present invention is not intended to be limited to the specific terminology so selected and it is to be understood that each specific element includes all technical equivalents which operate in a similar manner.

Various embodiment of the present invention will hereinafter be described with reference to the accompanying drawings, wherein like reference numerals designate identical or corresponding parts throughout the several views.

Embodiment 1

To begin with, a first embodiment of the present invention will be described in connection with a full color electronic photocopier (hereinafter simply referred to as the "copier"), that is, an image forming apparatus in which the present invention is applied.

Figure 2:
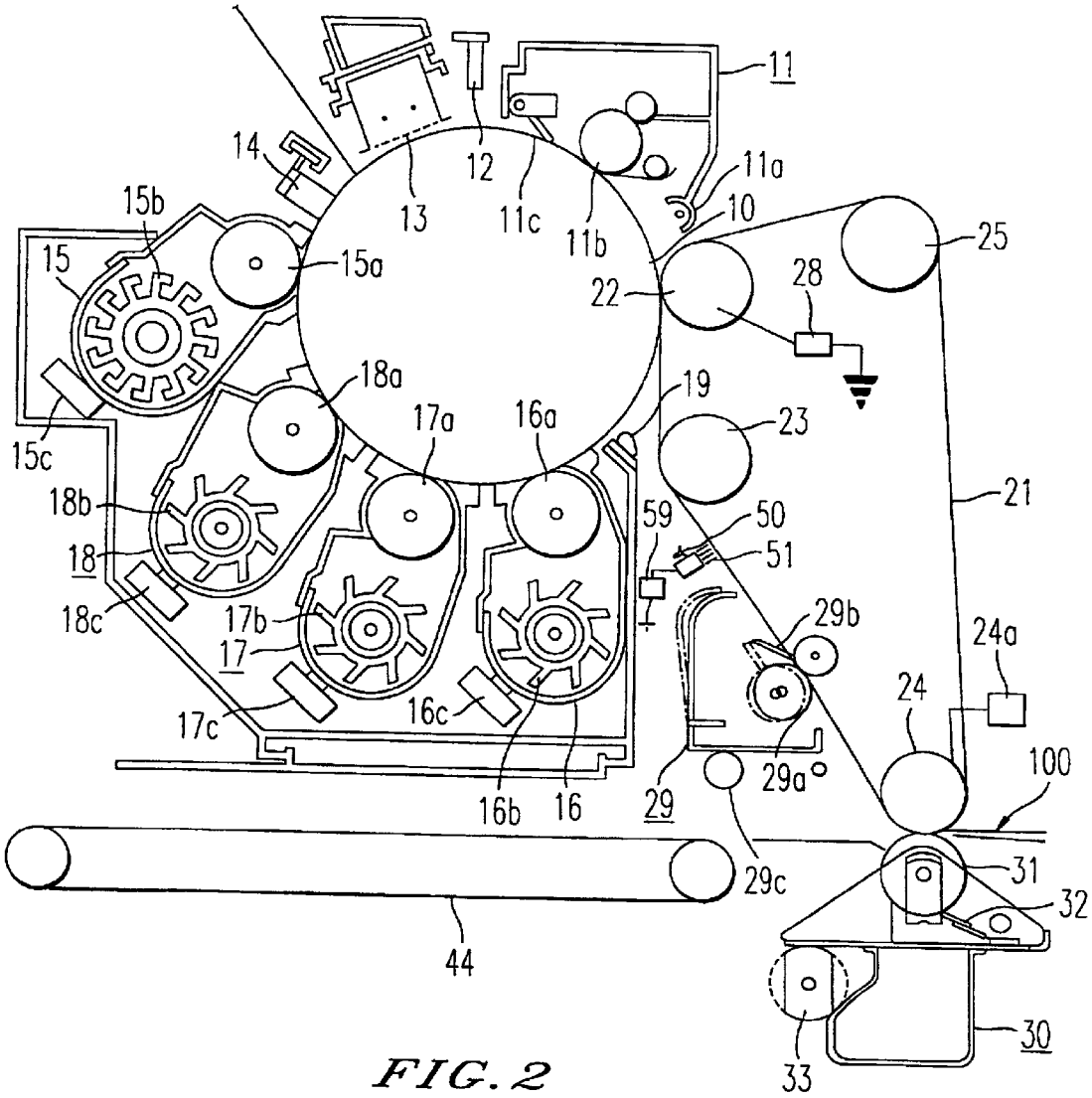
FIG. 2 illustrates an exemplary structure around a photosensitive drum of the image forming apparatus of FIG. 1.

FIG. 1 is a cross-sectional view schematically illustrating the configuration of the copier according to the first embodiment, and FIG. 2 is an enlarged view schematically illustrating the structure around a photosensitive drum serving as an image carrier in the copier of FIG. 1. The illustrated copier is generally formed of a color image reader unit 1 (hereinafter referred to as the "scanner unit 1") and a color image recording unit 2 (hereinafter referred to as the "printer unit 2").

First, the scanner unit 1 in the copier will be described in terms of the structure and operation. In this scanner unit 1, an image of an original 3 carried on a contact glass is focused on a color sensor 7 through an illumination lamp 4, a group of mirrors (5*a*, 5*b*, 5*c*), and a lens 6. The sensor 7 reads color image information of the original 3, for example, for each separated color light components Blue (hereinafter abbreviated as "B"), Green ("G"), and Red ("R"), and transduces the color image information to electrical image signals. The color sensor 7, which is composed of B, G, R color separating means and a photo-electric transducing element such as a CCD (charge coupled device), has the ability of simultaneously reading three colors. Respective image signals B, G, R produced in the scanner unit 1 are subjected to color conversion processing in an image processing unit based on their respective intensity levels. The color conversion processing results in color image data composed of Black (hereinafter abbreviated as "Bk"), Cyan ("C"), Magenta ("M"), and Yellow ("Y"). More specifically, an illumination/mirror optical system of the scanner unit 1 is responsive to a start signal associated with the printer unit 2 to scan an original in a direction indicated by an arrow A in FIG. 1 to acquire color image data. In the first embodiment, image data for one color is acquired each time the illumination/mirror optical system scans an original, so that the illumination/mirror optical system must scan a total of four times in order to acquire color image data for the four colors Bk, C, M, Y.

Next, the printer unit 2 of the copier according to the first embodiment will be described in terms of the structure and operation.

The printer unit 2 includes an optical writing unit 8 as an exposing means, and a photosensitive drum 10 as an image carrier. The optical writing unit 8 transduces color image data from the above-mentioned scanner unit 1 to an optical signal, and forms a negative latent image corresponding to an original image on the photosensitive drum 10 which is uniformly charged in the negative polarity. The optical writing unit 8 may be composed of a semiconductor laser 8*a*; a light emission driving controller, not shown, for controlling emission and driving of the semiconductor laser 8*a*; a polygon mirror 8*b*; a rotation driving motor 8*c* for rotating the polygon mirror 8*b;* an fθ lens 8*d*; and a reflection mirror 8*e*. The photosensitive drum 10 is driven to rotate in the counter-clockwise direction, i.e., in a direction indicated by an arrow B in FIG. 1.

The printer unit 2 further includes, around the photosensitive drum 10, a photosensitive drum cleaning unit 11; a discharging lamp 12; a charger 13; a potential sensor 14; a set of a Bk developing device 15, a C developing device 16, an M developing device 17 and Y developing device 18; a developer concentration pattern detector 19; and an intermediate transfer unit 20.

As can be seen in FIG. 2, the photosensitive drum cleaning unit 11 has a pre-cleaning discharger 11*a,* and a fur brush 11*b* and a photosensitive drum cleaning blade 11*c* as cleaning members, and is provided for cleaning the surface of the photosensitive drum 10 after primary transfer (transfer from the photosensitive drum to an intermediate transfer belt).

Each of the developing devices 15–18 has a developing paddle (15*b*, 16*b*, 17*b*, 18*b*) as an agitating means for scooping up and agitating an associated developer; a toner concentration sensor (15*c*, 16*c*, 17*c*, 18*c*) for sensing the toner concentration of the developer; and a developing sleeve (15*a*, 16*a*, 17*a*, 18*b*) as a developer carrier for bringing a sleeve or ear of the developer into contact with the surface of the photosensitive drum 10. For developers contained in the four developing devices, two-component developers may be used. Toners mixed in the developers are negatively charged. When the copier proceeds to a standby state, the four developing devices remove ears on the respective developing sleeves, and proceeds to an inoperative state.

The intermediate transfer unit 20 includes an intermediate transfer belt 21; a primary transfer bias roller 22 as a charge supply means; a primary transfer power supply 28 connected to the primary transfer bias roller 22; a ground roller 23 as a pre-primary transfer discharging means; a driving roller 24 as a belt driving means; and a driven roller 25. The intermediate transfer belt 21 is passed over the primary transfer bias roller 22, the ground roller 23, the driving roller 24, and the driven roller 25. The driving roller 24, connected to a driving motor 24*a*, controls the driving of the intermediate transfer belt 21.

The intermediate transfer belt 21 is formed in a multilayer structure composed of a surface layer, an intermediate layer and a base layer, and is placed such that the surface layer is positioned on the outer peripheral side which contacts the photosensitive drum 10, and the base layer is positioned on the inner peripheral side. In addition, an adhesive layer is interposed between the intermediate layer and the base layer for adhering the two layers. The intermediate transfer belt 21 is formed to have the volume resistivity ρv, as measured by the method described in JISK6911, in a range of $10^7$ Ωcm to $10^{14}$ Ωcm, preferably in a range of $10^{12}$ Ωcm to $10^{14}$ Ωcm, and more preferably equal to approximately $10^{13}$ Ωcm. It should be noted that while a material having the volume resistivity of $10^{14}$ Ωcm or more might be utilized, it is not suitable for the intermediate transfer belt for the intended purpose in the present invention from a viewpoint of durability and so on.

Around the intermediate transfer belt 21, there are disposed a contact-type discharger 50; a belt cleaning unit 29; and a transfer unit 30. The belt cleaning unit 29 has a brush roller 29*a* and a rubber blade 29*b* as cleaning members, and a belt contact/separation mechanism 29*c*. This belt contact/separation mechanism 29*c* enables the intermediate cleaning unit 29 to move into and out of contact with the intermediate transfer belt 21. The transfer unit 30 also has a secondary transfer bias roller 31 opposite to the driving roller 24 of the intermediate transfer unit 20; a transfer cleaning blade 32; and a transfer contact/separation mechanism 33. This transfer contact/separation mechanism enables the transfer unit 30 to move into and out of contact with the intermediate transfer belt 21.

The primary transfer bias roller 22 for tensioning the intermediate transfer belt 21 is positioned downstream of a primary transfer region defined by a nip formed by a contact between the intermediate transfer belt and the photosensitive drum 10 in a direction in which the surface of the intermediate transfer belt runs, i.e., in a belt moving direction. The primary transfer bias roller 22 is applied with a predetermined primary transfer bias by the primary transfer power supply 28. The ground roller 23 is disposed upstream of the nip in the belt moving direction. The intermediate transfer belt 21 is pressed against the photosensitive drum 10 by the primary transfer bias roller 22 and the ground roller 23, whereby the nip is formed.

The printer unit 2 also has a paper feed roller 41 for feeding a transfer paper 100 as a transfer material to a secondary transfer region formed between the secondary transfer bias roller 31 of the transfer unit 30 and the driving roller 24 of the intermediate transfer unit 20; a resist roller 42; transfer paper cassettes 43*a*, 43*b*, 43*c* for accommodating transfer papers 100 of various sizes; a hand feed tray 40 for use in copying an image on an OHP (overhead projector) sheet, rather thick paper, or the like; a paper conveying unit 44; a fixing unit 45; and a copy tray 46.

Next, the operation of the copier will be described in connection with an illustrative image forming mode in which the development is performed in the order of Bk, C, M, Y. It should be of course understood that image formation is not limited to this particular order.

Once a copy operation is initiated, a Bk step is first started, wherein color image information of an original is read in the scanner unit 1, and a Bk latent image is formed on the photosensitive drum 10 by laser light generated from the optical writing unit 8 based on Bk image data derived from the image information in the printer unit 20. The Bk latent image is applied with toner by the Bk developing device 15, and developed by forming a Bk toner image. In this event, the developing sleeve 15*a* has been previously rotated before the leading edge of the Bk latent image arrives at a developing position of the Bk developing device 15 in order to ensure that the Bk latent image is completely developed. In this way, since the developer has already formed a sleeve or ear when the leading edge of the Bk latent image arrives at the developing position of the Bk developing device 15, it is ensured that the entire Bk latent image can be developed. Also, in the Bk developing device 15, at the time the trailing edge of the Bk latent image has passed the developing position, the sleeve or ear of the developer formed on the developing sleeve 15*a* is immediately discontinued. This causes the Bk developing device 15 to proceed to an inoperative state. At this time, the Bk developing device 15 should be completely inoperative before the leading edge of a C latent image, to be next developed, arrives at the developing position of the Bk developing device 15. The developer ear may be discontinued by switching the developing sleep 15*a* to the direction reverse to the rotating direction during the developing operation.

The Bk toner image thus formed on the photosensitive drum 10 by the Bk developing device 15 is transferred to the surface of the intermediate transfer belt 21 which is driven at the same speed as the photosensitive drum 10 (primary transfer), followed by termination of the Bk step.

In parallel with the primary transfer of the Bk toner image, the next C step is started on the photosensitive drum 10. Specifically, color image information of the original is again read at a predetermined timing, a C latent image is formed on the photosensitive drum 10 by laser light based on C image data derived from the image information, and a C toner image is formed by the C developing device 16. The rotation of the developing sleeve 16*a* in the C developing device 16 is started after the trailing edge of the Bk latent image has passed a developing position of the C developing device 16 and before the leading edge of the C latent image arrives at the developing position. Then, at the time the trailing edge of the C latent image has passed the developing position, a developer ear formed on the developing sleeve 16*a* is discontinued as is the case of the aforementioned Bk developing device 15, and the C developing device 16 is made inoperative. Again, in this event, the C developing device 16 should be completely inoperative before the leading edge of the next M latent image arrives. The C toner image thus developed and formed on the photosensitive drum 10 is transferred to an image surface area of the intermediate transfer belt 21 in precise register with the Bk toner image which has been transferred to the image surface area.

Subsequently, in an M step and a Y step, the formation of latent image, development, and primary transfer are performed respectively based on their respective image data in a manner similar to the aforementioned C step. By transferring the respective Bk, C, M and Y toner images sequentially formed on the photosensitive drum 10 to the same image surface area on the intermediate transfer belt 21, a complete toner image formed of the four color images in accurate register with one another is formed on the intermediate transfer belt 21.

Now, the operation of the intermediate transfer belt 21 will be described referring again to FIG. 2.

While the aforementioned Bk, C, M and Y toner images are transferred to the photosensitive drum 10, for example, from the termination of the primary transfer of the first color (Bk) toner image to the initiation of the primary transfer of the second color (C) toner image, the intermediate transfer belt 21 may be driven in accordance with a constant speed forward mode, a skip forward mode, reciprocation (quick return) mode, or the like. While any driving mode selected from these illustrative driving modes may be fixedly employed for the intermediate transfer belt 21, a suitable driving mode may be selected from the three modes in accordance with a copy size for increasing the copy speed, or a plurality of driving modes may be efficiently used in combination.

In the following, the illustrative driving modes will be briefly described. The constant speed forward mode performs the primary transfer while driving the intermediate transfer belt in one direction at a low speed. The skip forward mode, which also drives the intermediate transfer belt in one direction similarly to the constant speed forward mode, moves the intermediate transfer belt away from the photosensitive drum after a toner image has been transferred thereto, skip forwards the intermediate transfer belt in the same direction at a higher speed, and then brings the intermediate transfer belt back to the start position of the primary transfer for performing the next primary transfer. This sequence of operations is repeated for the four color toner images. The reciprocation (quick return) mode, unlike the skip forward mode, returns the intermediate transfer belt to the start position of the primary transfer in the reverse direction at a higher speed in preparation for the next primary transfer, after the primary transfer is performed to the intermediate transfer belt and the intermediate transfer belt is moved away from the photosensitive drum. This sequence of operations are repeated for the four color toner images.

During a time period in which a complete toner image is formed on the intermediate transfer belt 21, specifically, during a time period from the time the first color (Bk) toner image had been transferred to the intermediate transfer belt 21 to the time the fourth color (Y) toner image has been transferred to the same, the discharging brush 51, the belt cleaning unit 29, and the transfer unit 30 are separated away from the intermediate transfer belt 21 by the respective contact/separation mechanisms.

The toner image transferred to the intermediate transfer belt 21 in the manner described above is conveyed to the secondary transfer region for secondary transfer to a transfer paper 100. In this event, the secondary transfer bias roller 31 of the transfer unit 30 is generally pressed against the intermediate transfer belt 21 by the transfer contact/separation mechanism 33 at the timing the toner image is transferred to the transfer paper 100. Subsequently, the secondary transfer bias roller 31 is applied with a predetermined secondary transfer bias by a secondary transfer power supply, not shown, to form a secondary transfer electric field in the secondary transfer region. The secondary transfer electric field causes the toner image on the intermediate transfer belt 21 to be transferred to the transfer paper 100. The transfer paper 100 is conveyed from a transfer paper cassettes 43*a*, 43*b*, 43*c* of a size specified by an operator on an operation panel, not shown, in a direction toward the resist roller 42, and fed into the secondary transfer region. More specifically, the transfer paper 100 is fed into the secondary transfer region at the timing coincident with the arrival of the leading edge of the toner image on the intermediate transfer belt 21 to the secondary transfer region.

The transfer paper 100, on which the complete toner image formed of four color toner images in accurate register with one another has been collectively transferred from the intermediate transfer belt 21, is subsequently conveyed to a fixing unit 45 by the paper conveying unit 44. The unfixed toner image on the transfer paper 100 is melted between a pair of fixing rollers consisting of a fixing roller 45*a* controlled at a predetermined temperature and a press roller 45*b*, and the unfixed toner image is fixed. Then, after the fixation, the transfer paper 100 is conveyed to and stacked on the copy tray 46.

After the primary transfer, the surface of the photosensitive drum 10 is cleaned by the photosensitive drum cleaning unit 11, and uniformly discharged by the discharging lamp 12. Also, after the secondary transfer, the surface of the intermediate transfer belt 21 is cleaned by the belt cleaning unit 29 which is pressed against the intermediate transfer belt 21 by the belt cleaning contact/separation mechanism 29*c*.

For repetitively copying the same original, in the scanner unit 1, the first color (Bk) step is started for the second copy at a predetermined timing subsequent to the fourth color (Y) step on the first copy. In the printer unit 2, in turn, a Bk latent image is formed on the photosensitive drum 10. On the intermediate transfer belt 21, on the other hand, the first color (Bk) toner image for the second copy is transferred to the region on the intermediate transfer belt 21, which has been cleaned by the belt cleaning unit 29, subsequent to the secondary transfer of the complete toner image 2 for the first copy.

While the operation of the copier has been described in connection with a copy mode for producing full-color or four-color copies, the same description is applicable to other copy modes, i.e., a three-color copy mode and a two-color copy mode, except that used colors and associated mechanisms are different. For a single-color copy mode, a developer in a developing device associated with a selected color is maintained to form a sleeve or ear, i.e., the developing device is maintained in operative state until a predetermined number of copies have been produced. Also, with the discharging brush 51, the belt cleaning unit 29 and the transfer unit 30 maintained in contact with the intermediate transfer belt 21 and with the intermediate transfer belt 21 maintained in contact with the photosensitive drum 10, the intermediate transfer belt 21 is driven in the forward direction at a constant speed for producing copies.

In the following, description will be made on the configuration and operation of the contact-type discharger 50 which constitutes a characterizing portion of the first embodiment.

The contact-type discharger 50 of the first embodiment has the discharging brush 51 and the discharge power supply 59 for applying the discharging brush 51 with a discharging bias. As can be seen in FIG. 2, the contact-type discharger 50 is positioned downstream of the belt cleaning unit 29 and upstream of the ground roller 23 in the direction of the movement of the intermediate transfer belt 21. Instead of the illustrated discharging brush 51, a discharging blade, a discharge roller, and a discharging brush roller may be used by way of example.

The discharging brush 51 is grounded through the discharge power supply 59. The discharging brush 51 is applied by the discharge power supply with a direct current or an alternate current discharging bias, or with a combination of direct current and alternate current discharging biases. In this event, when a direct current power supply for applying a direct current voltage is employed as the discharge power supply 59, a reduction in cost is expected. The first embodiment employs a regulated direct current power supply as the discharge power supply 59. In addition, since the residual potential on the intermediate transfer belt 21 is negative, the discharge power supply 59 applies the discharging brush 51 with a positive discharging bias.

The discharging bias thus applied to the discharging brush 51 forces a residual charge, which exists on the intermediate transfer belt 21 to form the residual potential, to efficiently flow into the discharging brush 51, so that effective discharging can be accomplished. Thus, even when the surface moving speed of the intermediate transfer belt 21 is increased, for example, in order to perform the image formation at a higher speed, the intermediate transfer belt 21 can be stably discharged.

Embodiment 2

Next, a second embodiment of the present invention will be described in connection with a full color electronic photocopier (hereinafter simply referred to as the "copier"), that is, an image forming apparatus in which the present invention is applied.

Figure 3:
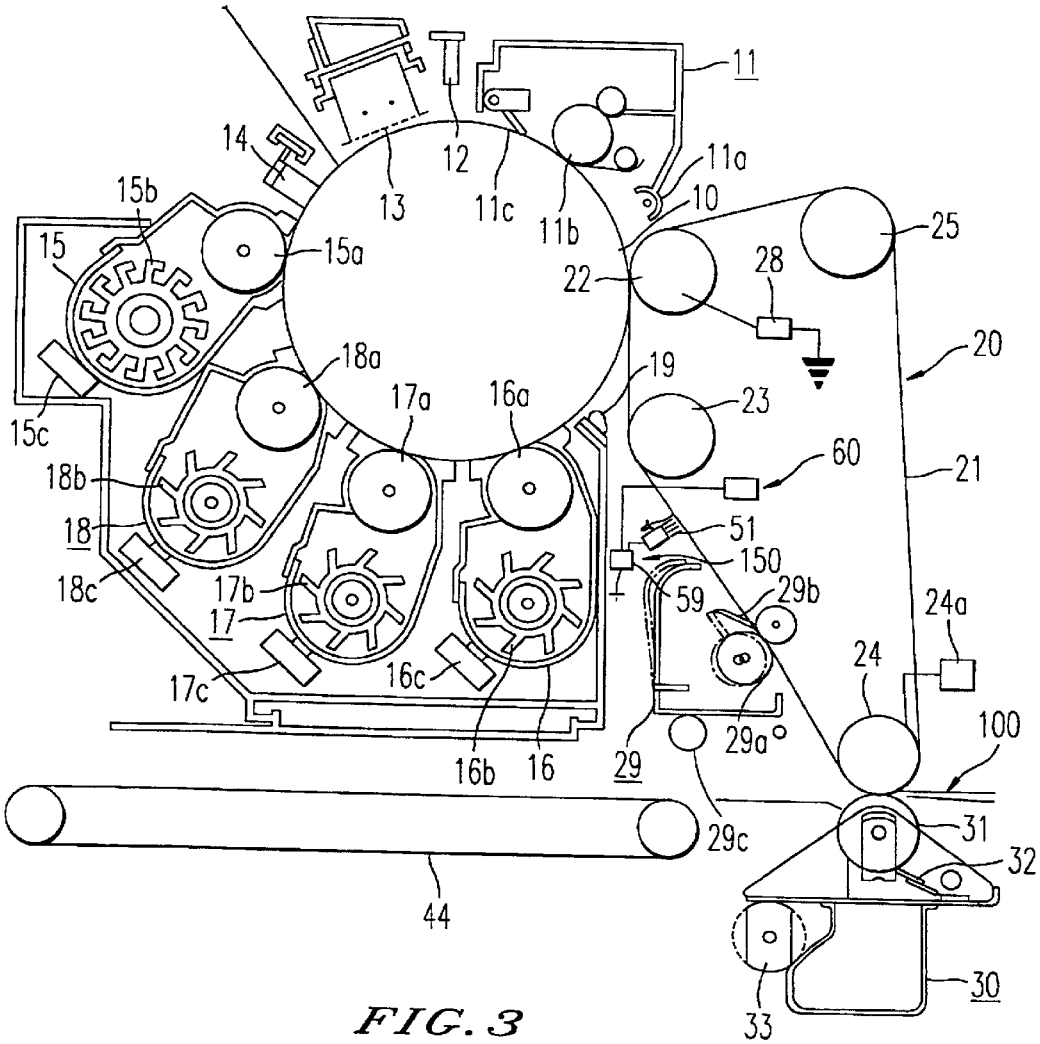
FIG. 3 illustrates an exemplary structure around a photosensitive drum of an image forming apparatus according to a second embodiment of the present invention.

FIG. 3 schematically illustrates the configuration of a main portion in a printer unit of the copier according to the second embodiment. The illustrated copier includes a scanner unit, not shown, which has the same configuration as that of the first embodiment. The second embodiment differs from the first embodiment in that a printer unit has a variable discharge power supply and a control unit for controlling the variable discharge power supply. Since the copier of the second embodiment performs image forming operations basically in the same manner as the first embodiment, description on those parts that are constructed and operated in a manner similar to the first embodiment is omitted.

A contact-type discharger 150 according to the second embodiment has a discharging brush 51, and a variable discharge power supply 159 for applying the discharging brush 51 with a variable direct current voltage, similarly to that in the first embodiment. The variable discharge power supply 159 is connected to a control unit which controls a direct current voltage applied to the discharging brush 51.

A specific example (hereinafter referred to as the "first example") of the control unit for controlling the variable bias power supply 159 will be described below with reference to FIG. 4.

Figure 4:
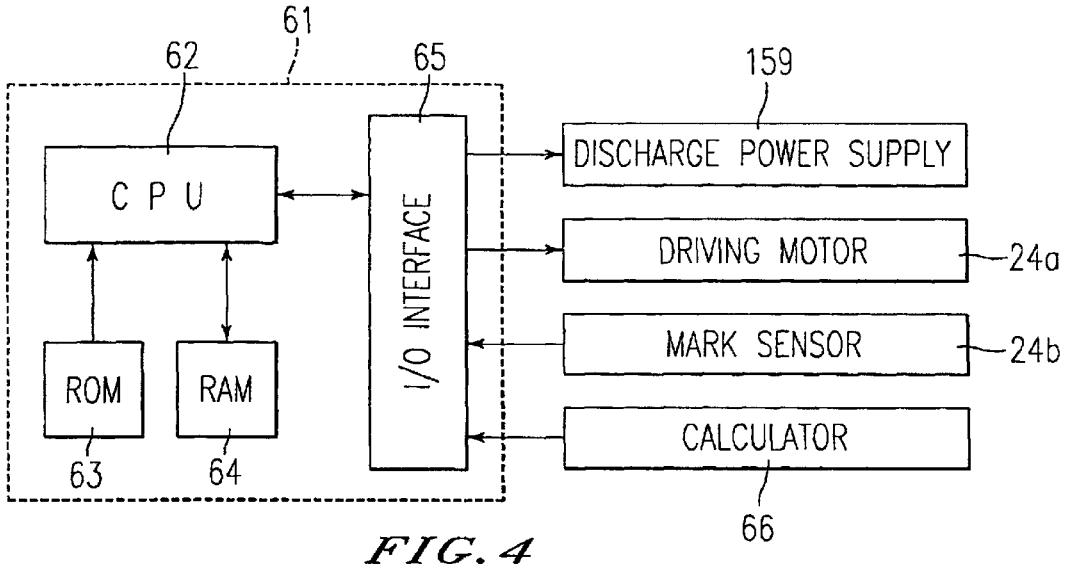
FIG. 4 illustrates a block diagram of a specific example of a controller included in the image forming apparatus of FIG. 2.

FIG. 4 is a block diagram illustrating the configuration of a controller 61 in the control unit 60 for controlling the variable discharge power supply 159 in accordance with the volume resistivity ρv of the intermediate transfer belt 21. The controller 61 has a CPU 62, a ROM 63, a RAM 64, and an I/O interface 65. The I/O interface 65 is connected to the variable discharge power supply 159; a driving motor 24*a* coupled to a driving roller 24 for driving the intermediate transfer belt 21; a mark sensor 24*b* for detecting a mark attached on the inner peripheral surface of the intermediate transfer belt 21 for detecting a rotating position; and a calculator 66 for counting a total number of copies produced by the copier. The variable discharge power supply 159 for applying the discharging brush 51 with a direct current voltage is turned ON/OFF at a timing that is set based on an output signal of the mark sensor 24*b*.

Now, explanation will be given of the relationship between the volume resistivity ρv of the intermediate transfer belt 21 and a surface potential on the intermediate transfer belt 21 after secondary transfer.

Figure 5:
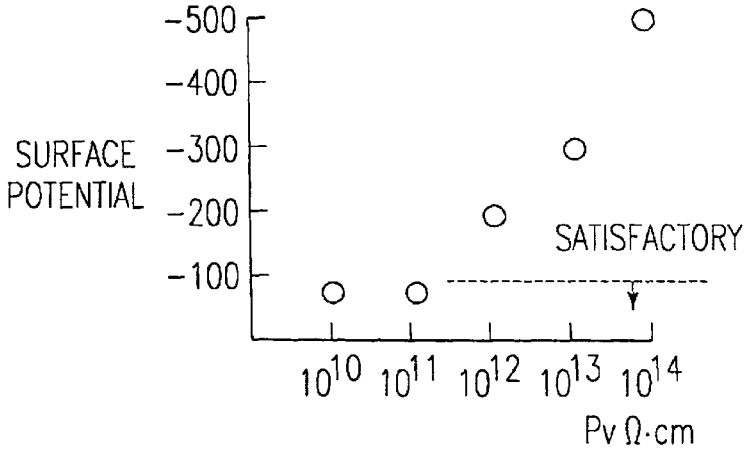
FIG. 5 is a graph for explaining a relationship between a volume resistivity of an intermediate transfer belt and a surface voltage of the intermediate transfer belt after a secondary transfer operation in the image forming apparatus of FIG. 2.

FIG. 5 shows a graph representing the relationship between the volume resistivity ρv of the intermediate transfer belt 21 and the surface potential on the intermediate transfer belt 21 after secondary transfer. Also, Table 1 below shows the relationship between the surface potential on the intermediate transfer belt 21 after secondary transfer and the evaluation for an image which is subsequently formed when the surface of the intermediate transfer belt 21 is charged at each potential as indicated. The image evaluation on Table 1 is made in the following manner: when an image produced in the next sequence of image formation with a surface potential equal to a value indicated in Table 1 exhibits a similar image quality to the preceding image, it is evaluated as ○; and when such an image has a lower image quality than the preceding image, it is evaluated as Δ or × according to the degree of deterioration.

TABLE 1

| Surface Potential (V) | 0 | −100 | −200 | −300 | −400 | −500 |
|---|---|---|---|---|---|---|
| Image | ○ | ○ | Δ | X | X | X |

The graph of FIG. 5 shows that when the volume resistivity ρv is $10^{11}$ Ωcm or more, the residual potential due to a residual charge on the surface of the intermediate transfer belt after the secondary transfer is at −100 volts or less Then, Table 1 shows that an image formed in the next sequence of image formation fails to be evaluated as ○ when the residual potential is at −100 volts or less. Consequently, it is found that with the volume resistivity ρv equal to or higher than $10^{11}$ Ωcm, the residual potential on the surface of the intermediate transfer belt adversely affects the next primary transfer, with the result that an image formed in such an environment suffers from a degraded quality. It is thought that the degraded image quality of a subsequently formed image as compared with that of the previously formed image is caused by an insufficient primary transfer bias due to the residual potential. It is therefore effective to provide such the intermediate transfer belt 21 with a discharging means. In addition, the volume resistivity ρv of the intermediate transfer belt 21 set in a range of $10^{13}$ Ωcm to $10^{14}$ Ωcm or more is preferable because dusts can be prevented from remaining on the intermediate transfer belt 21 after the primary transfer.

FIG. 5 also shows that as the volume resistivity ρv is higher, the residual potential on the intermediate transfer belt 21 is also higher. For preferably performing the primary transfer in the next image formation process, the discharging bias must be selected such that the intermediate transfer belt 21 is not discharged insufficiently or excessively, that is, such that the surface potential on the intermediate transfer belt is at −100 volts or lower. For this purpose, the variable discharge power supply 159 is controlled to generate a direct current which provides an optimal discharging bias in accordance with the volume resistivity ρv of the employed intermediate transfer belt 21.

Further, while the volume resistivity ρv of the intermediate transfer belt 21 is determined in a design stage of a copier, the intermediate transfer belt 21 is deteriorated as it is repetitively used over time. This deterioration appears as a lower volume resistivity ρv, so that if a direct current voltage applied by the variable discharge power supply 159 is kept unchanged from the initial setting, an actually applied discharging bias will deviate from an optimal value. To solve this problem, the control unit 60 in the second embodiment controls the direct current generated by the variable discharge power supply 159 in accordance with this decreasing volume resistivity ρv over time.

Specifically, when the total number of copies counted by the calculator 66 reaches a predetermined value, the controller 61 in the control unit 60 controls the variable discharge power supply 159 to generate a higher direct current voltage. As a result, it is possible to correct a deviation of the discharging bias from the optimal value due to the decreasing volume resistivity ρv associated with the deteriorated intermediate transfer belt 21, and hence accomplish stable and exact discharging over a long term.

Another specific example (hereinafter referred to as the "second example") of the control unit for controlling the variable bias power supply 159 will be described below with reference to FIG. 6.

Figure 6:
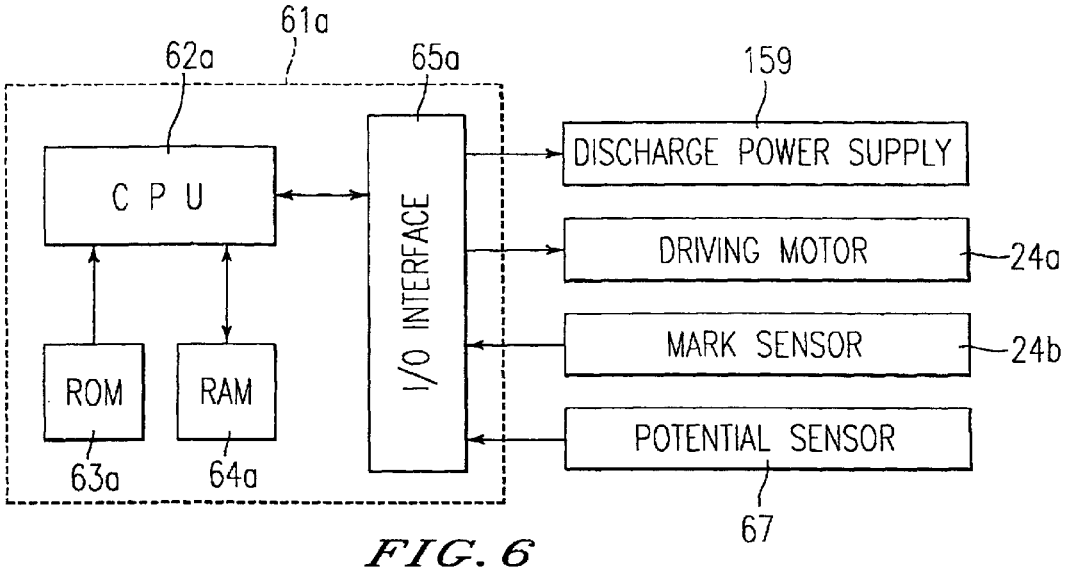
FIGS. 6–8 illustrate block diagrams of other specific examples of the controller included in the image forming apparatus of FIG. 2.

FIG. 6 is a block diagram illustrating the configuration of a controller 61*a* in a control unit 60*a* for controlling the variable discharge power supply 159 in accordance with a surface potential of the intermediate transfer belt 21. The control unit 60*a* of the second example has the same configuration as the control unit 60 in the foregoing first example except that an I/O interface 65*a* in the controller 61*a* is connected to a potential sensor 67 for sensing the potential on the surface of the intermediate transfer belt 21 instead of the calculator 60 in the first example. The potential sensor 67 is disposed upstream of the position at which the discharging brush 51 is disposed in the direction of the movement of the intermediate transfer belt 21.

An optimal value for a direct current applied by the variable discharge power supply 159 varies depending on the potential on the surface of the intermediate transfer belt 21, more specifically, the surface of the intermediate transfer belt 21 after secondary transfer. It is therefore desirable to control the variable discharge power supply 159 in accordance with the surface potential in order to achieve effective discharging.

In the second example, the potential sensor 67 senses the surface potential on the intermediate transfer belt 21 before it is discharged, and supplies the sensed surface potential data to a CPU 62*a* in the controller 61*a* to control the variable discharge power supply 159 in response to the surface potential data.

While an exact bias potential can be applied by virtue of the discharging bias control in response to the surface potential on the intermediate transfer belt 21 using the potential sensor 67, the implementation of such control may result in a complicated configuration and an increased cost. Thus, when the discharging bias control is applied to a copier which has a single-color mode in which a single-color toner image formed on the photosensitive drum 10 is transferred to the intermediate transfer belt 21 and then transferred again from the intermediate transfer belt 21 to the transfer paper 100, and a multi-color mode in which a plurality of toner images sequentially formed on the photosensitive drum are transferred to the intermediate transfer belt 21 one after the other in accurate register with one another, and the complete multi-color image is transferred to the transfer paper, the variable discharge power supply may be controlled to apply different discharging biases in accordance with the single-color mode or the multi-color mode. Specifically, when a copier has a single-color mode for producing copies using only a single developer for one color (hereinafter referred to as the "1C mode") and a multi-color mode for producing copies using developers for four colors (hereinafter referred to as the "4C mode"), the controller 61*a* may control the variable discharge power supply 159 such that different discharging biases are applied corresponding to these copy modes.

Further, when the discharging bias control is applied to a copier which has a plurality of multi-color modes in accordance with the number of times toner images are transferred or superimposed, in which a plurality of toner images sequentially formed on the photosensitive drum 10 are transferred to the intermediate transfer belt 21 one after the other in accurate register with one another, and the complete multi-color image is transferred to the transfer paper, the control unit 61 may control the variable discharge power supply 159 to generate different direct current voltages in accordance with the number of toner images, in other words, the number of times toner images are transferred or superimposed one after the other to the intermediate transfer belt 21. In this case, if a copier has an additional two-color mode (hereinafter referred to as the "2C mode") for producing copies using developers for two colors in addition to the aforementioned 1C mode and 4C mode, the controller 61*a* may control the variable discharge power supply 159 to apply different discharging biases corresponding to the respective copy modes.

Next, a further specific example (hereinafter referred to as the "third example") of the control unit for controlling the variable bias power supply 159 will be described below with reference to FIG. 7.

Figure 7:
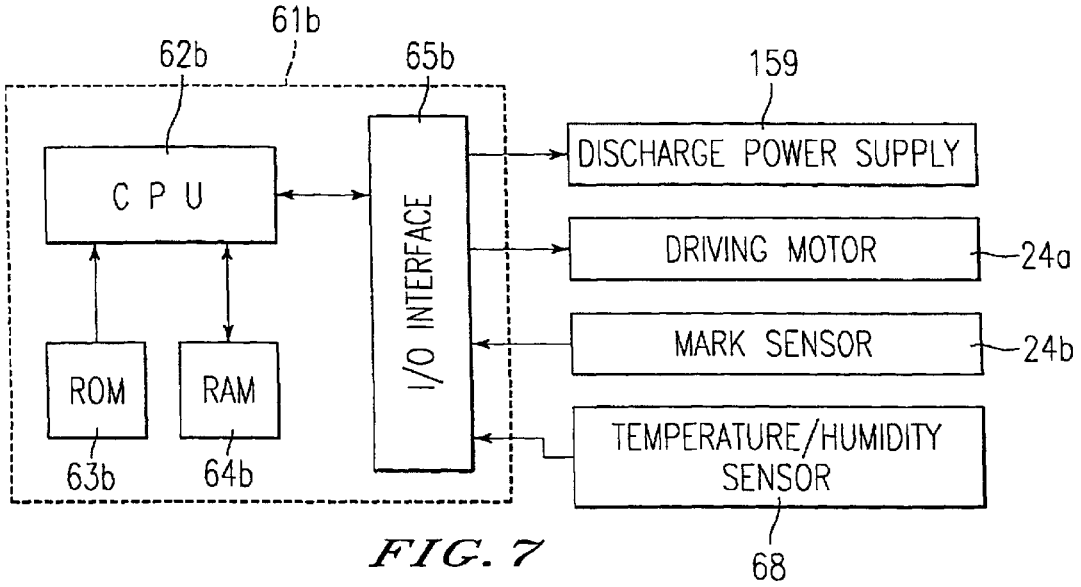

FIG. 7 is a block diagram illustrating the configuration of a controller 61*b* in a control unit 60*b* for controlling the variable discharge power supply 159 in accordance with an environmental condition around the intermediate transfer belt 21. The control unit 60*b* of the third example has the same configuration as the control unit 60 in the foregoing first example except that an I/O interface 65*b* in the controller 61*b* is connected to a temperature and humidity sensor 68 for sensing an environmental condition around the intermediate transfer belt 21 instead of the calculator 60 in the first example. While the third example employs the combined temperature and humidity sensor 68 as an environmental condition sensing means, separate sensors may be provided for individually sensing a temperature and a humidity. Alternatively, the control unit 60*b* may be provided with another environmental condition sensing means such as that for sensing the volume resistivity ρv of the intermediate transfer belt 21, or any other environmental condition, other than temperature and humidity, which may affect a contact resistance between the intermediate transfer belt 21 and the discharging brush 51.

As mentioned above, an optimal value for a direct current voltage applied by the variable discharge power supply 159 varies depending on the volume resistivity ρv of the intermediate transfer belt 21. The volume resistivity ρv in turn varies depending on environmental conditions, particularly, on temperature and humidity. Also, since the third example employs a discharging brush 51 which is a contact-type discharge member, a contact resistance between the discharging brush 51 and the intermediate transfer belt 21 is also included in factors which vary the optimal value for the direct current voltage. The contact resistance likewise varies depending on environmental conditions, particularly on temperature and humidity. It is therefore desirable to control the variable discharge power supply 159 in accordance with such environmental conditions as mentioned above which cause variations in the optimal value for the direct current voltage, in order to achieve effective discharging.

To meet the foregoing requirements, in the third example, the temperature and humidity sensor 68 senses the temperature and humidity around the intermediate transfer belt 21 and supplies sensed temperature data and humidity data to a CPU 62*b* in the controller 61*b* which controls the variable discharge power supply 159 in response to the supplied data.

Next, a further specific example (hereinafter referred to as the "fourth example") of the control unit for controlling the variable bias power supply 159 will be described below with reference to FIG. 8.

Figure 8:
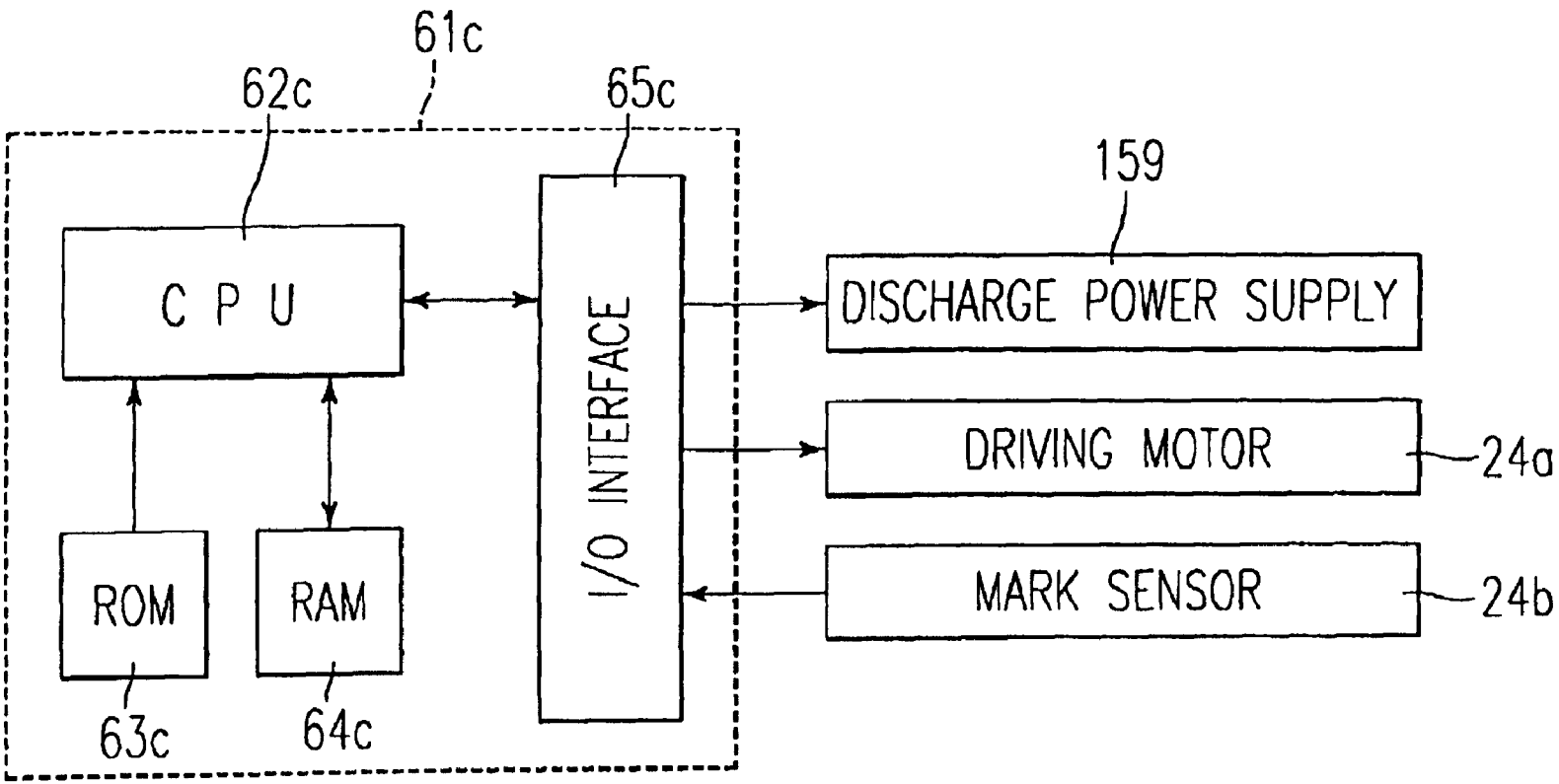

FIG. 8 is a block diagram illustrating the configuration of a controller 61*c* in a control unit 60*c* for controlling the variable discharge power supply 159 in accordance with a surface moving speed the intermediate transfer belt 21. The control unit 60*c* of the fourth example has the same configuration as the control unit 60 in the foregoing first example except that a CPU 62*c* in the controller 61*c* is supplied with a rotating speed of the driving motor 24*a* which drives the driving roller 24 for driving the intermediate transfer belt 21.

An optimal value for a direct current voltage applied to the variable discharge power supply 159 varies depending on the surface moving speed of the intermediate transfer belt 21. This is because a change in the surface moving speed causes variations in time period for which the discharging brush 51 remains in contact with the intermediate transfer belt 21. More specifically, when the direct current voltage is fixed, an increase in the surface moving speed of the intermediate transfer belt 21 may result in insufficient discharging, while a decrease in the surface moving speed may result in excessive discharging. It is therefore beneficial to control the variable discharge power supply 159 in accordance with the surface moving speed of the intermediate transfer belt 21 which causes variations in the optimal value for the direct current voltage, in order to achieve effective discharging.

To meet the above requirements, in the fourth example, data on the rotating speed of the driving motor 24*a* is supplied to the CPU 62*c* in the controller 61*c* which calculates the current surface moving speed of the intermediate transfer belt 21 corresponding to the rotating speed of the driving motor 24*a*, and controls the variable discharge power supply 159 so as to apply the discharging brush 51 with an optimal discharging bias for the calculated surface moving speed.

It should be noted that the control unit according to the second embodiment may advantageously utilize a combination of the foregoing examples as appropriate to more exactly discharge the intermediate transfer belt 21.

Embodiment 3

Next, a third embodiment of the present invention will be described in connection with a full color electronic photocopier (hereinafter simply referred to as the "copier"), that is, an image forming apparatus in which the present invention is applied.

Figure 9:
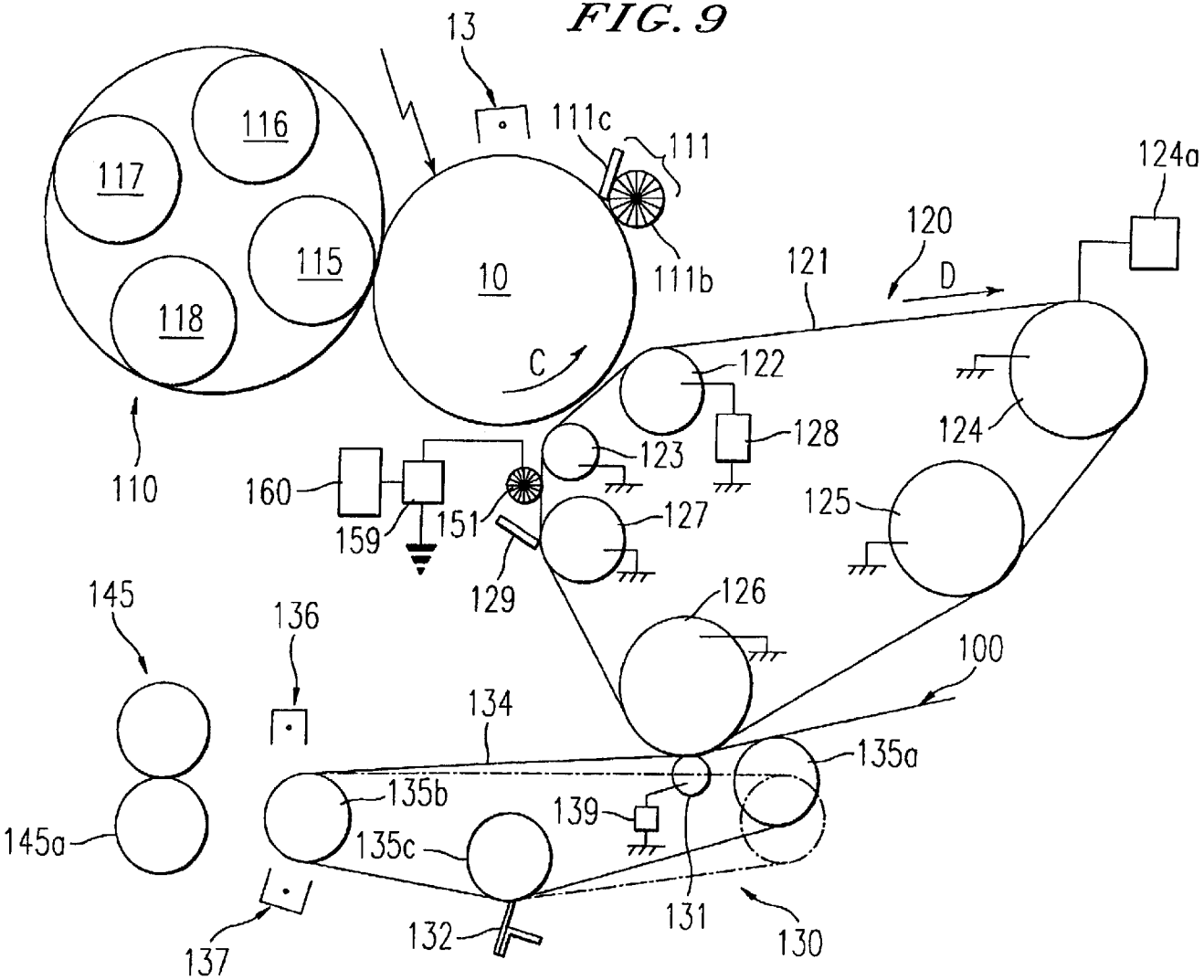
FIG. 9 illustrates a main portion of a printer of an image forming apparatus according to a third embodiment of the present invention.

FIG. 9 schematically illustrates the configuration of a main portion in a printer unit of the copier according to the third embodiment. The illustrated copier includes a scanner unit, not shown, which has the same configuration as that of the first embodiment, and performs basically the same image forming operations as the copier of FIG. 1. The third embodiment differs from the first embodiment mainly in the structure and operation of the printer unit.

As illustrated in FIG. 9, the printer unit of the third embodiment includes a photosensitive drum 10 as an image carrier, and, around the photosensitive drum 10, an optical writing unit, not shown, as an exposing unit; a photosensitive drum cleaning unit 111; a charger 13; a revolver developing unit 110; and an intermediate transfer unit 120. The printer unit also includes a transfer unit 130; an fixing unit 145; and a paper feed unit, a controller and so on, not shown, similar to those in the first embodiment.

The photosensitive drum cleaning unit 111 has a fur brush 111*b* and a photosensitive drum cleaning blade 111*c*, and is provided for cleaning the surface of the photosensitive drum 10 after primary transfer. The fixing unit 145 has a pair of fixing rollers 145*a,* and a pair of delivery rollers, not shown.

The revolver developing unit 110 has a Bk developing device 115; a C developing device 116; an M developing device 117; and a Y developing device 118. A developing position in the developing device of each color opposite to the photosensitive drum 10 can be determined by the revolution of the revolver developing unit 110.

The intermediate transfer unit 120 includes an intermediate transfer belt 121; a primary transfer bias roller 122 as a charge supply means; a primary transfer power supply 128 connected to the primary transfer bias roller 122; a ground roller 123 as a pre-primary transfer discharging means; a driving roller 124; a driven roller 125; a secondary transfer opposed roller 126; and a cleaning opposed roller 127. The intermediate transfer belt 121 is passed over the primary transfer bias roller 122, the ground roller 123, the driving roller 124, the driven roller 125, the secondary transfer opposed roller 126; and the cleaning opposed roller 127. The driving roller 124 is connected to a driving motor 124*a*. All the rollers, over which the intermediate transfer roller 121 is passed, are made of an electrically conductive material, and all the rollers except for the primary transfer bias roller 122 are respectively grounded. The primary transfer bias roller 122 is applied by the primary transfer power supply 128 with a predetermined primary transfer bias which is controlled to be a constant voltage or a constant current.

Around the intermediate transfer belt 121, there are disposed a discharging brush roller 151; a belt cleaning blade 129; and a transfer unit 130. These components are moved into and out of contact with the intermediate transfer belt 121 by respective contact/separation mechanisms, not shown, associated therewith.

Like the aforementioned first embodiment, the intermediate transfer belt 121 is formed in a multi-layer structure composed of a surface layer, an intermediate layer and a base layer. In addition, an adhesive layer is interposed between the intermediate layer and the base layer for adhering the two layers. The intermediate transfer belt 121 is formed to have a volume resistivity ρv in a range of $10^{12}$ Ωcm to $10^{14}$ Ωcm, and preferably equal to approximately $10^{13}$ Ωcm. Advantageously, with the intermediate transfer belt 21 having the volume resistivity ρv equal to or larger than $10^{12}$ Ωcm, dusts can be prevented from remaining on the intermediate transfer belt 121 after primary transfer. It should be noted that while in the third embodiment, the intermediate transfer belt 121 has high resistance surface layer and intermediate layer, and a middle resistance base layer with the volume resistivity ρv in a range of $10^{8}$ Ωcm to $10^{11}$ Ωcm, the intermediate transfer belt 121 is not limited to this particular structure. Also, the intermediate transfer belt 121 is made such that the surface resistivity on the surface layer side thereof is in a range of $10^{7}$ Ωcm to $10^{14}$ Ωcm.

The discharging brush 151 is connected to a variable discharge power supply 159 for applying the discharging brush 151 with a direct current voltage. The variable discharge power supply 159 in turn is connected to a control unit 160 which controls the direct current voltage applied to the discharging brush 151.

The transfer unit 130 has a paper transfer belt 134; a transfer cleaning blade 132 for cleaning the surface of the paper transfer belt 134; a secondary transfer bias roller 131 opposing a secondary transfer opposed roller 126 of the intermediate transfer unit 120; a secondary transfer power supply 139 connected to the secondary transfer bias roller 131; a first supporting roller 135*a* positioned at one end of the paper feed unit; a third supporting roller 135*c* opposing the transfer cleaning blade 132; a transfer paper discharger 136; and a transfer belt discharger 137. The paper transfer belt 134 is made of PVDF (polyvinylidene fluoride) to have a high volume resistance of $10^{13}$ Ωcm or higher. It should be understood that the transfer unit 130 is not limited to the foregoing structure, and that in an alternative, the transfer unit 130 may employ, for example, a member of a different shape such as a drum instead of the paper transfer belt 134.

Next, the operation of the copier according to the third embodiment will be described in connection with an illustrative image forming mode in which the development is performed in the order of Bk, C, M, Y. Before starting an image forming cycle, the photosensitive drum 10 is driven to rotate in a direction indicated by an arrow C in FIG. 9, i.e., in the counter-clockwise direction, causing the charger 113 to initiate corona discharge. In this event, in the third embodiment, the photosensitive drum 10 is uniformly charged at a predetermined potential with a negative charge. Also, the intermediate transfer belt 121 of the intermediate transfer unit 120 is driven at the same speed as the photosensitive drum 10 to rotate in a direction indicated by an arrow D, i.e., in the clockwise direction.

Like the aforementioned first embodiment, in the scanner unit, color image information of an original is read at a predetermined timing, and Bk image data derived from the image information is optically written onto the photosensitive drum 10 using laser light produced by the optical writing unit (for example, raster exposure). As a result, a Bk latent image is formed on the photosensitive drum 10 corresponding to the Bk image data. Subsequently, the Bk latent image formed on the photosensitive drum 10 is reversely developed with a negatively charged toner by the Bk developing device 115 in the revolver developing unit 110. In this way, a Bk toner image is formed on the photosensitive drum 10.

The Bk toner image thus formed on the photosensitive drum 10 is transferred to the surface of the intermediate transfer belt 121 by the action of a transfer electric field existing in a primary transfer region. The transfer electric field is formed by a charge given to the intermediate transfer belt 121 by the primary transfer bias roller 122. In this event, the primary transfer bias roller 122 is applied by the primary transfer power supply 128 with a primary transfer bias of a suitable magnitude. For example, the primary transfer bias may be at 1.5 kV for the first color (Bk) toner image; in a range of 1.6 to 1.8 kV for a second color (C) toner image; in a range of 1.8 to 2.0 kV for a third color (M) toner image; and in a range of 2.0 to 2.2 kV for a fourth color (Y) toner image. The toner used in the primary transfer and remaining on the photosensitive drum 10 after the development is removed by the photosensitive drum cleaning unit 111.

The image forming surface on the intermediate transfer belt 121, on which the Bk toner image has been transferred, is again returned to the primary transfer region. In this event, the discharging brush roller 151 and the belt cleaning blade 129 are moved away from the intermediate transfer belt 121 by respective contact/separation mechanisms associated therewith so as not to disturb the toner image. Further, the first supporting roller 135*a* and the secondary transfer bias roller 131 in the transfer unit 130 are moved by associated transfer contact/separation mechanisms, not shown, such that the secondary transfer bias roller 131 is moved away from the intermediate transfer belt 121. In this event, the secondary transfer power supply 139 connected to the secondary transfer bias roller 131 is inhibited from applying a voltage.

The above-mentioned state is held until the toner image transferred to the intermediate transfer belt 121 is transferred to a transfer paper 100.

After the Bk step is terminated, a C step is started on the photosensitive drum 10. Specifically, color image information of the original is again read at a predetermined timing, a C latent image is formed on the photosensitive drum 10 by laser light based on C image data derived from the image information, and a C toner image is formed by the C developing device 116.

In the third embodiment, after the trailing edge of the Bk latent image has passed, the revolver developing unit 110 is immediately rotated. The rotation of the revolver developing unit 110 is completed before the leading edge of the C latent image formed on the photosensitive drum 10 arrives at a developing position of the C developing device 116. In this way, the C developing device 116 is aligned to the developing position, so that it develops the C latent image coming up to the developing position with a C toner.

Subsequently, in either of an M step and a Y step, the formation of a latent image, development, and primary transfer are performed respectively based on their respective image data in a manner similar to the aforementioned C step. By transferring the respective Bk, C, M and Y toner images sequentially formed on the photosensitive drum 10 to the same image surface area on the intermediate transfer belt 21, a complete toner image formed of the four color images in accurate register with one another is formed on the intermediate transfer belt 21.

The complete toner image thus transferred to the intermediate transfer belt 121 is conveyed to the secondary transfer region for secondary transfer of the toner image to a transfer paper 100. In this event, the secondary transfer bias roller 131 of the transfer unit 130 is pressed against the intermediate transfer belt 121 by a transfer contact/separation mechanism, not shown. Subsequently, the secondary transfer bias roller 131 is applied with a predetermined secondary transfer bias to form a secondary transfer electric field in the secondary transfer region. The secondary transfer electric field causes the toner image on the intermediate transfer belt 121 to be transferred to the transfer paper 100. The transfer paper 100 is fed into the secondary transfer region at the timing coincident with the arrival of the leading edge of the toner image on the intermediate transfer belt 121 to the secondary transfer region.

The transfer paper 100, on which the complete toner image formed of four color toner images in accurate register with one another has been collectively transferred from the intermediate transfer belt 121, is subsequently conveyed to an area opposite to the transfer paper discharger 136 in the transfer unit 130. When the transfer paper 100 passes this opposing area, the transfer paper 100 is discharged by the transfer paper discharger charger 136 now in operative state, and separated from the paper transfer belt 134. Then, the separated transfer paper 100 is conveyed to pass between the pair of fixing rollers 145*a* of the fixing unit 145. The unfixed toner image on the transfer paper 100 is melted in a fixing region formed of a nip between the fixing rollers 145*a,* and the unfixed toner image is fixed. Then, after the fixation, the transfer paper 100 is conveyed to and stacked on the copy tray 46.

After the secondary transfer, the belt cleaning blade 129 is pressed against the intermediate transfer belt 121 by a contact/separation mechanism, not shown, to remove the toner used in the secondary transfer and remaining on the surface of the intermediate transfer belt 121. In addition, the charge remaining on the surface of the paper transfer belt 134, after the transfer paper 100 has been separated, is discharged by the transfer belt discharger 137. Furthermore, the surface of the paper transfer belt 134 is cleaned by the transfer cleaning blade 132.

Figure 10:
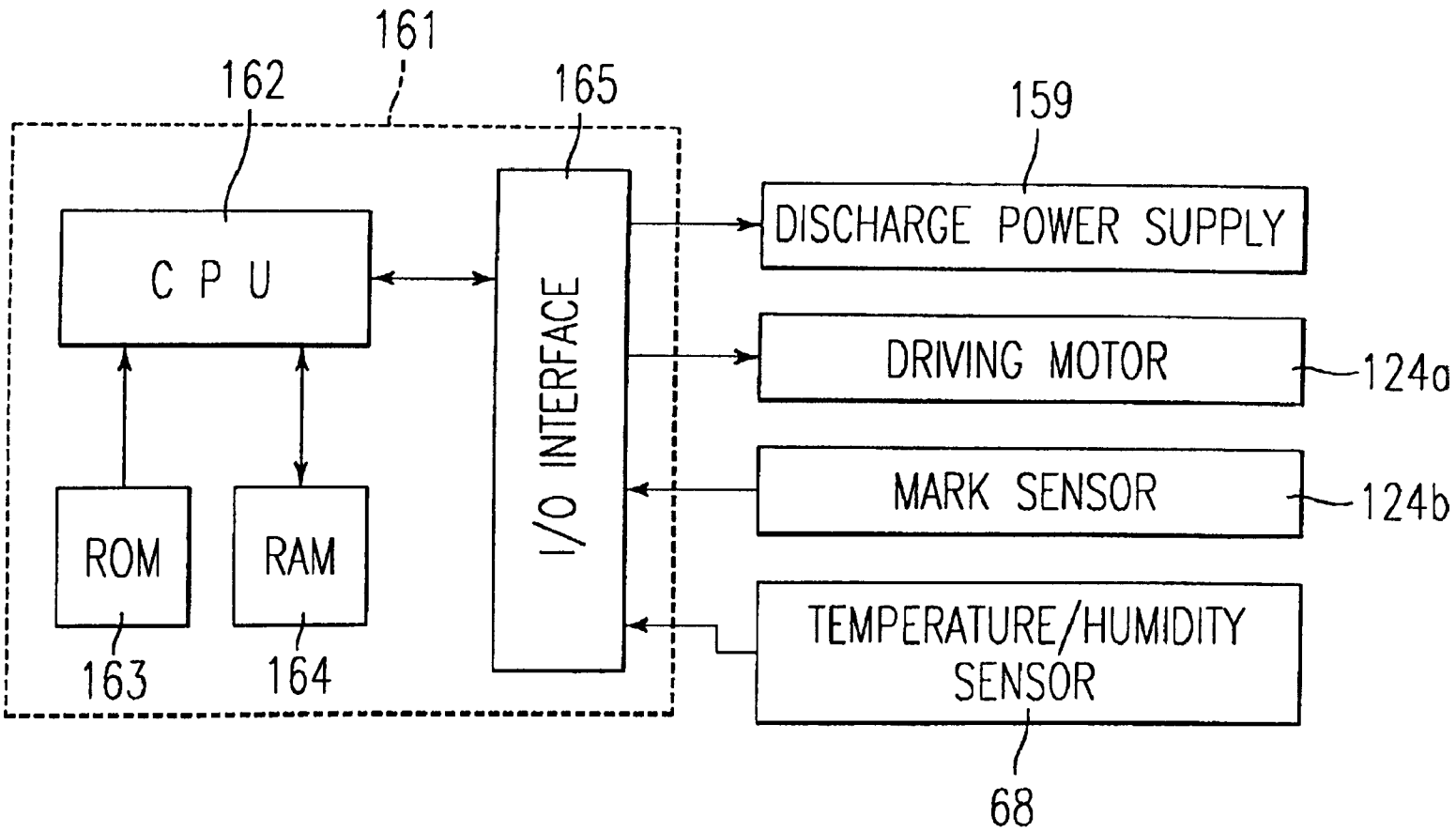
FIG. 10 illustrates a block diagram of an exemplary controller of the image forming apparatus of FIG. 9.

In the following, description will be made on the operation of the control unit 160 which constitutes a characterizing portion of the third embodiment. FIG. 10 is a block diagram illustrating the configuration of a controller 161 in the control unit 160. The controller 161 has the same configuration as the second embodiment previously described with reference to FIG. 4. The controller 161 has an I/O interface 165 which is connected to the variable discharge power supply 159; a driving motor 124*a* coupled to a driving roller 124 for driving the intermediate transfer belt 121; and a mark sensor 124*b* for detecting a mark attached on the inner peripheral surface of the intermediate transfer belt 21 for detecting a rotating position. The variable discharge power supply 159 for applying the discharging brush 151 with a direct current voltage is turned ON/OFF at a timing that is set based on an output signal of the mark sensor 124*b*. In the third embodiment, the control unit 160 variably controls the direct current voltage generated by the variable discharge power supply 159 in accordance with a potential on the surface of the intermediate transfer bent 121, a surface moving speed of the same, and the temperature and humidity around the intermediate transfer belt 121.

For controlling the direct current voltage of the variable discharge power supply 159 in accordance with the surface potential on the intermediate transfer belt 121, data on a copy mode of the copier is supplied to a CPU 162 in the controller 161 of the control unit 160. For controlling the direct current voltage of the variable discharge power supply 159 in accordance with the surface moving speed of the intermediate transfer belt 121, data on the rotating speed of the driving motor 124*a* for driving the driving roller 124 is supplied to the CPU 162. For controlling the direct current voltage of the variable discharge power supply 159 in accordance with temperature and humidity conditions around the intermediate transfer belt 121, the CPU 162 is supplied with temperature data and humidity data through the I/O interface 165 from a temperature and humidity sensor 68 which is disposed near the position at which the discharging brush 151 contacts the intermediate transfer belt 121, and connected to the I/O interface 165.

Then, the CPU 162 in the controller 161 calculates an optimal discharging bias based on the various data supplied thereto, and forces the variable discharge power supply 159 to apply the discharging brush 151 with an optimal direct current voltage.

It should be understood that the copier according to the third embodiment can be used not only in the foregoing full-color copy mode but also in any other copy mode, as is the case of the aforementioned first embodiment.

Now, description will be made on one implementation of the present invention which uses the copier according to the third embodiment and a combination of the second, third and fourth examples in the second embodiment for controlling a discharging bias.

Explained first is an experiment conducted to reveal the relationship between a residual potential on the intermediate transfer belt and a discharging bias or a direct current voltage applied to the contact-type discharge member for removing the residual potential. In this experiment, the control unit 160 of the copier was not used.

The experiment involved measurements of affected images produced when an image forming process was executed with a residual potential maintained on the intermediate transfer belt 121. It is desired that the intermediate transfer belt is discharged such that the surface potential is at zero volt on the intermediate transfer belt after the discharging. Actually, however, it is extremely difficult to bring the surface potential exactly to zero volt by the discharging.

Also, when the intermediate transfer belt is discharged insufficiently, the next primary transfer step is performed with a potential of the same polarity as that of a toner held on the intermediate transfer belt, resulting in an insufficient transfer bias and accordingly an incomplete transfer which will lead to an affected image. On the other hand, excessive discharging causes the intermediate transfer belt 121 to have a surface potential of the opposite polarity to the toner. The next primary transfer performed on the intermediate transfer belt 121 with the surface potential of the opposite polarity would result in a so-called pre-transfer where the primary transfer is performed before the primary transfer region, which leads to deteriorated dot reproductivity and consequently an affected image. To solve this problem, the inventors of the present invention and others measured the relationship between a surface potential Vb on the intermediate transfer belt 121 after discharging (hereinafter referred to as the "post-discharge potential Vb") and affected images, and concluded in Table 2 below.

TABLE 2

| | Post-Discharge Potential Vb (volts) | | |
|---|---|---|---|
| | Vb < −300 | −300 Vb 300 | Vb > 300 |
| Affected Image Due to Pre-Transfer | ○ | ○ | X |

TABLE 2-continued

| | Post-Discharge Potential Vb (volts) | | |
|---|---|---|---|
| | Vb < −300 | −300 Vb 300 | Vb > 300 |
| Affected Image Due to Insufficient Transfer | X | ○ | ○ |

Thus, the measurements revealed that when the absolute value of the post-discharge potential Vb on the intermediate transfer belt 121 is at least 300 volts or less, images can be produced without affecting much by pre-transfer or insufficient transfer.

Figure 11A:
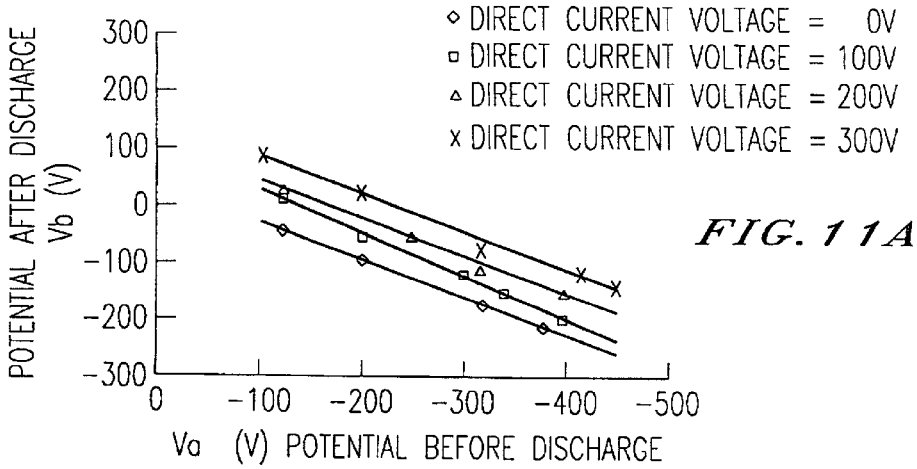
FIGS. 11A–11C are graphs for explaining experimental results with variations of environmental conditions on an implementation version based on the image forming apparatus of FIG. 9.
Figure 11B:
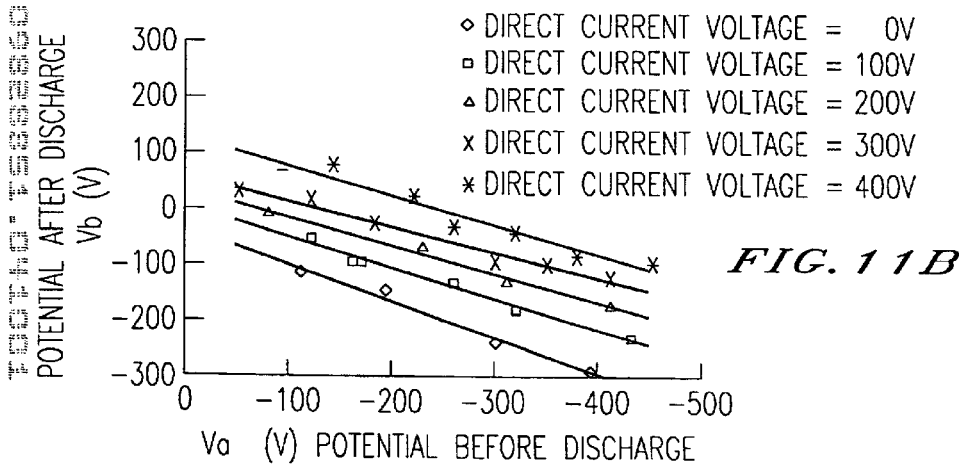

Keeping the foregoing measurement results in mind, the inventors of the present invention and others next conducted an experiment for revealing the relationship between a surface potential Va on the intermediate transfer belt 121 after a secondary transfer step has been completed and before the intermediate transfer belt 121 is discharged (hereinafter referred to as the "pre-discharge potential Va) and the post-discharge potential Vb, with a varying direct current voltage applied to the discharging brush roller. FIG. 11A is a graph showing the result of the experiment conducted at temperature of 23° C. and humidity of 65% (in a laboratory environment); FIG. 11B is a graph showing the result of the experiment conducted at temperature of 10° C. and humidity of 15% (in an low temperature and low humidity (L.L.) environment); and FIG. 11C is a graph showing the result of the experiment conducted at temperature of 27° C. and humidity of 80% (in a high temperature and high humidity (H.H.) environment).

Figure 11C:
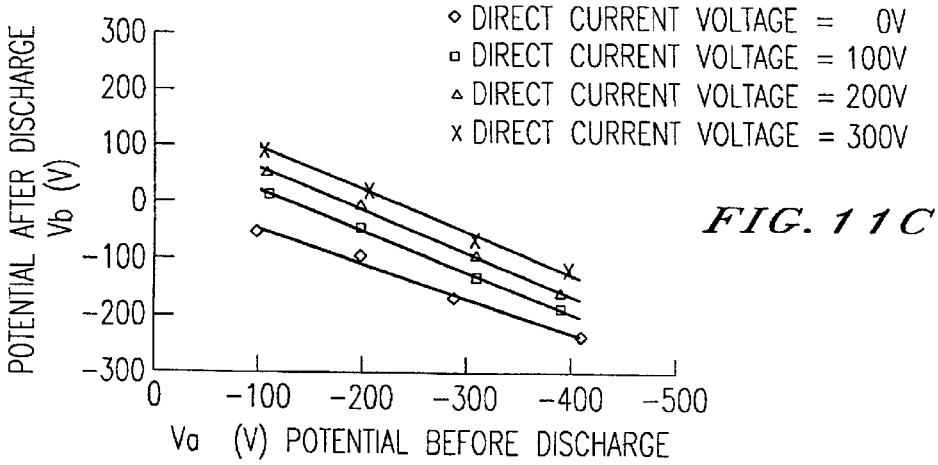

In each of FIGS. 11A, 11B, 11C, it can be said that each plot is substantially linear when the pre-discharge potential Va on the intermediate transfer belt 121 is at −100 volts or less. From the results of the experiment represented by the graphs, the relationship between the pre-discharge potential Va, the post-discharge potential Vb, and a direct current voltage V applied to the discharging brush 151 can be expressed substantially by the following Equation 1:

$$Vb=0.65Va+(25+V/2) \quad \text{(Equation 1)}$$

The post-discharge potential Vb which meets the condition of producing images with less pre-transfer and with sufficient transfer must fall within a range expressed by:

$$-300 \leqq Va \leqq 300 \quad \text{(Equation 2)}$$

Therefore, the direct current voltage V applied to the discharging brush 151 for ensuring images with less pre-transfer and with sufficient transfer can be expressed by:

$$1.3Va-650 \leqq V \leqq -1.3Va+550 \quad \text{(Equation 3)}$$

In this implementation, the intermediate transfer belt 121 is formed to have a thickness of 0.15 mm, a width of 368 mm, and an inner peripheral length of 565 mm, and a surface moving speed of the intermediate transfer belt 121 is set at 200 mm/s. Also, the surface layer of the intermediate transfer belt 121 is formed of an insulating layer having a thickness of approximately 1 μm. The intermediate layer of the intermediate transfer belt 121 is formed of polyvinylidene fluoride in a thickness of approximately 75 μm. The volume resistivity ρv of the intermediate layer is $9\times10^{12}$ Ωcm when measured using a resistance measuring instrument "High Rester IP" manufactured by Yuka Denshi at temperature of 25° C. and humidity of 45% with a voltage of 100 volts applied thereto for 10 seconds, and $6\times10^{12}$ Ωcm when measured in the same environment using the same instrument with a voltage of 500 volts applied thereto for 10 seconds. The base layer is formed of PVDF and titanium oxide in a thickness of approximately 75 μm. The volume resistivity ρv of the base layer is $7\times10^{7}$ Ωcm when measured in the same environment using the same instrument with a voltage of 100 volts applied thereto for 10 seconds.

The surface resistance on the surface of the surface layer of the intermediate transfer belt 121 is $10^{13}$ Ωcm when measured with resistance measuring instrument "High Rester IP" manufactured by Yuka Denshi. Other than this resistance measuring instrument, the surface resistivity may be measured in accordance with the surface resistance measuring method described in JISK6911.

In this implementation, the primary transfer bias roller 122 may be a nickel plated metal roller, and the ground roller 123 may be a metal roller. Other rollers may be metal rollers or rollers made of any conductive resin.

The primary transfer bias roller 122 is applied with a direct current primary transfer bias at 1.5 kV for the first color (Bk) toner image; 1.7 kV for the second color (C) toner image; 1.9 kV for the third color (M) toner image; and 2.1 kV for the fourth color (Y) toner image. The width of the nip in the primary transfer region is set to be 10 mm.

The transfer unit 130 uses the secondary transfer bias controller 131 implemented by a roller having a surface layer made of a conductive sponge or a conductive rubber, and a core layer made of a metal or a conductive resin. The secondary transfer bias roller 131 is applied with a transfer bias that is a current regulated in a range of 10 to 50 μA. Appropriate values within this range are used depending on copy modes available to the copier and types of used transfer papers. Specific values for the regulated current for different types of papers and different modes are shown in Table 3 below.

TABLE 3

| | Secondary Transfer Current (μA) |
|---|---|
| Normal Paper (1C Mode) | 25 |
| Normal Paper (4C Mode) | 35 |
| Thick Paper (1C Mode) | 14 |
| Thick Paper (4C Mode) | 18 |
| Very Thick Paper (1C Mode) | 16 |
| Very Thick Paper (4C Mode) | 20 |

The paper transfer belt 134 is formed of a PVDF-based material having a volume resistivity ρv of $10^{13}$ Ωcm in a thickness of 100 μm. The transfer paper discharger 136 and the transfer belt discharger 137 are implemented by dischargers which are applied with an alternate current voltage or with a combination of alternate current and direct current voltages. The transfer cleaning blade 132 is in contact with the surface of the paper transfer belt 134 on the opposite side of the third supporting roller 135*c*.

The temperature and humidity sensor 68 described in the third example of the second embodiment is connected to the I/O interface 165 of the controller 161. Data on temperature and humidity around the intermediate transfer belt 121 sensed by the temperature and humidity sensor 68 is supplied to the CPU 162 in the controller 161. The CPU 162 is also supplied with information on a copy mode, in which the copier is to operate to produce the next copy, for controlling the discharging bias in accordance with the surface potential on the intermediate transfer belt 121, more specifically, in accordance with the number of times toner images are transferred or superimposed onto the intermediate transfer belt 121. Assume in this implementation that three types of copy modes, 1C mode, 2C mode and 4C mode, are available to the copier. The CPU 162 is further supplied with information on a transfer paper on which the copier produces a copy next time, more specifically, information for discriminating whether a normal paper, a thick paper, a very thick paper or an OHP sheet is used. Assume in this implementation that when the copier produces copies on normal papers at a normal speed, the speed of producing copies on thick papers, very thick papers and OHP sheets is one half of the normal speed.

As described above, this implementation employs a variable discharge power supply such as 159, and the discharging bias applied to the discharging brush roller 151 is set as shown in the following Table 4, Table 5 and Table 6 in accordance with the aforementioned results of the experiments.

TABLE 4

| | Discharging Bias V (volts) |
|---|---|
| 1C Mode (Normal Speed) | 0 |
| 2C Mode (Normal Speed) | 0 |
| 4C Mode (Normal Speed) | 50 |
| 1C Mode (Half Speed) | 0 |
| 2C Mode (Half Speed) | 0 |
| 4C Mode (Half Speed) | 50 |

Note:
at temperature of 23° C. and humidity of 65%

TABLE 5

| | Discharging Bias V (volts) |
|---|---|
| 1C Mode (Normal Speed) | 0 |
| 2C Mode (Normal Speed) | 50 |
| 4C Mode (Normal Speed) | 350 |
| 1C Mode (Half Speed) | 0 |
| 2C Mode (Half Speed) | 50 |
| 4C Mode (Half Speed) | 350 |

Note:
at temperature of 10° C. and humidity of 15%

TABLE 6

| | Discharging Bias V (volts) |
|---|---|
| 1C Mode (Normal Speed) | 0 |
| 2C Mode (Normal Speed) | 0 |
| 4C Mode (Normal Speed) | 50 |
| 1C Mode (Half Speed) | 0 |
| 2C Mode (Half Speed) | 0 |
| 4C Mode (Half Speed) | 50 |

Note:
at temperature of 27° C. and humidity of 80%

Figure 12:
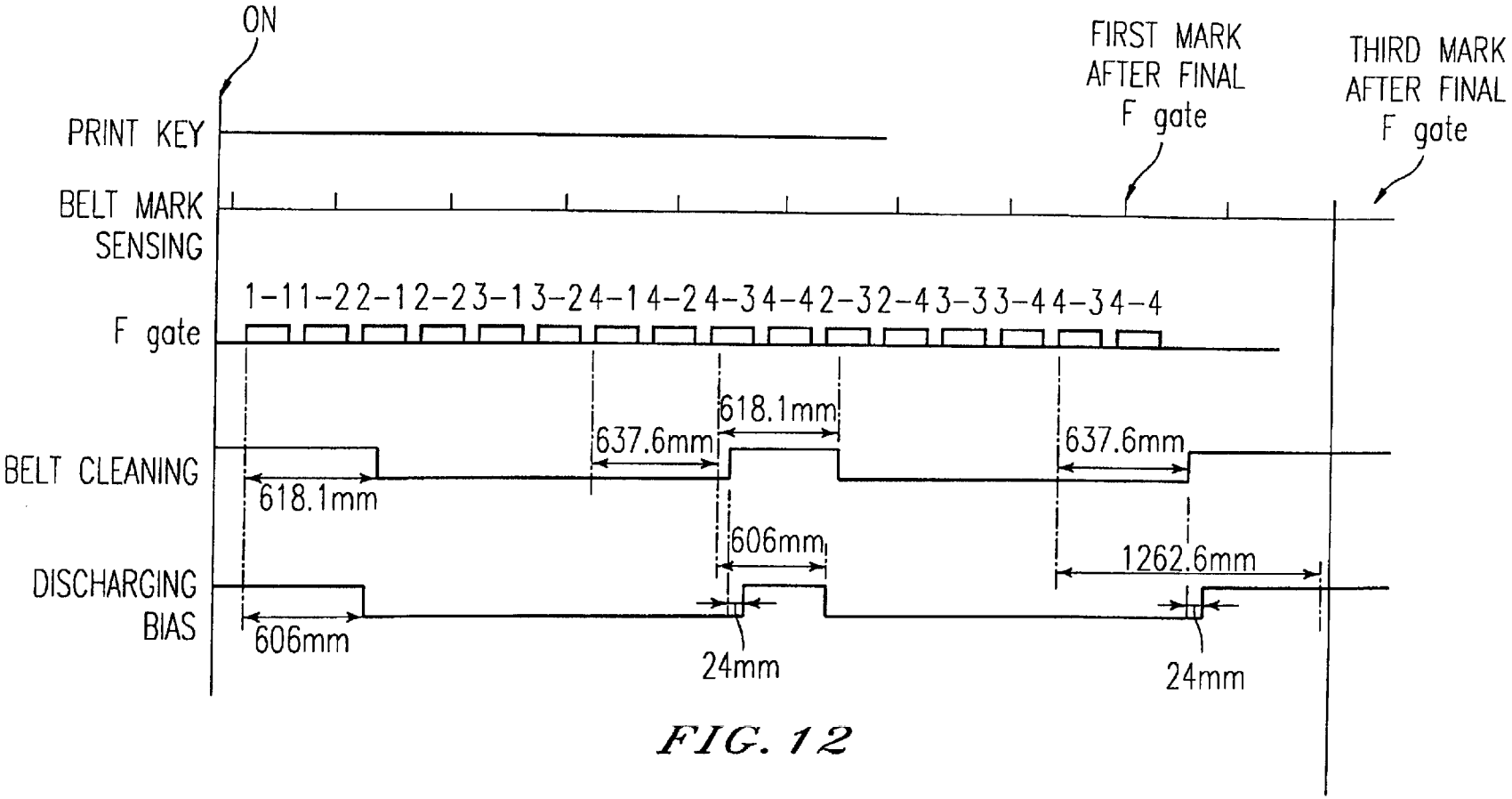
FIG. 12 is a time chart for explaining a timing of application of a discharging bias in the implementation version of the image forming apparatus of FIG. 9.

Also in this implementation, four copies are produced from a single original sheet using normal papers of A4 size. It should be noted that in this implementation, the intermediate transfer belt 121 is formed with an image surface area for accommodating two images to speed the image formation. During the image formation, the discharging brush roller 151 is applied with a discharging bias at a timing which is controlled in accordance with a timing chart as illustrated in FIG. 12. The discharging brush roller 151 is moved into and out of contact with the intermediate transfer belt 121 in association with timings at which the belt cleaning blade 129 which is moved into and out of contact with the intermediate transfer belt 121. As illustrated in FIG. 12, the discharging bias is controlled in the following manner. The discharging bias is applied when the surface of the intermediate transfer belt has moved by 24 mm after the discharging brush roller 151 had been brought into contact with the intermediate transfer belt 121. Then, the applied discharging bias is removed slightly before the discharging brush 151 is moved out of contact with the intermediate transfer belt 121.

Embodiment 4

Next, a fourth embodiment of the present invention will be described in connection with a full color electronic photocopier (hereinafter simply referred to as the "copier"), that is, an image forming apparatus in which the present invention is applied.

Figure 13:
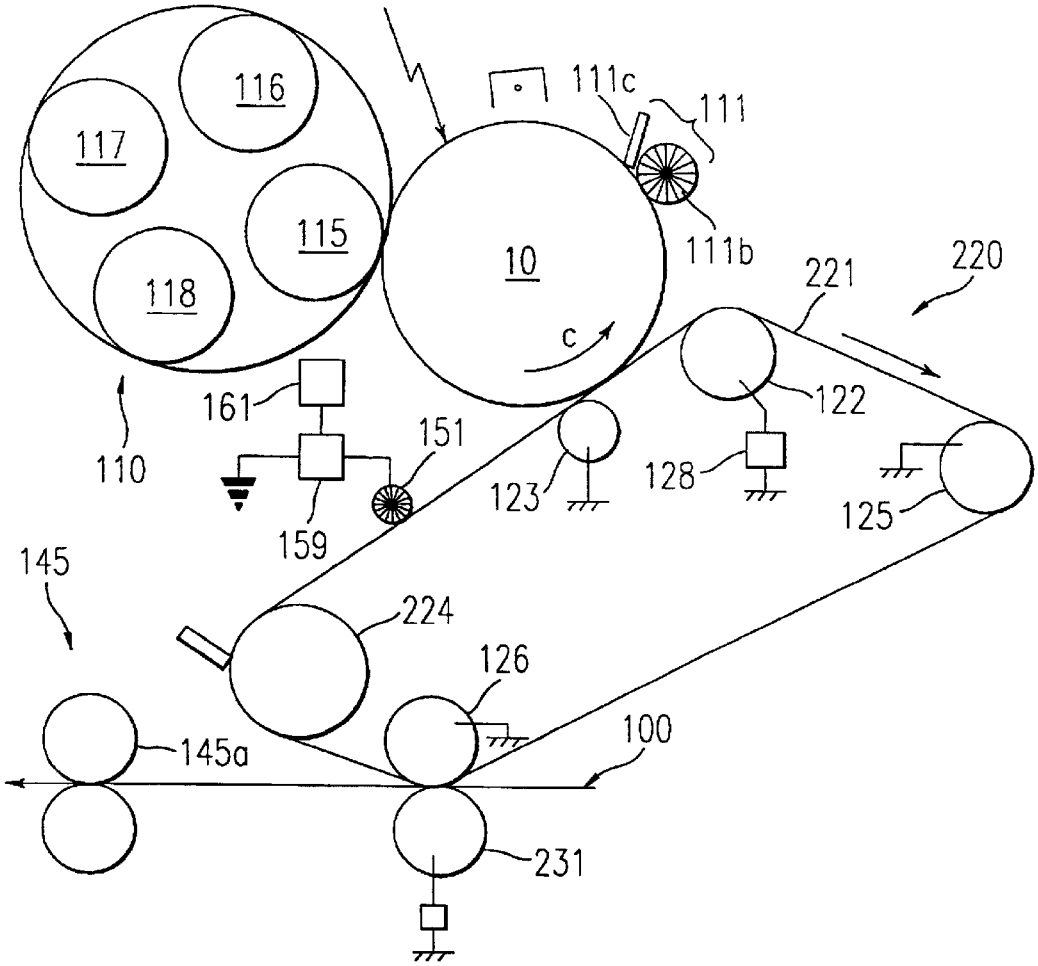
FIG. 13 illustrates a main portion of a printer of an image forming apparatus according to a fourth embodiment of the present invention.

FIG. 13 schematically illustrates the configuration of a main portion in a printer unit of the copier according to the fourth embodiment. In general, the illustrated copier, which is intended for a reduction in cost, differs from the copier according to the second embodiment only in the following aspects. Therefore, similar constituent members in the fourth embodiment are designated the same reference numerals as those in the second embodiment, and description thereon is omitted.

In the fourth embodiment, an intermediate transfer belt 221 forming part of an intermediate transfer unit 220 has a middle resistance intermediate layer with a volume resistivity ρv in a range of $10^8$ Ωcm to $10^{11}$ Ωcm. Also, the intermediate transfer belt 221, as a whole, has a volume resistivity ρv in a range of $10^{10}$ Ωcm to $10^{12}$ Ωcm. Further, the intermediate transfer belt 221 is made to have a surface resistivity on the surface side in a range of $10^7$ Ωcm to $10^{14}$ Ωcm. More specifically, the intermediate layer is formed of PVDF and titanium oxide with the volume resistivity ρv of $5\times10^{12}$ Ωcm when measured using the aforementioned resistance measuring instrument "High Rester IP" manufactured by Yuka Denshi at temperature of 25° C. and humidity of 45% with a voltage of 100 volts applied thereto for 10 seconds, and $2\times10^{11}$ Ωcm when measured in the same environment using the same instrument with a voltage of 500 volts applied thereto for 10 seconds. The surface layer of the intermediate transfer belt 221 is formed of an insulating layer having a thickness of approximately 1 μm. The base layer is formed of PVDF and titanium oxide in a thickness of approximately 75 μm. The volume resistivity ρv of the base layer is $7\times10^7$ Ωcm when measured in the same environment using the same instrument with a voltage of 100 volts applied thereto for 10 seconds. In addition, a surface moving speed of the intermediate transfer belt 221 is set at 156 mm/s. The use of the intermediate transfer belt 221 having such a middle resistance can prevent uneven charging from occurring on the surface of the intermediate transfer belt 221 after primary transfer. Additionally, in the fourth embodiment, a driving roller 224 in the intermediate transfer unit 220 is disposed downstream of a secondary transfer region and upstream of a primary transfer region in a direction of movement of the intermediate transfer belt 221. Then, a belt cleaning blade 129 is disposed opposite to the driving roller 224, so that the driving roller 224 may also serve as the cleaning opposed roller 127 that is used in the third embodiment.

A primary transfer bias roller 122 is applied with a direct current primary transfer bias at 1.7 kV for the first color (Bk) toner image; 1.8 kV for the second color (C) toner image; 1.9 kV for the third color (M) toner image; and 2.0 kV for the fourth (Y) toner image.

The fourth embodiment employs, as a transfer means, a secondary bias roller 231 disposed opposite to a secondary transfer opposed roller 126 in the intermediate transfer unit 220, instead of the transfer unit used in the third embodiment. Thus, a fed transfer paper 100 is sandwiched between a secondary transfer bias roller 234 and the intermediate transfer belt 221, and conveyed to pass between a pair of fixing rollers 145*a* of a fixing unit 145. The configuration as described results in a reduction in the number of constituent members required for the secondary transfer step and accordingly a reduced cost as compared with the third embodiment.

The secondary transfer bias roller 231 is implemented by a roller made of conductive rubber, and is applied with a transfer bias that is a regulated current having values as shown in Table 7 below.

TABLE 7

| | Secondary Transfer Current (μA) |
|---|---|
| Normal Paper (1C Mode) | 10 |
| Normal Paper (4C Mode) | 18 |
| Thick Paper (1C Mode) | 8 |
| Thick Paper (4C Mode) | 10 |
| Very Thick Paper (1C Mode) | non |
| Very Thick Paper (4C Mode) | non |

Embodiment 5

Next, a fifth embodiment of the present invention will be described in connection with an image forming apparatus which employs a transfer material carrier such as a belt for carrying and conveying a transfer material such as a paper, an OHP sheet or the like, and to which the present invention is applied.

Figure 14:
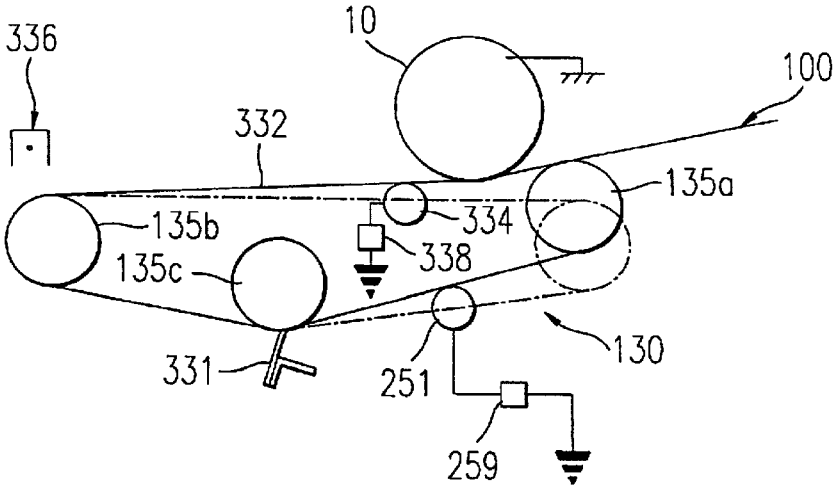
FIG. 14 illustrates an exemplary transfer unit of an image forming apparatus according to a fifth embodiment of the present invention.

FIG. 14 schematically illustrates the configuration of a transfer unit equipped in the copier according to the fifth embodiment. In the fifth embodiment, the present invention is utilized in a transfer material carrier for carrying and conveying a transfer material rather than in an intermediate transfer unit as in the foregoing embodiments.

The transfer unit 330 has a paper transfer belt 332 for carrying and conveying a transfer material such as a paper, an OHP sheet or the like; a cleaning blade 331 for cleaning the surface of the paper transfer belt 332; a ground roller 335*a* positioned at one end of a paper feed unit, not shown, and serving as a pre-transfer discharging means; a transfer bias roller 334 as a charge supply means; a transfer power supply 338 connected to the transfer bias roller 334; a tension roller 335*b* positioned at one end of a fixing unit, not shown; a cleaning opposed roller 335*c* disposed opposite to the cleaning blade 331 for aiding the cleaning blade 331 in cleaning the surface of the paper transfer belt 332; a transfer paper discharger 336; and a discharge roller 251 which is a contact-type discharge member. The paper transfer belt 332 used in the fifth embodiment may be formed of a middle resistance material having a volume resistivity ρv in a range of $10^8$ Ωcm to $10^{11}$ Ωcm. It should be understood that the transfer unit 330 is not limited to this configuration, and that in an alternative, the transfer unit 330 may employ, for example, a member of a different shape such as a drum instead of the paper transfer belt 332.

The copier according to the fifth embodiment forms a toner image on a photosensitive drum 10 serving as an image carrier in a well known electronic photographic process, and transfers the toner image to a transfer material, or a transfer paper 100 in this embodiment, fed into a transfer region defined by a transfer nip formed between the photosensitive drum 10 and the paper transfer belt 332. In this event, an intermediate transfer belt may also be used as the image carrier instead of the photosensitive drum 10.

The ground roller 335*a* is disposed downstream of the transfer region in a direction of movement of the paper transfer belt 332 (hereinafter referred to as the "paper transfer belt moving direction) . On the other hand, the transfer bias roller 334 is disposed upstream of the transfer region in the paper transfer belt moving direction. The transfer bias roller 334 is applied with a predetermined transfer bias from the transfer power supply 338, whereby a transfer electric field is formed in the transfer region. Then, a toner image on the photosensitive drum 10 is transferred to the transfer paper 100 which is carried on and conveyed by the paper transfer belt 332. Then, the transfer paper 100, which has received the toner image transferred thereto, passes through a separation region in which the transfer paper 100 is discharged by the transfer paper discharger 336 to separate the transfer paper 100 from the paper transfer belt 332. Then, the transfer paper 100 separated from the paper transfer belt 332 is conveyed to a fixing unit, not shown.

An area of the paper transfer belt 332, from which the transfer paper 100 has been separated, is cleaned by the cleaning blade 331. The discharge roller 251 is disposed downstream of the cleaning blade 331 in the paper transfer belt moving direction, such that the paper transfer belt 332 is discharged by the discharge roller 251. The discharge roller 251 is grounded through the discharge power supply 259. The discharger roller 251 is applied by the discharge power supply 259 with a direct current or an alternate current discharging bias, or a combination of direct current and alternate current discharging biases. In this event, when a direct current power supply for applying a direct current voltage is employed as the discharge power supply, a reduction in cost is expected. The fifth embodiment employs a regulated direct current power supply as the discharge power supply 259.

It is also possible to employ a variable discharge power supply to vary a direct current voltage applied to the discharge roller 251 in accordance with a variety of factors which may cause variations in an optimal value for the discharging bias, in a manner similar to the discharging of the intermediate transfer belt in the aforementioned embodiments.

While the fifth embodiment has been described as employing a photosensitive drum as an image carrier for an illustrative purpose, the present invention can be applied to other image carriers having different structures, for example, to an endless photosensitive belt which is passed over two rollers for endless movement. In addition, while the fifth embodiment employs a bias roller as a charge supply means for use in the primary transfer or the secondary transfer for an illustrative purpose, other members of different shapes such as a blade, a brush and so on may also be employed instead. Similarly, while the fifth embodiment employs a ground roller as a pre-transfer discharging means for an illustrative purpose, other members of different shapes such as a blade, a brush and so on may also be employed instead.

Also, while the aforementioned first to fourth embodiments have each employed an intermediate transfer belt as an intermediate transfer body for an illustrative purpose, the present invention can be applied to other intermediate transfer bodies having configurations different from the foregoing, for example, an intermediate transfer drum, an intermediate transfer roller, and so on. Further, the electric characteristic such as the surface resistivity or the like, structure, thickness and so on of the intermediate transfer belt may be selected as appropriate depending on specific applications which may require different image forming conditions.

Furthermore, the foregoing embodiments have illustrated a developing unit which employs a reverse developing mode in which the photosensitive drum is negatively charged, and a two-component based developer is used. The present invention, however, is not limited to any specific developer or the polarity of a charging potential on the photosensitive drum, and can be applied to any image forming apparatus which may employ a one-component based developer, a normal developing mode, or the like.

Embodiment 6

Figure 15:
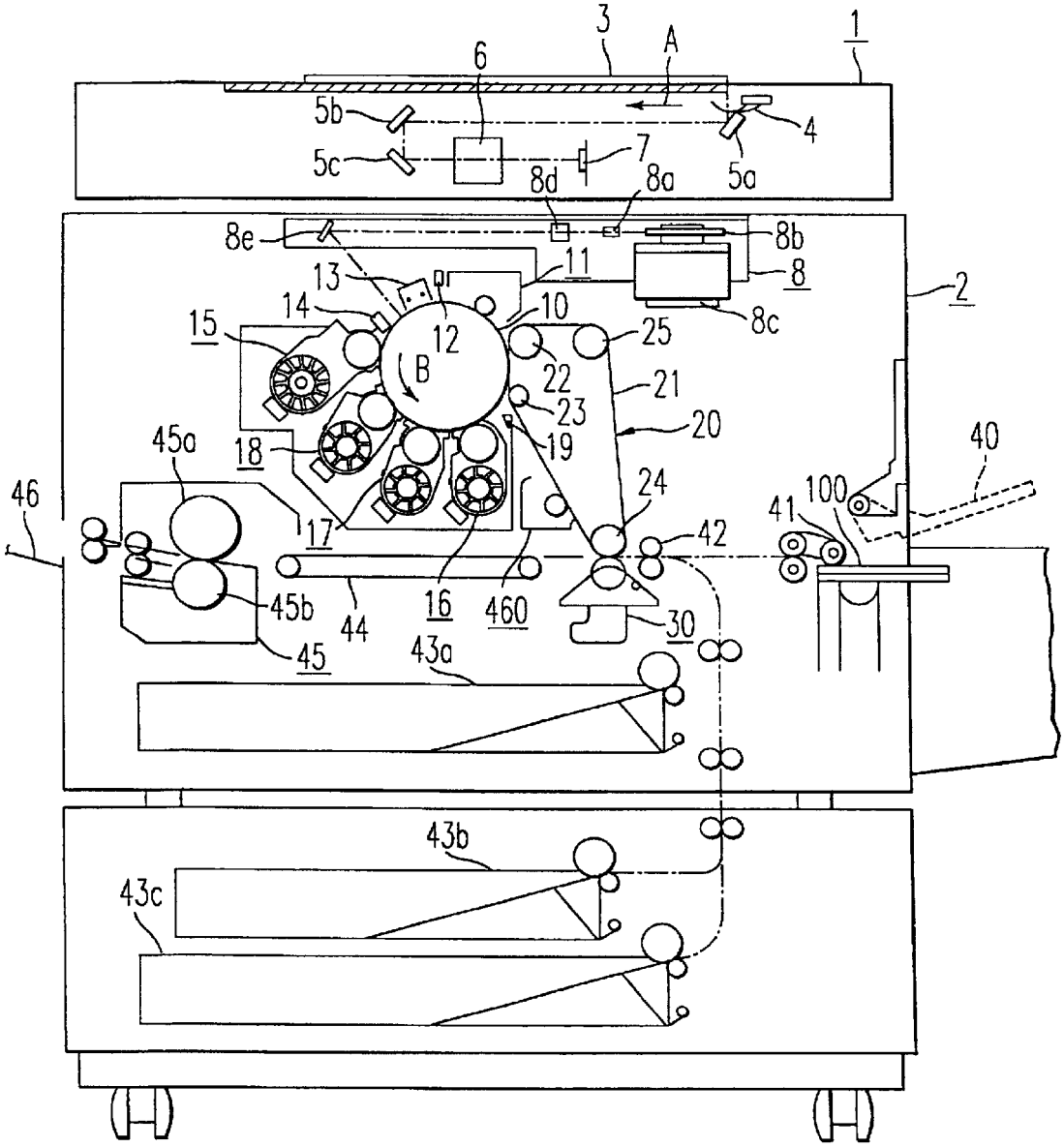
FIG. 15 illustrates an exemplary configuration of an image forming apparatus according to a six embodiment of the present invention.
Figure 16:
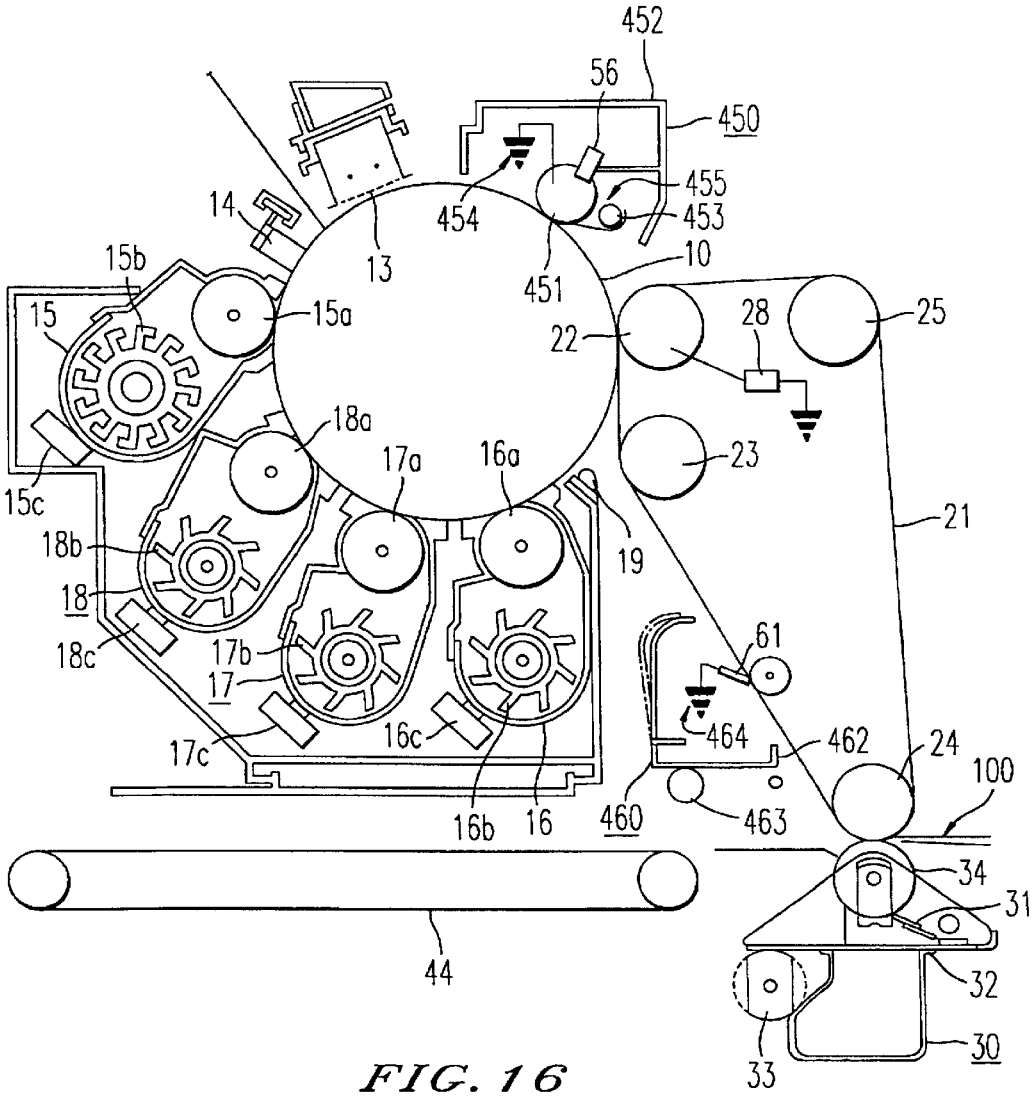
FIG. 16 illustrates an exemplary structure around a photosensitive drum of the image forming apparatus of FIG. 15.
Figure 17:
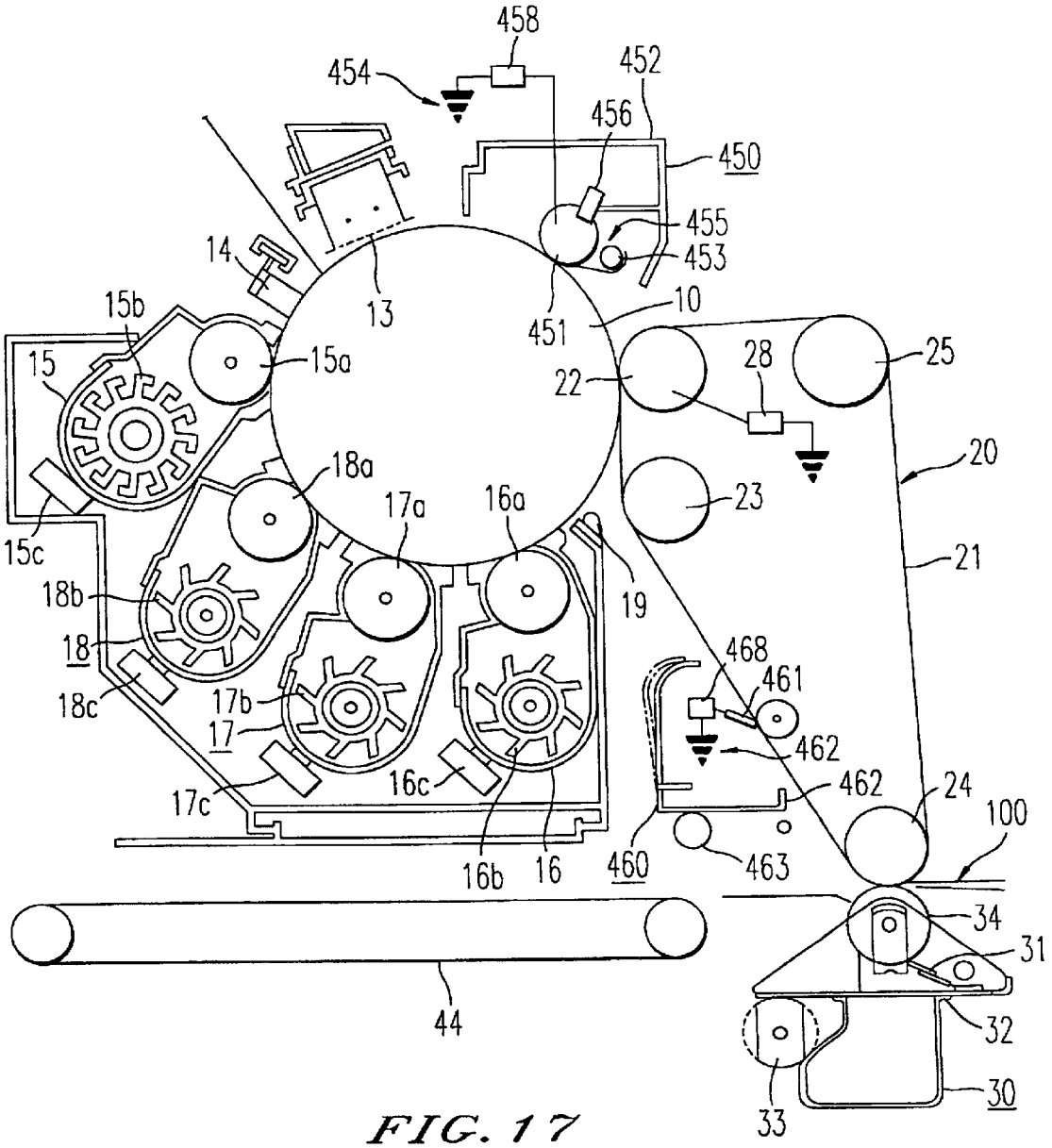
FIG. 17 illustrates an exemplary structure around a photosensitive drum of a modified version of the image forming apparatus of FIG. 15.

Referring next to FIGS. 15 to 17, a sixth embodiment of the present invention will be described in connection with a full color electronic photocopier (hereinafter simply referred to as the "copier"), that is, an image forming apparatus in which the present invention is applied.

FIG. 15 is a cross-sectional view schematically illustrating the configuration of the copier according to the sixth embodiment, and FIG. 16 is an enlarged view schematically illustrating the structure around a photosensitive drum 10 in the copier of FIG. 15. The following description will be mainly focused on only those portions which are different from the first embodiment illustrated in FIGS. 1 and 2.

A photosensitive drum cleaning unit 450 has, within a casing 452, a fur brush 451 as a cleaning member; a residual toner recovering container 455 for containing the toner remaining after first transfer and swept away by the fur brush 451; and a flicker 456 for removing residual toner attached on the fur brush. The photosensitive drum cleaning unit 450 is provided for cleaning the surface of the photosensitive drum 10 after primary transfer.

Around an intermediate transfer belt 21, there are disposed a belt cleaning unit 460, and a transfer unit 30. The belt cleaning unit 460 is provided with a cleaning blade 461 disposed within a casing 462, and a cleaning contact/separation mechanism 463 for moving the cleaning blade 461 into and out of contact with the intermediate transfer belt 21 as required.

In addition, the transfer unit 30 has a secondary transfer bias controller 34 opposing a driving roller 24 of the intermediate transfer unit 20; a cleaning blade 31 disposed within a casing 32; and a transfer contact/separation mechanism 33. The transfer contact/separation mechanism 33 enables the secondary transfer bias controller 34 to come into contact with and separate away from the intermediate transfer belt 21.

During a time period in which a complete toner image is formed on the intermediate transfer belt 21, specifically, during a time period from the time the first color (Bk) toner image had been transferred to the intermediate transfer belt 21 to the time the fourth color (Y) toner image has been transferred to the same, the cleaning blade 461 of the belt cleaning unit 460 and the secondary bias roller 34 of the transfer unit 30 are separated away from the intermediate transfer belt 21 by the respective contact/separation mechanisms (463, 33) associated therewith.

While the operation of the copier has been described in connection with a copy mode for producing full-color copies, the same description is applicable to other copy modes, i.e., a three-color copy mode and a two-color copy mode, except that used colors and associated mechanisms are different. For a single-color copy mode, a developer in a developing device associated with a selected color is maintained to form a sleeve or ear, i.e., the developing device is maintained in operative state until a predetermined number of copies have been produced. Also, with the belt cleaning unit 460 and the transfer unit 30 maintained in contact with the intermediate transfer belt 21 and with the intermediate transfer belt 21 maintained in contact with the photosensitive drum 10, the intermediate transfer belt 21 is driven in the forward direction at a constant speed for producing copies.

In the following, description will be made on the configurations and operations of characterizing portions of the sixth embodiment, i.e., the photosensitive drum cleaning unit 450 for cleaning the photosensitive drum 10; the cleaning unit 460 for cleaning the intermediate transfer belt 21; and the cleaning blade 31 for cleaning the secondary transfer bias roller 34 of the transfer unit 30.

First, the photosensitive drum cleaning unit 450 will be described in terms of its configuration with reference to FIG. 16. Essentially, the photosensitive cleaning unit 450 of the sixth embodiment simultaneously cleans and discharges the photosensitive drum 10. The sixth embodiment employs the fur brush 451 which is formed of a conductive roller and a conductive brush sheet wrapped around the roller.

The conductive roller, serving as a core bar of the fur brush 451, is connected to a ground 454. To improve a discharging efficiency, the fur brush 451 is fabricated such that the resistance between a portion contacting the photosensitive drum 10, i.e., the brush tip and the ground 454 is equal to or lower than $10^8$ Ω, and preferably, equal to or lower than $10^7$ Ω. While the sixth embodiment employs a fur brush as a cleaning member, other cleaning members well known in the art may also be used, for example, a cleaning blade, a combination of a cleaning blade and a fur brush, and so on. In addition, the fur brush 451 with a narrowest possible gaps between edges of the wrapped conductive brush sheet would have an improved cleaning performance and eliminate uneven discharging because of a more uniform bristle density in the axial direction of the fur brush 451.

Description will next be made on the operation of the photosensitive drum cleaning unit 450. After a toner image formed on the photosensitive drum 10 has been transferred to the intermediate transfer belt 21, the toner remaining on the photosensitive drum 10 after the primary transfer is brought into a cleaning region defined between the photosensitive drum 10 and the fur brush 451. Then, the residual toner is swept away from the photosensitive drum 10 by the rotating fur brush 451. It should be noted the fur brush 451 is driven to rotate at a speed relative to the intermediate transfer belt 21 in order to prevent the discharging performance from degrading and bristles of the fur brush 451 from lying down. In the sixth embodiment, the fur brush 451 is rotated in the direction reverse to the intermediate transfer belt 21.

As mentioned above, the residual toner swept away by the fur brush 451 is received by the residual toner recovering container 455 within the casing 452. Also, residual toner attached on the fur brush 451 is removed therefrom by the flicker 456 in contact with the fur brush 451. The removed residual toner is received by the residual toner recovering container 455. A recovering roller 453 is disposed inside the residual toner recovering container 455. The recovering roller 453 is applied by a power supply, not shown, with a bias for attracting the residual toner. In this way, since the residual toner received by the residual toner recovering container 455 collected by the recovering roller 453, contamination inside the copier is obviated.

It should be noted that the fur brush 451 also discharges the photosensitive drum 10 simultaneously with the cleaning when it comes in contact therewith. Specifically, since the fur brush 451 is made of conductive materials and is grounded, the fur brush 451, when in contact with the photosensitive drum 10, causes a residual charge on the surface of the photosensitive drum 10 to flow into the fur brush 451. In this way, the residual charge on the photosensitive drum 10 can be removed so that the photosensitive drum 10 is discharged.

Next, the belt cleaning unit 460 will be described in terms of the structure with reference again to FIG. 16. The belt cleaning unit 460 of the sixth embodiment has the ability of simultaneously cleaning and discharging the intermediate transfer belt 21. Unlike the photosensitive drum cleaning unit 450, the belt cleaning unit 460 employs a conductive cleaning blade 461 as a cleaning member. The cleaning blade 461 is formed of a plate-shaped member which contacts the intermediate transfer belt 21 over its entire width.

The cleaning blade 461 is connected to a ground 464, and is fabricated such that the resistance between a portion contacting the intermediate transfer belt 21, i.e., the blade tip and the ground 464 is equal to or lower than $10^8$ Ω, and preferably, equal to or lower than $10^7$ Ω. While the sixth embodiment employs a cleaning blade as a cleaning member, other cleaning members well known in the art may also be used, as is the case of the photosensitive drum cleaning unit 450.

Description will next be made on the operation of the belt cleaning unit 460. Generally, after a toner image on the intermediate transfer belt 21 transferred from the photosensitive drum 10 (primary transfer) has been transferred to a transfer paper 100 (secondary transfer), the residual toner remaining on the intermediate transfer belt 21 is introduced into a cleaning region defined between the intermediate transfer belt 21 and the cleaning blade 461. Then, the residual toner is removed from the intermediate transfer belt 21 by the cleaning blade 461 pressed against the intermediate transfer belt 21, falls into the casing 461 and remains therein.

The cleaning blade 461 simultaneously discharges the intermediate transfer belt 21 when they are in contact. Specifically, as the cleaning blade 461 comes into contact with the intermediate transfer belt 21, a residual charge on the intermediate transfer belt 21 after secondary transfer, negatively charged due to the discharging which occurs when a transfer paper is separated therefrom, flows into the cleaning blade 461 connected to the ground 464. In this way, the residual charge on the intermediate transfer belt 21 can be removed to discharge the intermediate transfer belt.

Next, a modification to the sixth embodiment will be described with reference to FIG. 17. FIG. 17 is an enlarged view illustrating the configuration of the photosensitive drum and associated components therearound in the copier of the sixth embodiment including the modification. The illustrated copier is substantially similar to the sixth embodiment except that discharge power supplies (458, 468) are connected to the fur brush 451 of the photosensitive drum cleaning unit 450 and to the cleaning blade 461 of the belt cleaning unit 460, respectively, for applying respective discharging biases.

A bias applied to the fur brush 451 of the photosensitive drum cleaning unit 450 may be selected from a direct current or an alternate current bias, or a combination of direct current and alternate current biases as the case may be. Such a discharging bias promotes a residual charge existing on the photosensitive drum 10 to flow into the fur brush 451, thus allowing for efficient discharging. In this way, the photosensitive drum 10 can be stably discharged even when the surface moving speed of the photosensitive drum 10 is increased, for example, in order to perform the image formation at a higher speed.

The cleaning blade 461 of the belt cleaning unit 460 is also applied with a discharging bias as described above, and similar effects can be produced thereby. It is further possible to apply a discharging bias to the cleaning blade 31 in the transfer unit 30 to discharge the secondary transfer bias roller 34, in a manner similar to the cleaning blade 461 of the belt cleaning unit 460.

Embodiment 7

Figure 18:
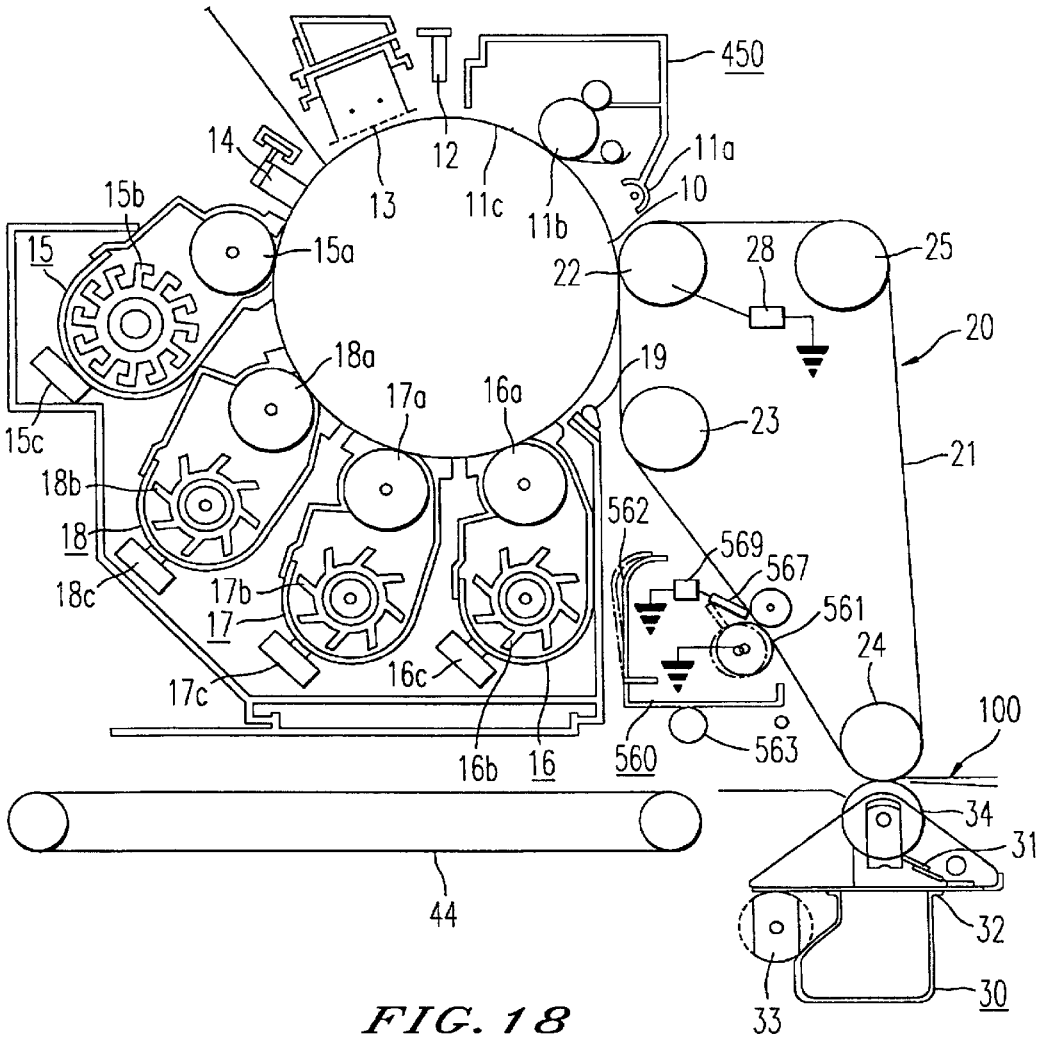
FIG. 18 illustrates an exemplary structure around a photosensitive drum of an image forming apparatus according to a seventh embodiment of the present invention.

Referring next to FIG. 18, a seventh embodiment of the present invention will be described in connection with a full color electronic photocopier (hereinafter simply referred to as the "copier") in which the present invention is applied. FIG. 18 schematically illustrates the configuration of a main portion of a printer unit in the copier according to the seventh embodiment. The illustrated copier includes a scanner unit, not shown, which has the same configuration as that of the sixth embodiment. The seventh embodiment differs from the sixth embodiment in a belt cleaning unit for cleaning an intermediate transfer belt in the printer unit. Since the copier of the seventh embodiment performs image forming operations basically in the same manner as the sixth embodiment, description on those parts that are constructed and operated in a manner similar to the sixth embodiment is omitted.

In FIG. 18, a belt cleaning unit 560 of the seventh embodiment has a fur brush 561 and cleaning blade 567 disposed within a casing 562 as cleaning members; and cleaning contact/separation mechanism 563 for moving the fur brush 561 and the cleaning blade 567 into and out of contact with an intermediate transfer belt 21 as required. The fur brush 561 has the ability of simultaneously cleaning and discharging the intermediate transfer belt 21, and is the same as the fur brush 451 of the photosensitive cleaning unit 450 in the aforementioned sixth embodiment. The cleaning blade 567, in turn, is disposed downstream of the fur brush 561 in a belt moving direction, and, unlike the fur brush 561, only cleans the intermediate transfer belt 21 without discharging it.

The cleaning blade 567 is connected to a cleaning power supply for applying the same with a cleaning bias. This cleaning bias has a polarity which repels that of the residual toner remaining on the intermediate transfer belt 21. Specifically, since the residual toner has the negative polarity, the cleaning blade 567 is applied with a cleaning bias of negative polarity. The applied cleaning bias produces a repellent force to disperse a portion of the residual toner remaining on the intermediate transfer belt 21 after secondary transfer from a cleaning region, before the cleaning blade 567 comes in contact with the intermediate transfer belt 21, so that the residual toner is partially removed before cleaning. The remaining residual toner, not affected by the repellent force, is introduced into the cleaning region as it is, and removed by the cleaning blade 567.

In the manner described above, the intermediate transfer belt 21 is cleaned by the cleaning blade 567 after the amount of residual toner remaining thereon has been previously reduced. In this way, even if a large amount of residual toner, for example, due to a jammed transfer paper 100, must be removed from the intermediate transfer belt 21 by the cleaning blade 567, it is possible to completely remove the residual toner from the intermediate transfer belt 21. The residual toner dispersed by the repelling force of the cleaning bias is received on the inner wall of the casing 562, and accumulated within the casing 562. The residual toner removed by the cleaning blade 567, in turn, falls into the casing 562 by the gravity and accumulated therein.

As appreciated, the seventh embodiment employs a combination of the fur brush 561 having the discharging ability and the cleaning blade 567 as cleaning members. Alternatively, the intermediate transfer belt 121 may be cleaned by a conventional cleaning blade without discharging ability and separately providing a discharging means, or by utilizing an intermediate transfer belt having such a volume resistivity ρv that does not require discharging, or the like. Further, the copier according to the seventh embodiment can be utilized not only in the foregoing full-color copy mode but also in any other copy mode, as is the case of the sixth embodiment.

Embodiment 8

Figure 19:
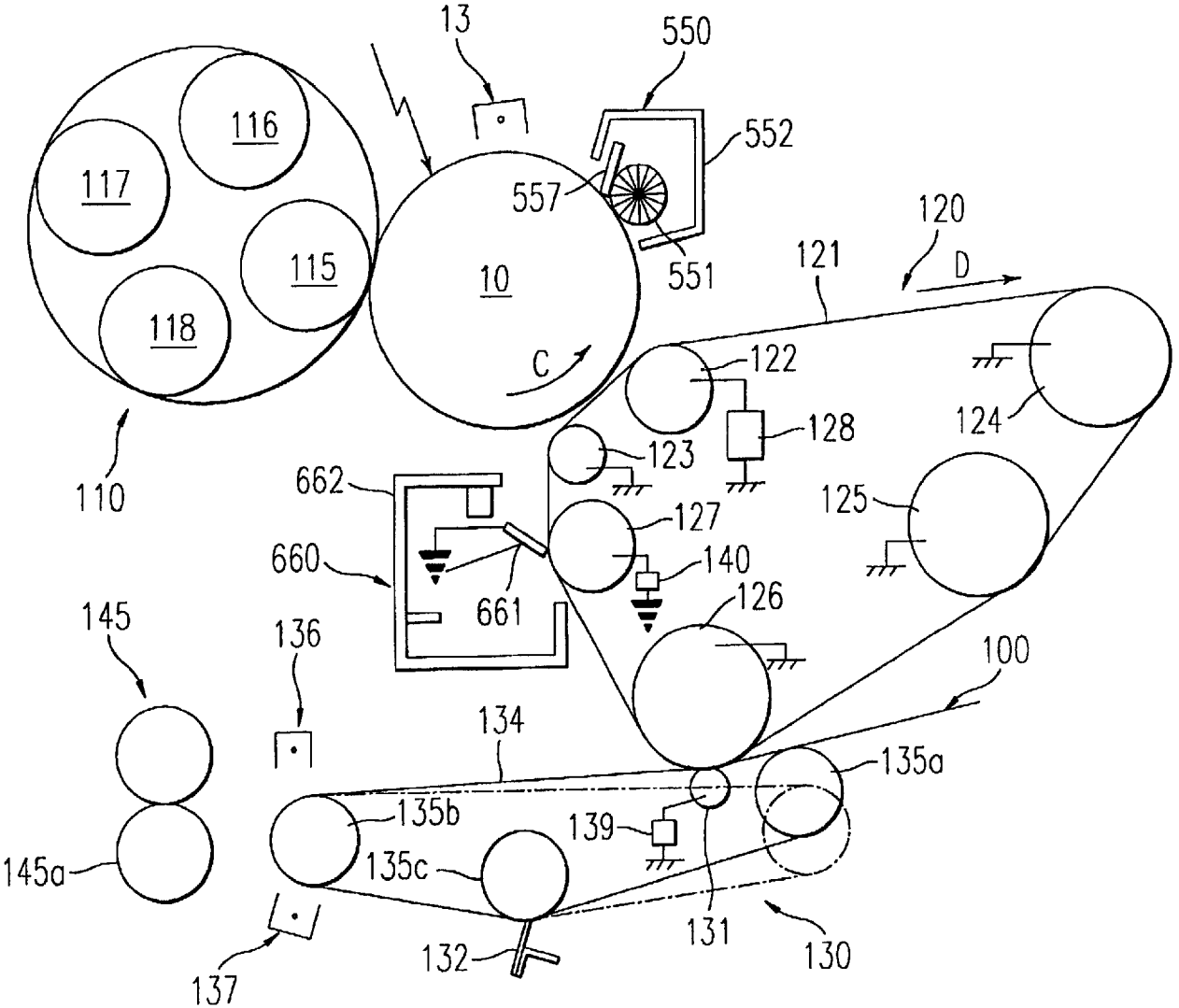
FIG. 19 illustrates a main portion of a printer of an image forming apparatus according to an eighth embodiment of the present invention.

Referring next to FIG. 19, an eighth embodiment of the present invention will be described in connection with a full color electronic photocopier (hereinafter simply referred to as the "copier") in which the present invention is applied. FIG. 19 schematically illustrates the configuration of a main portion of a printer unit in the copier according to the eighth embodiment. The illustrated copier includes a scanner unit, not shown, which has the same configuration as that of the sixth embodiment, and performs image forming operations basically in the same manner as the copier of FIG. 15. The eighth embodiment differs from the sixth embodiment mainly in the structure and operation of the printer unit. FIG. 19 corresponds to FIG. 9, so that the following description will be mainly focused on only those portions which are different from FIG. 9.

A photosensitive drum cleaning unit 550 has a fur brush 551 and a cleaning blade 557, and is provided for cleaning the surface of a photosensitive drum 10 after primary transfer. It should be noted that the fur brush 551 and the cleaning blade 557 in the photosensitive drum cleaning unit 550 are identical in structure to the fur brush 561 and the cleaning blade 567 in the belt cleaning unit 560.

Around an intermediate transfer belt 121, there are disposed a belt cleaning unit 660, and a transfer unit 130 which can be moved into and out of contact with the intermediate transfer belt 121 by respective contact/separation mechanisms, not shown, associated therewith.

An image surface area on the intermediate transfer belt 121, on which a Bk toner image formed in the aforementioned process has been transferred, is again returned to a primary transfer region, as is the case of the sixth embodiment. In this event, the cleaning blade 661 of the belt cleaning unit 660 is moved away from the intermediate transfer belt 121 by a mechanism, not shown, associated therewith so as not to disturb the toner image. Further, a first supporting roller 135*a* and a secondary transfer bias roller 131 in the transfer unit 130 are also moved by associated transfer contact/separation mechanisms, not shown, such that the secondary transfer bias roller 131 is moved away from the intermediate transfer belt 121. In this event, a secondary transfer power supply 139 connected to the secondary transfer bias roller 131 is inhibited from applying a voltage.

The above-mentioned state is held until the toner image transferred to the intermediate transfer belt 121 is transferred to a transfer paper 100.

In the following, description will be made on the a cleaning opposed roller 127, opposing the cleaning blade 661 through the intermediate transfer belt 121, which constitutes a characterizing portion of the eighth embodiment. It should be noted that the cleaning blade 661 has the ability of simultaneously cleaning and discharging the intermediate transfer belt 121, and has the same structure as the cleaning blade 461 of the belt cleaning unit 460 in the aforementioned sixth embodiment.

The cleaning opposed roller 127 of the eighth embodiment is connected to a cleaning power supply 140 for applying a cleaning bias. This cleaning bias has a polarity which generates an electric field that causes a residual toner remaining on the intermediate transfer belt 121 to separate therefrom. Specifically, since the residual toner has the negative polarity, the cleaning opposed roller 127 is applied with a cleaning bias of negative polarity. Such a cleaning bias applied to the cleaning opposed roller 127 results in the formation of the above-mentioned electric field in a region in front of the cleaning blade 661, i.e., in a region upstream of the cleaning blade 661 in a belt moving direction. Consequently, a portion of residual toner remaining on the intermediate transfer belt 121 after secondary transfer is removed by the electric filed, before it is introduced into a cleaning region. The remaining residual toner, not affected by the electric field, is introduced into the cleaning region as it is, and removed by the cleaning blade 661.

In one implementation, the fur brush 551 of the photosensitive cleaning unit 550 is formed of a metal roller and a conductive brush sheet wrapped around the metal roller. The conductive brush sheet is made of acrylic fiber dispersed with carbon and having a size of 6.5 deniers, and wrapped around the metal roller such that a gap between edges of the wrapped sheet is 1 mm or less. The fur brush 551 has a filling density of 100,000 per square inch. The resistance from the brush tip to the ground of the fur brush 551 is set at $10^6$ Ω. For the cleaning blade 557 of the photosensitive drum cleaning unit 550, a known one is used.

A cleaning blade 661 having a discharging ability is used for the belt cleaning unit 660. The cleaning blade 661 is formed of a conductive material. The casing 662 of the belt cleaning unit 660 includes a blade mount 662 extending from the inner wall surface of the casing 662, to which an electrode member 662*b* is secured, as can be seen in FIG. 20. The electrode member 662*b* is connected to a discharge power supply 668 and also to a ground 664. Further, the cleaning blade 661 is securely adhered on the electrode member 662*b* with a conductive adhesive 662*c*.

In the manner described above, the intermediate transfer belt 121 is cleaned by the cleaning blade 661 after the amount of residual toner remaining thereon has been previously reduced by the electric field. In this way, even if a large amount of residual toner, for example, due to a jammed transfer paper 100, must be removed from the intermediate transfer belt 121 by the cleaning blade 567, it is possible to completely remove the residual toner from the intermediate transfer belt 121. The residual toner removed by the electric field is received on the inner wall of the casing 662, and accumulated within the casing 662. The residual toner removed by the cleaning blade 661, in turn, falls into the casing 662 by the gravity and accumulated therein.

As appreciated, the eighth embodiment employs a cleaning blade having a discharging ability as a cleaning member. Alternatively, the intermediate transfer belt 121 may be cleaned only by the cleaning blade 661, for example, by separately providing a discharging means, by utilizing an intermediate transfer belt having such a volume resistivity ρv that does not require discharging, or the like. Further, the copier according to the eighth embodiment can be utilized not only in the foregoing full-color copy mode but also in any other copy mode, as is the case of the sixth embodiment.

Embodiment 9

Referring next to FIG. 21, a ninth embodiment of the present invention will be described in connection with a full color electronic photocopier (hereinafter simply referred to as the "copier"), that is, an image forming apparatus in which the present invention is applied.

FIG. 21 schematically illustrates the configuration of a main portion of a printer unit in the copier according to the ninth embodiment. In general, the illustrated copier is intended for a reduction in cost, and differs from the copier according to the eighth embodiment only in the following aspects. Therefore, similar constituent members in the ninth embodiment are designated the same reference numerals as those in the eighth embodiment, and description thereon is omitted. FIG. 21 corresponds to FIG. 11 so that the following description will be mainly focused on only those portions which are different from FIG. 11.

A cleaning opposed roller 227 in the ninth embodiment also functions as a belt driving means. A cleaning blade 761 is disposed opposite to the cleaning opposed roller 227 through an intermediate transfer belt 221.

In the following, a belt cleaning unit 760, which constitutes a characterizing portion of the ninth embodiment, will be described with reference to FIG. 22.

Figure 22:
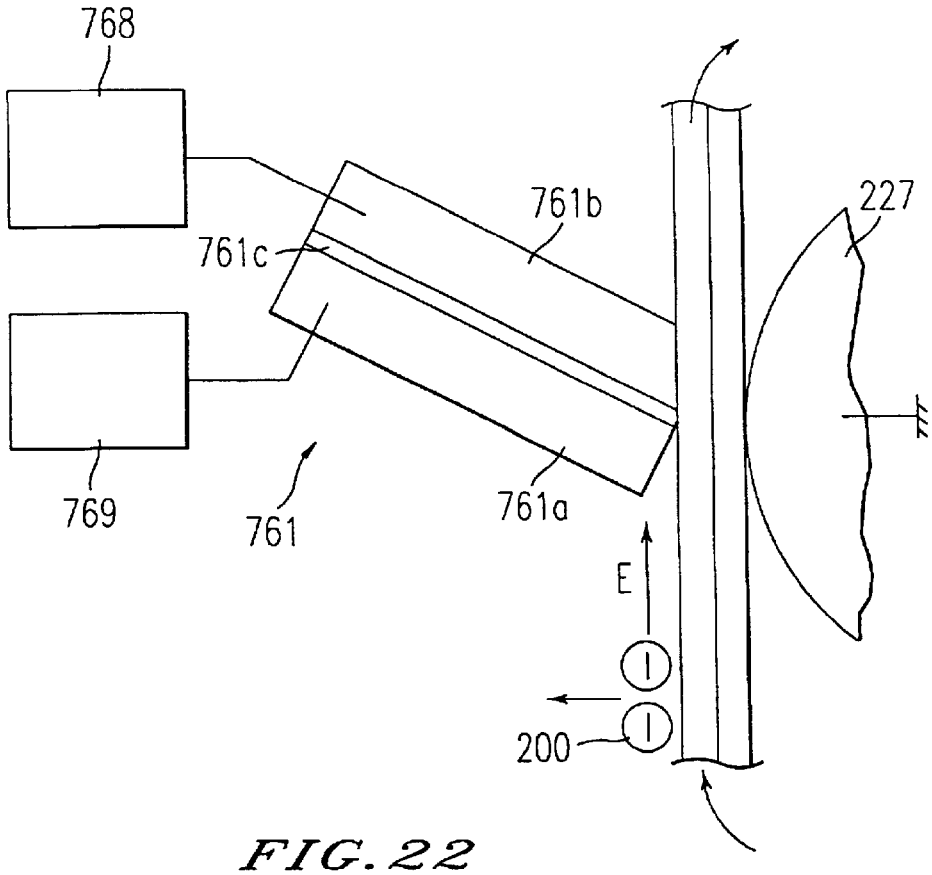
FIG. 22 is an enlarged view of a cleaning blade of a belt cleaning unit and a cleaning facing roller of an intermediate transfer belt included in the image forming apparatus of FIG. 21.

FIG. 22 is an enlarged view illustrating that a cleaning blade 761 of the belt cleaning unit 760 opposes the cleaning opposed roller 227 the intermediate transfer unit 220. The cleaning opposed roller 227 is grounded.

The cleaning blade 761 has the ability of simultaneously cleaning and discharging the intermediate transfer belt 221. The cleaning blade 761 has a cleaner 761 positioned on the upstream side in a belt moving direction E of the intermediate transfer belt 221; a discharger 761*b* positioned on the downstream side of the belt moving direction E; and an insulating layer 761*c* interposed between the cleaner 761*a* and the discharger 761*b* for insulating them.

The cleaner 761*a* is connected to a cleaning power supply 769 for applying the cleaner 761*a* with a bias of a polarity which repels that of residual toner 200 remaining on the intermediate transfer belt 221. The discharger 761*b* in turn is connected to a discharge power supply 768. Specifically, since the residual toner 200 is negatively charged, the cleaning power supply 769 applies the cleaner 761*a* with a bias of the same polarity as that of the residual toner 200. On the other hand, the discharge power supply 768 applies the discharger 761*b* with a bias of the opposite polarity to that of the residual toner 200.

By thus applying the cleaner 761*a* and the discharger 761*b* with respective biases, it is possible to maintain the cleaning performance by previously removing a portion of the residual toner before cleaning and simultaneously discharge the intermediate transfer belt 221. Stated another way, even when a large amount of residual toner is deposited on the intermediate transfer belt 221, the residual toner can be completely removed and the intermediate transfer belt 221 can be discharged by a single member. In addition, by completely removing the residual toner by the action of the cleaner 761*a,* the discharging performance of the discharger 761*b* can be improved, thereby making it possible to accomplish stable and effective discharging.

As a modification to the ninth embodiment, the cleaning opposed roller 227 may be modified to have a similar structure to the cleaning opposed roller 127 in the eighth embodiment, with the result that the cleaning performance can be further improved. Consequently, this leads to a further improvement in the discharging performance of the discharger 761*b* and more stable and effective discharging.

Embodiment 10

Next, a tenth embodiment of the present invention will be described in connection with an image forming apparatus which employs a transfer material carrier such as a belt for carrying and conveying a transfer material such as a paper, an OHP sheet or the like, and to which the present invention is applied.

Figure 23:
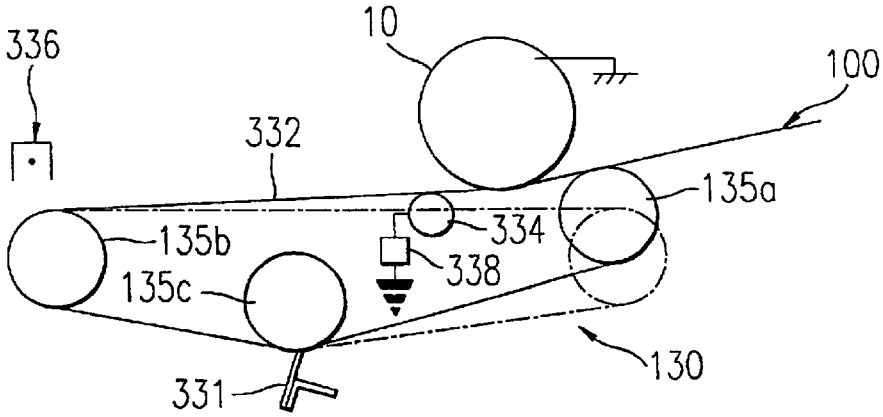
FIG. 23 illustrates an exemplary transfer unit of an image forming apparatus according to a tenth embodiment of the present invention.

FIG. 23 schematically illustrates a transfer unit of a copier according to the tenth embodiment. In the tenth embodiment, the present invention is utilized in a transfer material carrier for carrying and conveying a transfer material rather than in an intermediate transfer unit as in the foregoing embodiments. FIG. 23 corresponds to FIG. 12 so that the following description will be mainly focused on only those portions which are different from FIG. 12.

An area of the paper transfer belt 332, from which a transfer paper 100, has been separated, is moved to a cleaning region defined between the cleaning blade 331 and the cleaning opposed roller 335*c*. After completion of a normal transfer step, there is a bit of contaminants such as paper dusts, rather than toner, attached on the paper transfer belt 332. Such contaminants may be sufficiently removed by any conventional cleaning member. However, for example, if a jammed transfer paper 100 results in a toner image on the photosensitive drum 10 transferred to the paper transfer belt 332, instead of a transfer paper, an excessively large amount of toner must be removed by a cleaning member. This problem is particularly grave in a full color image forming apparatus. In this case, an amount of toner exceeding the cleaning capability of the cleaning blade 331 will be introduced into the cleaning region, so that a conventional cleaning member is not capable of completely removing such a large amount of toner. As a result, a portion of the toner, too much for the cleaning member to remove, may cause troubles such as an insufficient transfer bias or the like in the next transfer step.

In the tenth embodiment, however, a portion of toner is previously removed making use of an electric action, before cleaning, to reduce the amount of toner introduced into the cleaning region, such that the cleaning blade 331 removes only the remaining toner, in a manner similar to the ninth embodiment. In this way, since the amount of toner remaining on the paper transfer belt 332 is previously reduced before cleaning, even a large amount of toner can be completely removed from the paper transfer belt 332.

The foregoing tenth embodiment utilizes an electric field as a means for removing a portion of residual toner before the paper transfer belt 332 comes in contact with the cleaning blade 331. However, when a magnetic toner is employed in some copiers, a magnetic field generating means may be used to form a magnetic field which can remove a residual magnetic toner.

Embodiment 11

Referring next to FIGS. 24 to 27, an eleventh embodiment of the present invention will be described in connection with a full color electronic photocopier (hereinafter simply referred to as the "copier"), that is, an image forming apparatus in which the present invention is applied.

Figure 24:
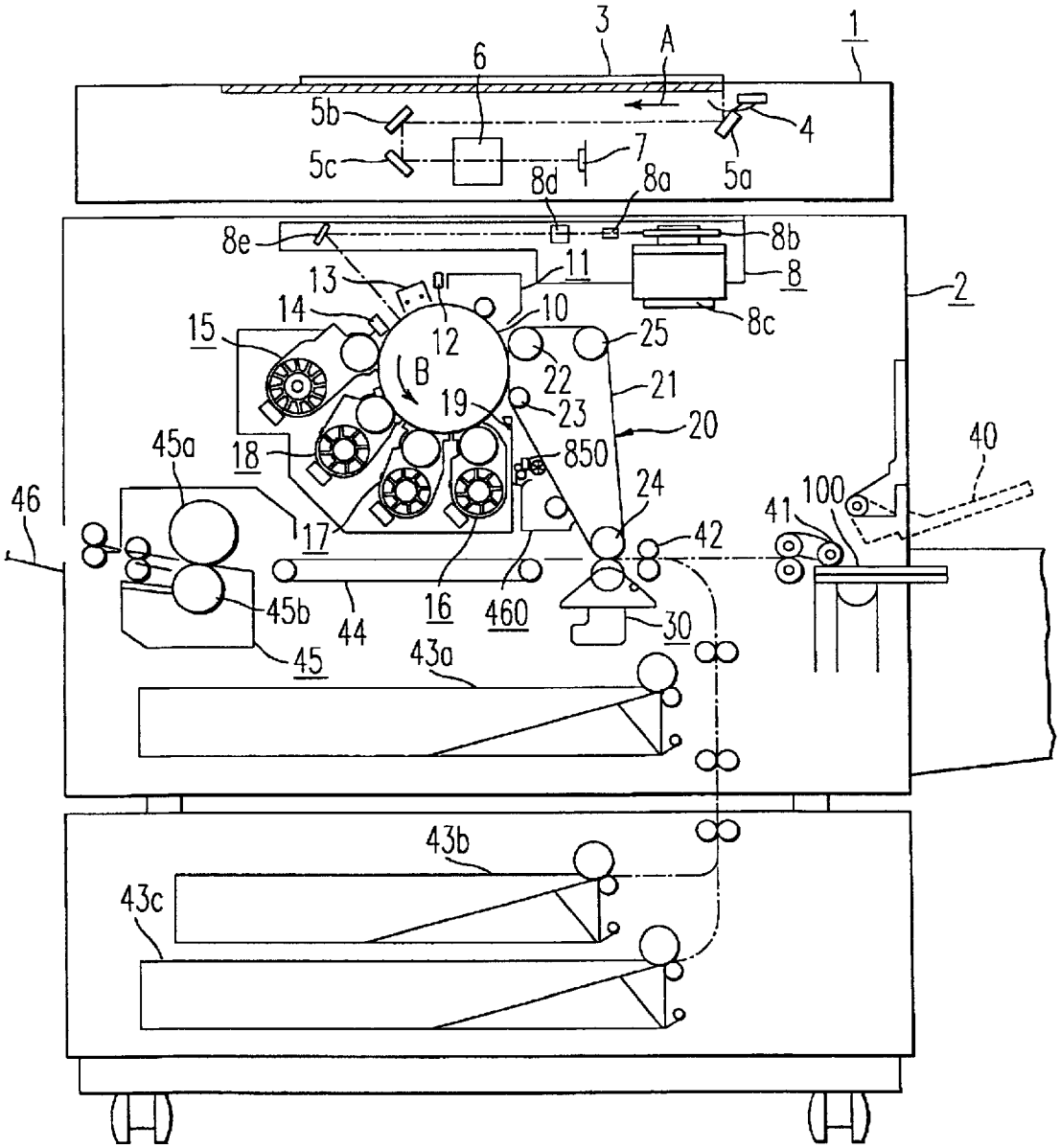
FIG. 24 illustrates an exemplary configuration of an image forming apparatus according to an eleventh embodiment of the present invention.
Figure 25:
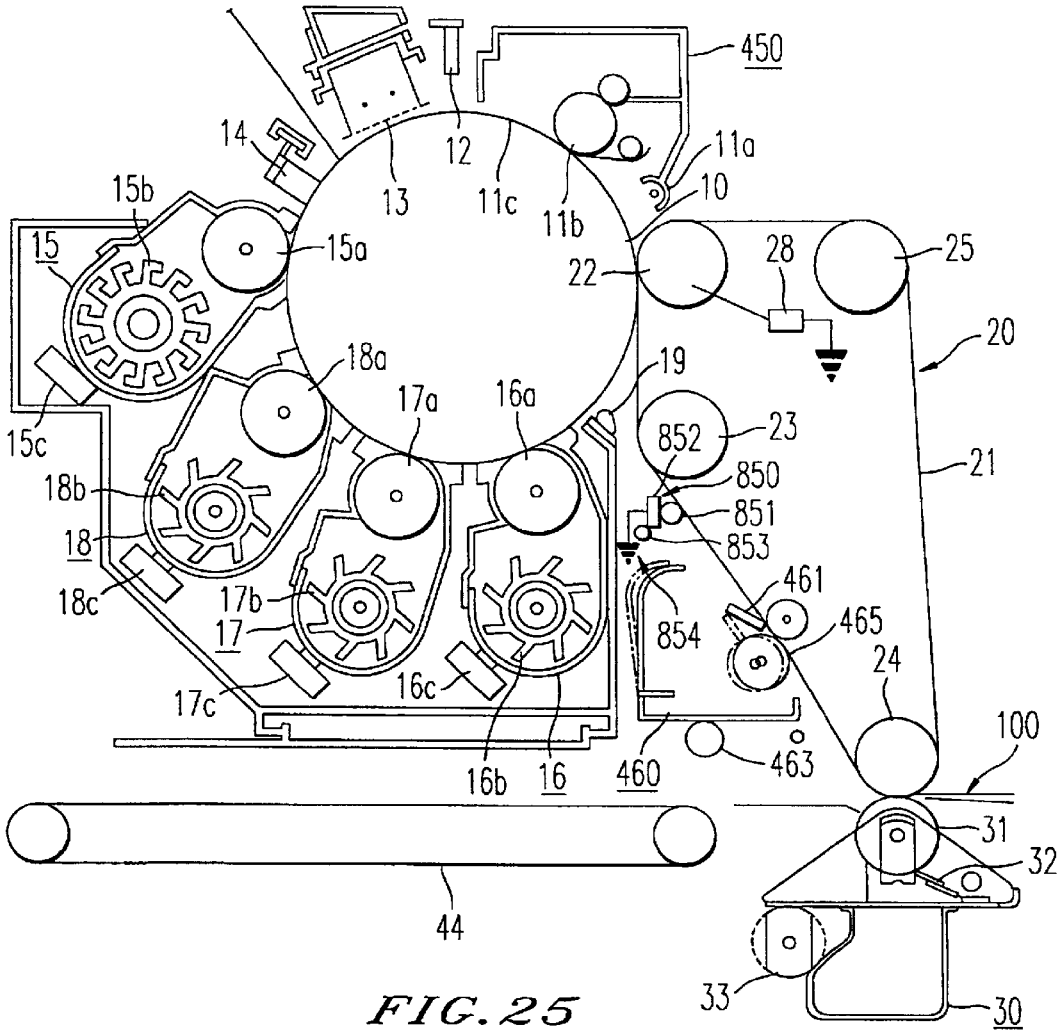
FIG. 25 illustrates an exemplary structure around a photosensitive drum of the image forming apparatus of FIG. 24.

FIG. 24 is a cross-sectional view schematically illustrating the configuration of the copier according to the eleventh embodiment, and FIG. 25 is an enlarged view schematically illustrating the structure around a photosensitive drum in the copier of FIG. 24. The following description will be mainly focused on only those portions which are different from the first embodiment illustrated in FIGS. 1, 2.

Around an intermediate transfer belt 21, there are disposed a lubricant coating unit 850, a cleaning belt (belt cleaning unit) 460, and a transfer unit 30. The lubricant coating unit 850 has a lubricant coating brush roller 851, a lubricant container 852, and a contact/separation mechanism 853 for moving the lubricant coating brush roller 851 into and out of contact with the intermediate transfer belt 21. The lubricant coating brush roller 851 is associated with the contact/separation mechanism 853, so that it is driven by the contact/separation mechanism 853 to come into and out of contact with the intermediate transfer belt 21.

The cleaning unit 460 has a brush roller 465 and a cleaning blade 461 as cleaning members, and a cleaning unit contact/separation mechanism 463. The cleaning unit contact/separation mechanism 463 enables the cleaning unit 460 to come into and out of contact with the intermediate transfer belt 21.

While the seventh embodiment employs a combination of the cleaning blade 461 and the brush roller 465 as cleaning members, they may be used in separation, or other known cleaning members may also be used.

During a time period in which a complete toner image is formed on the intermediate transfer belt 21, specifically, during a time period from the time the first color (Bk) toner image had been transferred to the intermediate transfer belt 21 to the time the fourth color (Y) toner image has been transferred to the same, the lubricant coating unit 850, the cleaning unit 460, and the transfer unit 30 are separated away from the intermediate transfer belt 21 by the respective contact/separation mechanisms (853, 463, 33) associated therewith.

While the operation of the copier has been described in connection with a copy mode for producing full-color copies, the same description is applicable to other copy modes, i.e., a three-color copy mode and a two-color copy mode, except that used colors and associated mechanisms are different. For a single-color copy mode, a developer in a developing device associated with a selected color is maintained to form a sleeve or ear, i.e., the developing device is maintained in operative state until a predetermined number of copies have been produced. Also, with the lubricant coating unit 850, the cleaning unit 460, and the transfer unit 30 maintained in contact with the intermediate transfer belt 21 and with the intermediate transfer belt 21 maintained in contact with the photosensitive drum 10, the intermediate transfer belt 21 is driven in the forward direction at a constant speed for producing copies.

Figure 26:
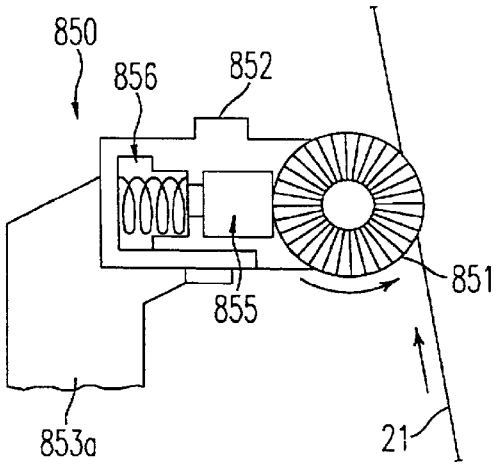
FIG. 26 illustrates an exemplary structure of a lubricant applying unit of the image forming apparatus of FIG. 24.
Figure 27:
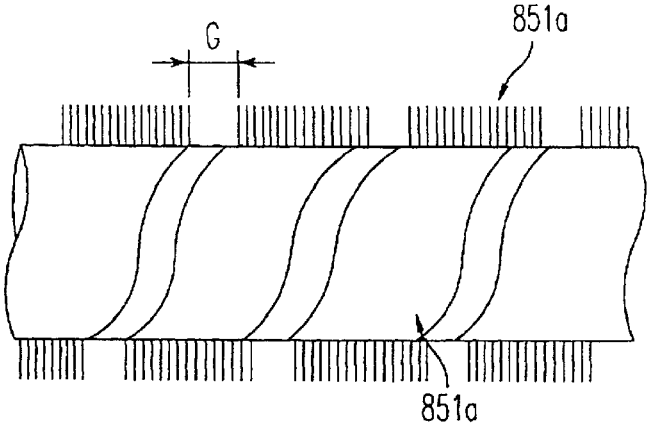
FIG. 27 illustrates an exemplary structure of a brush roller of the lubricant applying unit of the image forming apparatus of FIG. 24.

In the following, description will be made on the structure and operation of the lubricant coating unit 850 which constitutes a characterizing portion of the eleventh embodiment. FIG. 26 is a cross-sectional view schematically illustrating the structure of the lubricant coating unit 850 according to the eleventh embodiment, and FIG. 27 is a front view of a lubricant coating brush roller 851 in the lubricant coating unit 850. The lubricant coating unit 850 is disposed downstream of a secondary transfer region and upstream of a primary transfer region in a belt moving direction, and downstream of the cleaning blade 461 and upstream of the primary transfer region in the belt moving direction.

The lubricant coating unit 850 is mounted to an arm 853*a* extending from the contact/separation mechanism 853. A solid lubricant 855 and a spring 856 are contained in the lubricant container 852 of the lubricant coating unit 850. The solid lubricant 855 may be, for example, a plate formed of fine particles of zinc stearate. The solid lubricant 855 is urged by the spring 856 toward the lubricant coating brush roller 851 to be in contact therewith. The lubricant coating brush roller 851 can be driven by a driving means, not shown, for rotation. When the lubricant 855 is actually coated on the intermediate transfer belt 21 after secondary transfer, the lubricant coating brush roller 851 is rotated to scrape off the solid lubricant 855. The lubricant thus scraped off is transformed into powder which is then coated on the intermediate transfer belt 21.

In the eleventh embodiment, the lubricant coating brush roller 851 also functions as a discharging member. Specifically, the lubricant coating brush roller 851 is brought into contact with the intermediate transfer belt 21 to coat the lubricant thereon and simultaneously discharge the intermediate transfer belt 21. In this event, the lubricant coating brush roller 851 is driven to rotate in the same direction as the intermediate transfer belt 21 in order to prevent the discharging performance from degrading and its brush bristles from lying down. In addition, the lubricant coating brush roller 851 is controlled such that it rotates at a line velocity higher than that of the intermediate transfer belt 21 in a discharge region in which the lubricant coating brush roller 851 contacts the intermediate transfer belt 21.

As illustrated in FIG. 27, the lubricant coating brush roller 851 is formed of a conductive roller and a conductive fabric sheet 851*b* having brush bristles 851*a* wrapped around the conductive roller. In this event, the brush roller 851 with a narrowest possible gaps between edges of the wrapped conductive brush sheet would eliminate uneven discharging because of a more uniform bristle density in the axial direction of the lubricant coating brush roller 851. The conductive fabric sheet 851*b* is made, for example, of acrylic fiber dispersed with carbon, or the like. The conductive roller, serving as a core bar of the lubricant coating brush roller 851, is connected to a ground 854. To improve a discharging efficiency, the lubricant coating brush roller 851 fabricated such that the resistance between a portion contacting the intermediate transfer belt 21, i.e., the tip of the brush bristles 851*a* and the ground 854 is equal to or lower than $10^8\Omega$, and preferably, equal to or lower than $10^7\Omega$. Essentially, this resistance means the resistance of the conductive fabric sheet since the roller serving as a core bar of the lubricant coating brush roller 851 is conductive.

Figure 28:
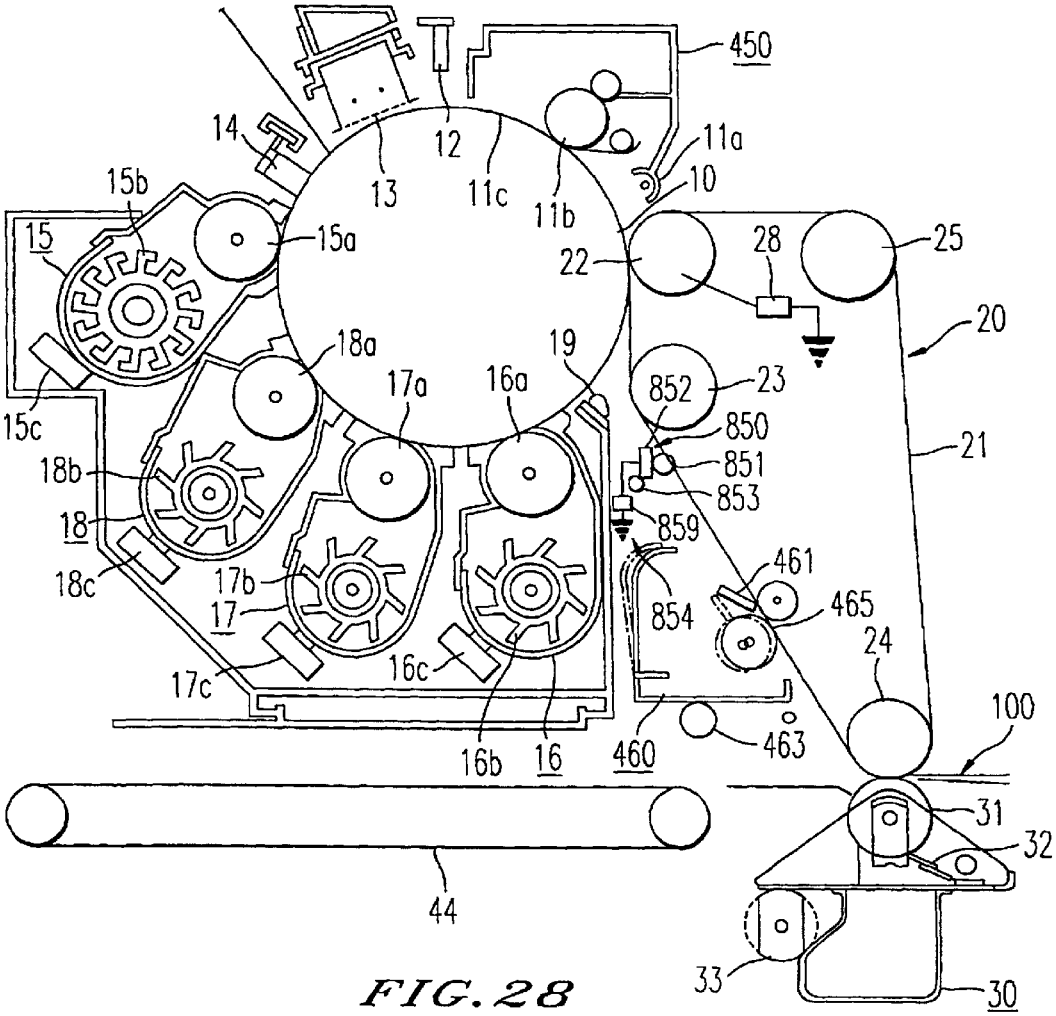
FIG. 28 illustrates an exemplary structure around a photosensitive drum with respect to a modification made on the image forming apparatus of FIG. 24.

Next, a modification to the eleventh embodiment will be described with reference to FIG. 28. FIG. 28 is an enlarged view schematically illustrating a modified structure around a photosensitive drum 10 in the copier of the eleventh embodiment. The modification basically has substantially the same configuration as the eleventh embodiment, and differs from the eleventh embodiment only in that in the modification, the lubricant coating brush roller is connected to a discharge power supply 859 for applying a discharging bias, whereas in the eleventh embodiment, the lubricant coating brush roller 851 is simply grounded. Since the discharging bias permits a residual charge existing on the intermediate transfer belt 21 to flow into the lubricant coating brush roller 851, thus allowing for efficient discharging. In this way, the photosensitive drum 10 can be stably discharged even when the surface moving speed of the photosensitive drum 10 is increased, for example, in order to perform the image formation at a higher speed.

Embodiment 12

Figure 29:
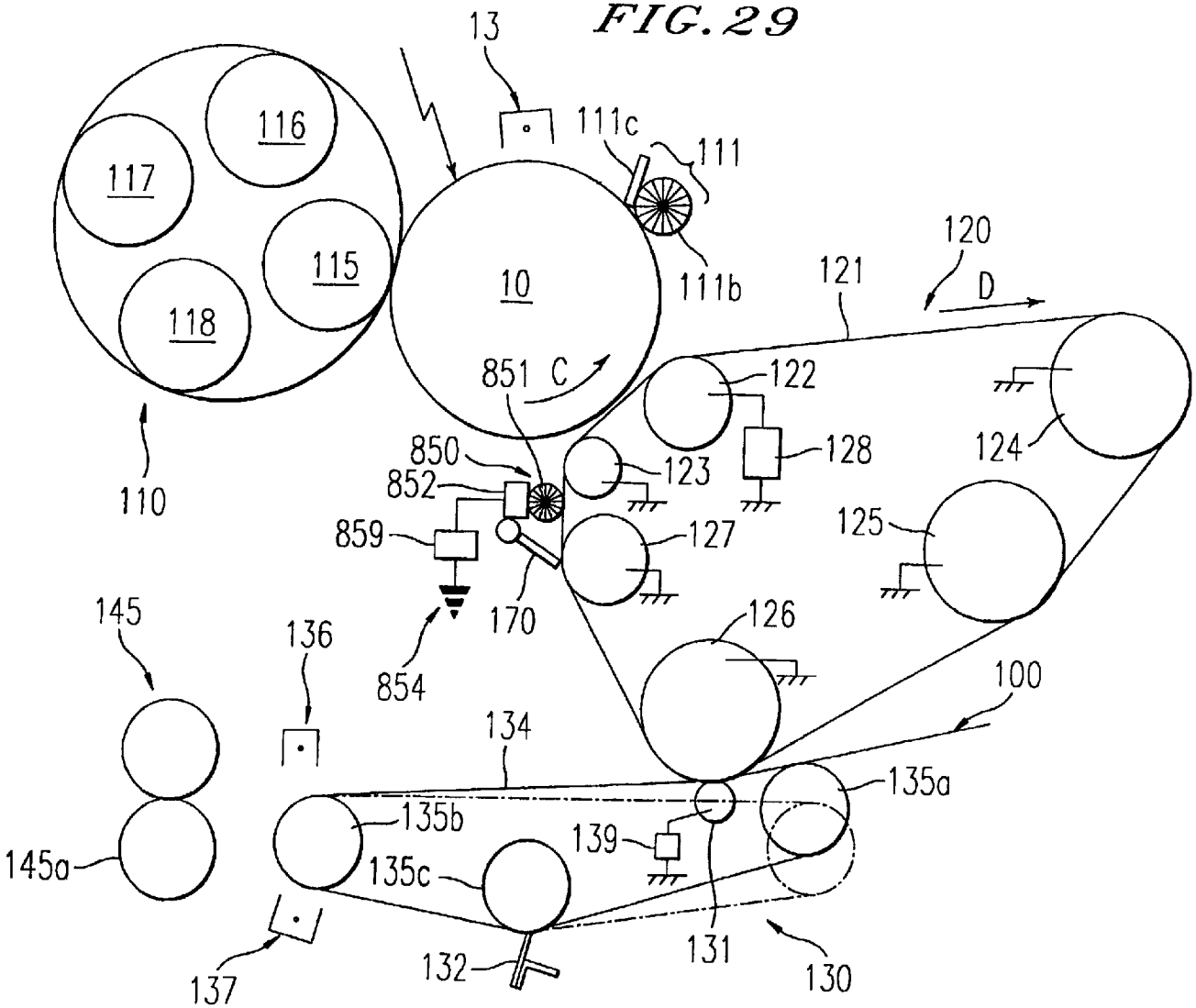
FIG. 29 illustrates a main portion of a printer of an image forming apparatus according to a twelfth embodiment of the present invention.

Referring next to FIGS. 29 to 31A and 31B, a twelfth embodiment of the present invention will be described in connection with a full color electronic photocopier (hereinafter simply referred to as the "copier"), that is, an image forming apparatus in which the present invention is applied. FIG. 29 schematically illustrates the configuration of a main portion of a printer unit in the copier according to the twelfth embodiment. The illustrated copier includes a scanner unit, not shown, which has the same configuration as that of the eleventh embodiment, and performs image forming operations basically in the same manner as the copier of FIG. 24. The twelfth embodiment differs from the sixth embodiment mainly in the structure and operation of the printer unit. FIG. 29 corresponds to FIG. 9, so that the following description will be mainly focused on only those portions which are different from FIG. 9.

Around an intermediate transfer belt 121, there are disposed a lubricant coating unit 850 identical to that used in the eleventh embodiment, and a transfer unit 130. These components can be moved into and out of contact with the intermediate transfer belt 121 by respective contact/separation mechanisms, not shown, associated therewith.

The image forming surface on the intermediate transfer belt 121, on which the Bk toner image has been transferred, is again returned to the primary transfer region, similarly .to the eleventh embodiment. In this event, the lubricant coating brush roller 851 and the cleaning blade 170 are moved away from the intermediate transfer belt 121 by respective contact/separation mechanisms associated therewith so as not to disturb the toner image.

In the following, description will be made on the contact/separation mechanism for moving the lubricant coating brush roller 851 into and out of contact with the intermediate transfer belt 121, and the contact/separation mechanism for moving the cleaning blade 170 into and out of contact with the intermediate transfer belt 121, which constitute characterizing portions of the twelfth embodiment. Like the eleventh embodiment, the lubricant coating brush roller 851 also functions as a discharging member, and for this purpose, is connected to a discharge power supply 859 for applying the same with a discharging bias. Thus, the lubricant coating brush roller 851, when in contact with the intermediate transfer belt 121, can coat a lubricant on the intermediate transfer belt 121 and simultaneously discharge the intermediate transfer belt 121.

Figure 30:
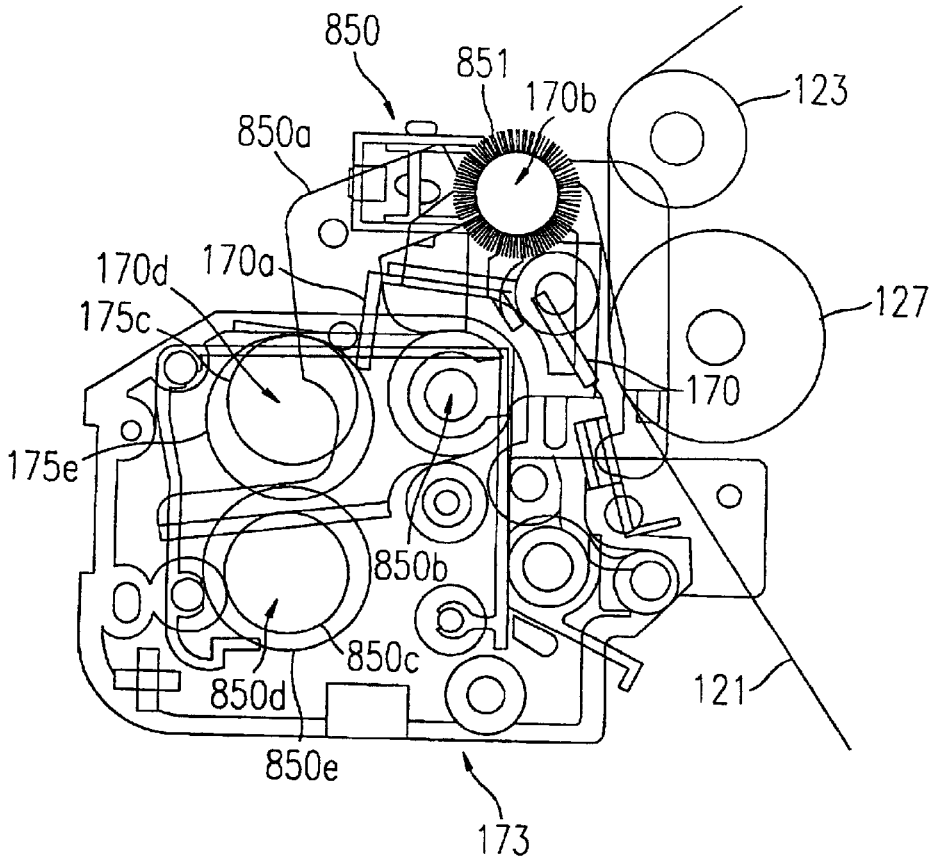
FIG. 30 illustrates an exemplary structure of a moving mechanism for moving a lubricant applying brush roller and a cleaning blade in the image forming apparatus of FIG. 29.

First, the structures of the contact/separation mechanisms will be described with reference to FIG. 30. FIG. 30 schematically illustrates the structure of the contact/separation mechanism 173 which functions to move not only the lubricant coating brush roller 851 but also the cleaning blade 170 into and out of contact with the intermediate transfer belt 121. The contact/separation mechanism 173 includes the lubricant coating unit 850; the cleaning blade 170; a first contact/separation cam 850*c* for moving the lubricant coating brush roller 851 into and out of contact with the intermediate transfer belt 121; a second contact com 170*c* for moving the cleaning blade 170 into and out of contact with the intermediate transfer belt 121; and driving units, not shown, connected to these cams.

The lubricant coating unit 850 is supported at one end of a first bracket 850*a*. The first bracket 850*a* is supported for pivotal movements about a first bracket pivot shaft 850*b*. The other end of the first bracket 850*a*, opposite to the one end at which the lubricant coating unit 850 is supported, abuts to a cam surface of the first contact/separation cam 850*c*. In this event, the other end of the first bracket 850*a* is urged by a spring, not shown, toward the cam surface. The cleaning blade 170, in turn, is secured to a second bracket 170*a* at one end thereof. The second bracket 170*a* is supported for pivotal movements about a second bracket pivot shaft 170*b*. The other end of the second bracket 170*a*, opposite to the one end at which the cleaning blade 170 is secured, abuts to a cam surface of the second contact/separation cam 170*c*. In this event, the other end of the second bracket 170*a* is urged by a spring, not shown, toward the cam surface.

The first contact/separation cam 850*c* is secured to a first cam shaft 850*d* connected to the driving unit. To the first cam shaft 850*d*, a first gear 850*e* is also secured at the end on the front side on the drawing. The second contact/separation cam 170*c* is secured to a second cam shaft 170*d*. To the second cam shaft 170*d*, a second gear 170*e* is also secured at the end on the front side on the drawing. The first gear 850*e* and the second gear 170*e* have the same number of teeth, and are meshed with each other on the same plane.

Figure 31A:
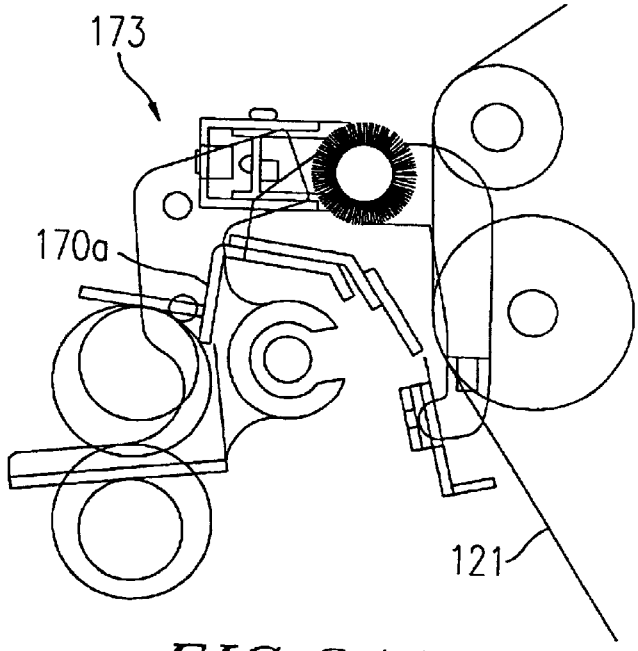
FIGS. 31A and 31B illustrate enlarged structures of the moving mechanism of FIG. 30.
Figure 31B:
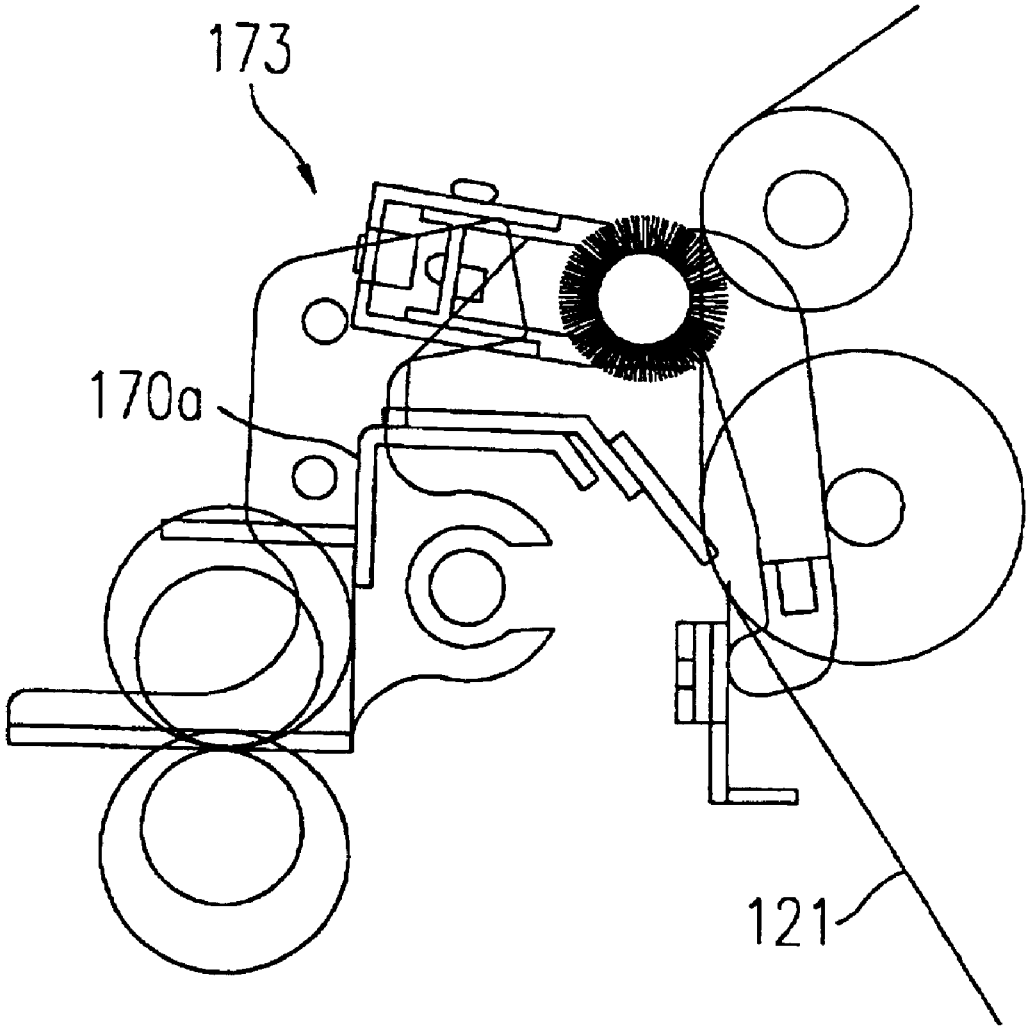

Next, the operation of the contact/separation mechanism 173 will be described with reference to FIGS. 31A and 31B. FIG. 31A and FIG. 31B are enlarged views schematically illustrating a main portion of the contact/separation mechanism 173 when the lubricant coating brush roller 851 and the cleaning blade 170 are out of contact with the intermediate transfer belt 121, and when the lubricant coating brush roller 851 and the cleaning blade 170 are into contact with the intermediate transfer belt 121, respectively.

In FIG. 31A, the lubricant coating brush roller 851 and the cleaning blade 170 are separated from the intermediate transfer belt 121. From the illustrated state, the first cam shaft 850*d* is rotated over 180° by a motor, not shown, disposed in the driving unit. This causes the first contact/separation cam 850*c* to also rotate over 180°, and the cam surface thereof to lift the other end of the first bracket 850*a*, thus bringing the lubricant coating brush roller 851 into contact with the intermediate transfer belt 121. In addition, the rotation of the first cam shaft 850*d* also causes the second cam shaft 170*d* to rotate over 180° by way of the first gear 850*e* and the second gear 170*e*. The rotation of the second cam shaft 170*d* causes the second contact/separation cam 170*c* to lift the other end of the second bracket 170*a* to bring the cleaning blade 170 into contact with the intermediate transfer belt 121. In this way, the state illustrated in FIG. 31A proceeds to the state illustrated in FIG. 31B.

Further, when the motor is driven to rotate the first cam shaft 850*d* over another 180°, the lubricant coating brush roller 851 and the cleaning blade 170 are moved out of contact with the intermediate transfer belt 121 because the first bracket 850*a* and the second bracket 170*a* have their other ends urged toward the cam surface of the first contact/separation cam 850*c* and the cam surface of the second contact/separation cam 170*c*, respectively. In this way, the state illustrated in FIG. 31B proceeds to the state illustrated in FIG. 31A.

As an additional feature, by adjusting the angle at which the first contact/separation cam 850*c* is secured to the first cam shaft 850*d* and the angle at which the second contact/separation cam 170*c* is secured to the second cam shaft 170*d*, it is possible to arbitrarily set an interval between a timing at which the cleaning blade 170 is moved into contact with the intermediate transfer unit 121 and a timing at which the lubricant coating brush roller 851 is subsequently moved into contact with the intermediate transfer unit 121.

In the twelfth embodiment, the foregoing angles are set such that after the cleaning blade 170 has been brought into contact with the intermediate transfer belt 121, the lubricant coating brush roller 851 is brought into contact with the intermediate transfer belt 121 at a timing the contacted surface of the intermediate transfer belt 121 passes a position at which the lubricant coating brush roller 851 is designed to contact the intermediate transfer belt 121. In this way, since the surface discharged by the lubricant coating brush roller 851 in contact therewith has been cleaned, a less amount of contaminants or the like will attach to the lubricant coating brush roller 851.

In one implementation, the lubricant coating brush roller 851 is formed of a metal roller and a conductive fabric sheet wrapped around the metal roller. The conductive fabric sheet is made of acrylic fiber dispersed with carbon and having a size of 6.5 deniers, and wrapped around the metal roller such that gap G between edges of the wrapped sheet is 1 mm or less. The lubricant coating brush roller 851 has a filling density of 100,000 per square inch. The resistance from the brush tip to the ground 854 of the lubricant coating brush roller 851 is set at $10^6$ Ω.

It should be noted that the lubricant coating brush roller 851 need not be brought into contact with a completely cleaned surface, and an amount of contaminants not affecting a formed image may be regarded to fall within a tolerable range. Thus, depending on specific applications of the copier of the twelfth embodiment, it may be sufficient that a timing at which the lubricant coating brush roller 851 is brought into contact with the intermediate transfer belt 121 is controlled such that an uncleaned area of the intermediate transfer belt 121 contacted by the lubricant coating brush roller 851 is at least smaller than the case where the lubricant coating brush roller 851 and the cleaning blade 170 are simultaneously brought into contact with the intermediate transfer belt 121.

While in the twelfth embodiment, the lubricant coating brush roller 851 and the cleaning blade 170 are controlled by a single contact/separation mechanism, an individual contact/separation mechanism may be provided for each of them. Further, the copier according to the twelfth embodiment can be utilized not only in the foregoing full-color copy mode but also in any other copy mode, as is the case of the eleventh embodiment.

Embodiment 13

Figure 32:
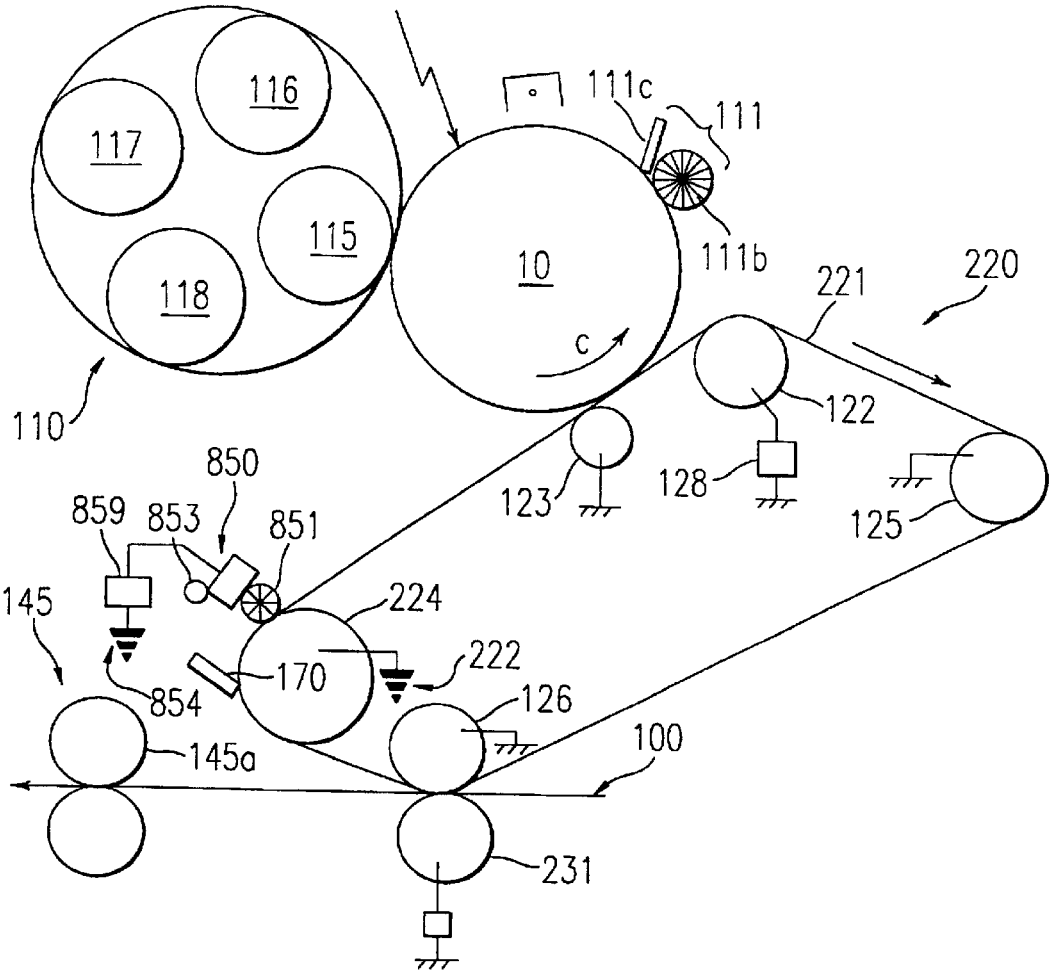
FIG. 32 illustrates a main portion of a printer of an image forming apparatus according to a thirteenth embodiment of the present invention.

Referring next to FIG. 32, a thirteenth embodiment of the present invention will be described in connection with a full color electronic photocopier (hereinafter simply referred to as the "copier"), that is, an image forming apparatus in which the present invention is applied.

FIG. 32 schematically illustrates the configuration of a main portion of a printer unit in the copier according to the thirteenth embodiment. In general, the illustrated copier is intended for a reduction in cost, and differs from the copier according to the twelfth embodiment only in the following aspects. Therefore, similar constituent members in the thirteenth embodiment are designated the same reference numerals as those in the twelfth embodiment, and description thereon is omitted. FIG. 32 corresponds to FIG. 11 so that the following description will be mainly focused on only those portions which are different from FIG. 11.

For feeding a transfer paper 100 in the thirteenth embodiment, the fed transfer paper 100 is directly sandwiched between a secondary transfer bias roller 231 and an intermediate transfer belt 221, and conveyed to pass between a pair of fixing rollers 145*a* of a fixing unit 145.

In the following, description will be made on the structures and operations of a lubricant coating unit 850 and a cleaning blade 170 which constitute characterizing portions of the thirteenth embodiment. The lubricant coating unit 850 and the cleaning blade 170 in the thirteenth embodiment are substantially similar to the correspondents in the twelfth embodiment in basic structure, and differs in their positions.

In the thirteenth embodiment, a lubricant coating brush roller 851 of the lubricant coating unit 850 is also disposed opposite to a driving roller 224 which also serves as a cleaning opposed roller associated with the cleaning blade 170. Since the driving roller 224 has a ground 222 connected to a casing, the driving roller 224 also serves as a grounding member disposed opposite to the lubricant coating brush roller 851. As a result, an electric field is concentrically formed between the lubricant coating brush roller 851 and the driving roller 224. The electric field thus formed allows for stable discharging of not only a charge on the surface of the intermediate transfer belt 121 but also a charge internal to the intermediate transfer belt 121, so that the entire intermediate transfer belt 121 can be uniformly discharged. The lubricant coating brush roller 851 and the cleaning blade 170 may be disposed opposite to another supporting roller instead of the driving roller 224.

The driving roller 224 opposing the lubricant coating brush roller 851 is formed of a metal roller coated with conductive rubber thereon. The resistance from the surface of the driving roller 224 to the ground 222 is set at $10^7$ Ω.

Embodiment 14

Next, a fourteenth embodiment of the present invention will be described in connection with an image forming apparatus which employs a transfer material carrier such as a belt for carrying and conveying a transfer material such as a paper, an OHP sheet or the like, and to which the present invention is applied.

Figure 33:
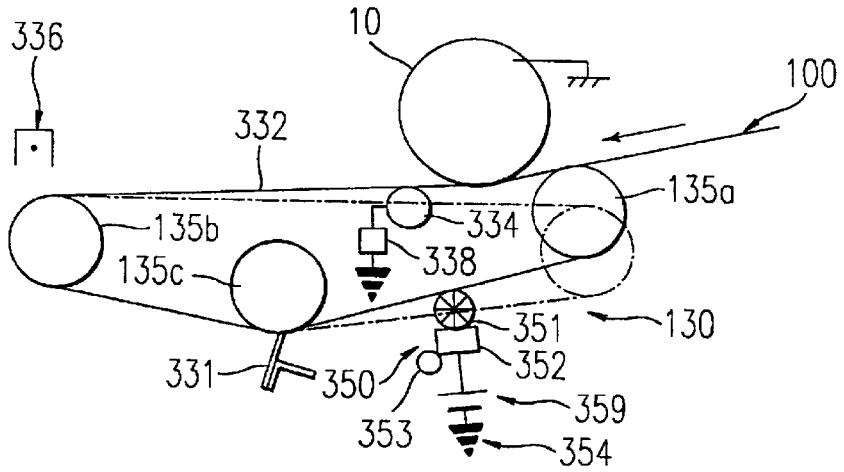
FIG. 33 illustrates an exemplary transfer unit of an image forming apparatus according to a fourteenth embodiment of the present invention.

FIG. 33 schematically illustrates a transfer unit of a copier according to the fourteenth embodiment. In the fourteenth embodiment, the present invention is utilized in a transfer material carrier for carrying and conveying a transfer material rather than an intermediate transfer unit as in the foregoing embodiments. FIG 33 corresponds to FIG. 12 so that the following description will be mainly focused on only those portions which are different from FIG. 12.

A transfer unit 330 has a paper transfer belt 332 for carrying a transfer paper 100; a transfer cleaning blade 331 for cleaning the surface of the paper transfer belt 332; a ground roller 335*a* positioned at one end of a sheet feed unit, not shown; a transfer bias roller 334 as a charge supply menas; a transfer power supply 338 connected to the transfer bias roller 334; a tension roller 335*b* positioned at one end of a fixing unit, not shown; a cleaning opposed roller 335*c* opposing the transfer cleaning blade 331; a transfer paper discharger 336; and a lubricant coating unit 350 for coating a lubricant on the surface of the paper transfer belt 332.

A transfer paper 100, on which a toner image has been transfered as described above, is discharged by the transfer paper discharger 336, and passes a separation region where the transfer paper 100 is separated from the paper transfer belt, 332, and conveyed to the fixing unit, not shown. After the transfer paper 100 has been separated from the paper transfer belt 332, the transfer cleaning blade 331 removes contanimants such as paper dusts from surface of the paper transfer belt 332. In this event, a lubricant coating brush roller 351 disposed in the lubricant coating unit 350 a lubricant on the cleaned surface of the paper transfer belt 332 in order to reduce a friction between the cleaning blade 331 and the paper transfer belt 332. The lubricant coating brush roller 351 is disposed upstream of a transfer region and downstream of the separation region in a direction in which the paper transfer belt advances, and preferably, upstream of the transfer region and downstream of the transfer cleaning blade 331 in the paper transfer belt advancing direction.

Embodiment 15

Figure 34:
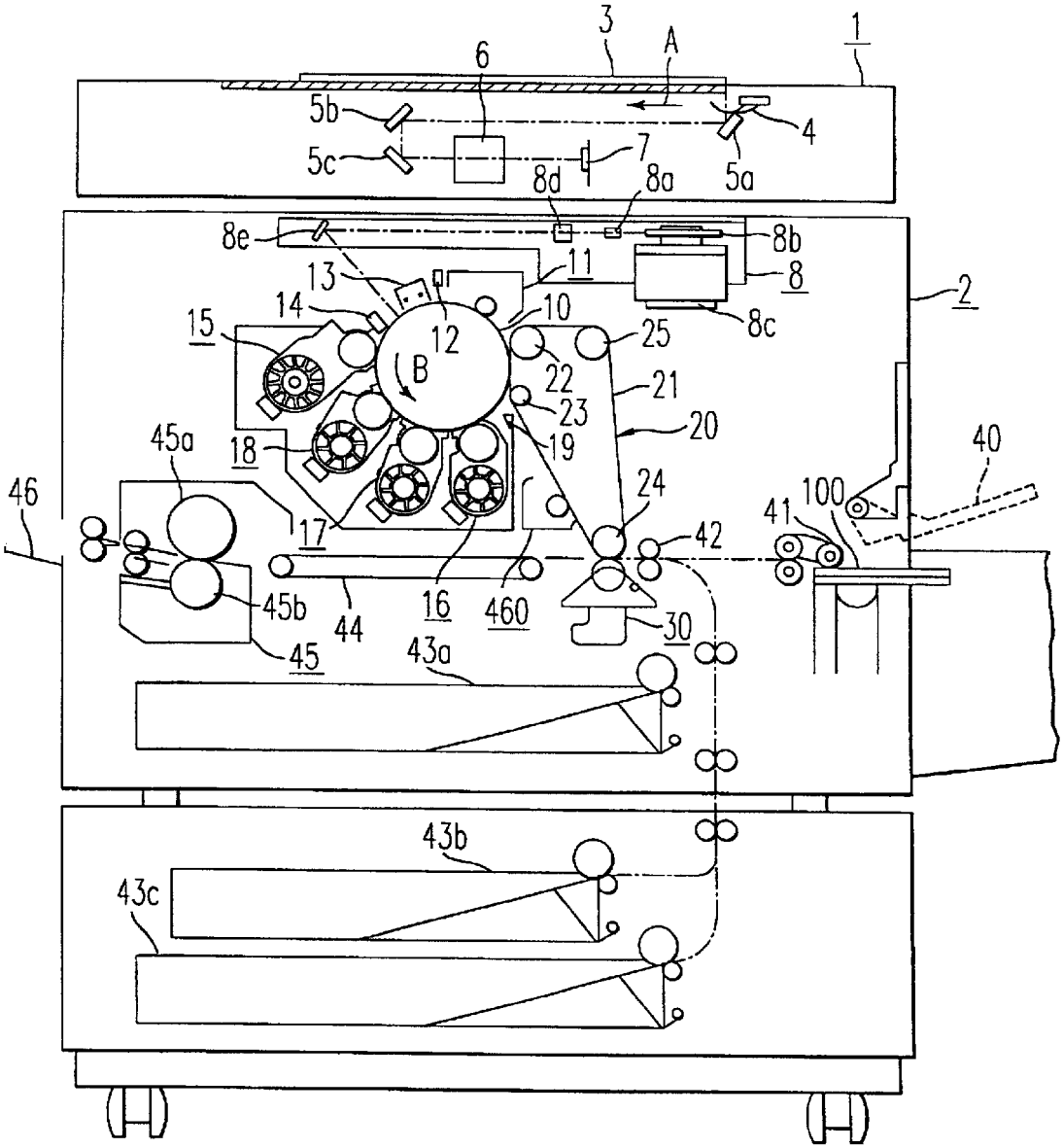
FIG. 34 illustrates an exemplary configuration of an image forming apparatus according to a fifteen embodiment of the present invention.
Figure 35:
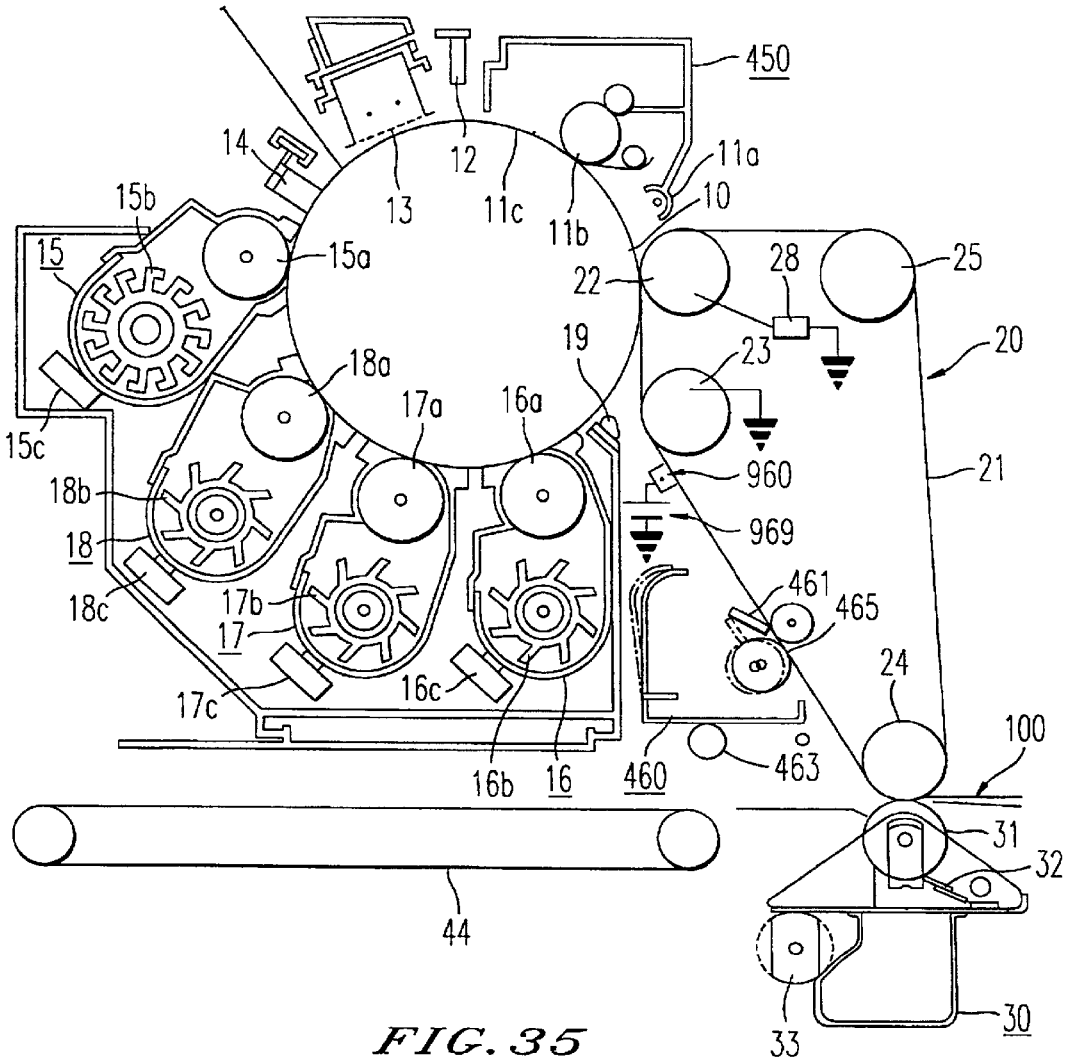
FIG. 35 illustrates an exemplary structure around a photosensitive drum of the image forming apparatus of FIG. 34.

Referring next to FIGS. 34 to 42, a fifteenth embodiment of the present invention will be described in connection with a full color electronic photocopier (hereinafter simply referred to as the "copier"), that is, an image forming apparatus in which the present invention is applied. FIG. 34 is a cross-sectional view schematically illustrating the configuration of the copier according to the fifteenth embodiment, and FIG. 35 is an enlarged view schematically illustrating the structure around a photosensitive drum in the copier of FIG. 34. The following description will be mainly focused on only those portions which are different from the first embodiment illustrated in FIGS. 1, 2.

Referring first to FIG. 35, description will be made on the structure and operation of a corona charger 960 which constitutes a characterizing portion of the fifteenth embodiment. The corona charger 960 is disposed downstream of a secondary transfer region and upstream of a primary transfer region in a direction of movement of an intermediate transfer belt 21. The corona charger 960 is connected to a discharge power supply 969 for applying the same with a direct current voltage for discharging the intermediate transfer belt 21.

Since the corona charger 960 can discharge the intermediate transfer belt 21 in a non-contact manner, the mechanism associated with discharging the intermediate transfer belt 21 can be simplified as compared with a contact-type discharger. This is because a contact-type discharger requires a contact/separation mechanism for forming a color image using two or more colors. Specifically, while a toner image of each color is transferred to the intermediate transfer belt 21, the contact/separation mechanism is required to move a discharging member of the contact-type discharger out of contact with the intermediate transfer belt 21, and after secondary transfer is completed, the contact/separation mechanism is again required to move the discharging member into contact with the intermediate transfer belt 21. However, since the corona charger 960 introduces the generation of ozone, it is not preferably in view of environmental protection. From this point of view, when a contact-type discharger is used, a discharging brush, a discharging blade, or the like may be used as a discharging member of the contact-type discharger.

Figure 36:
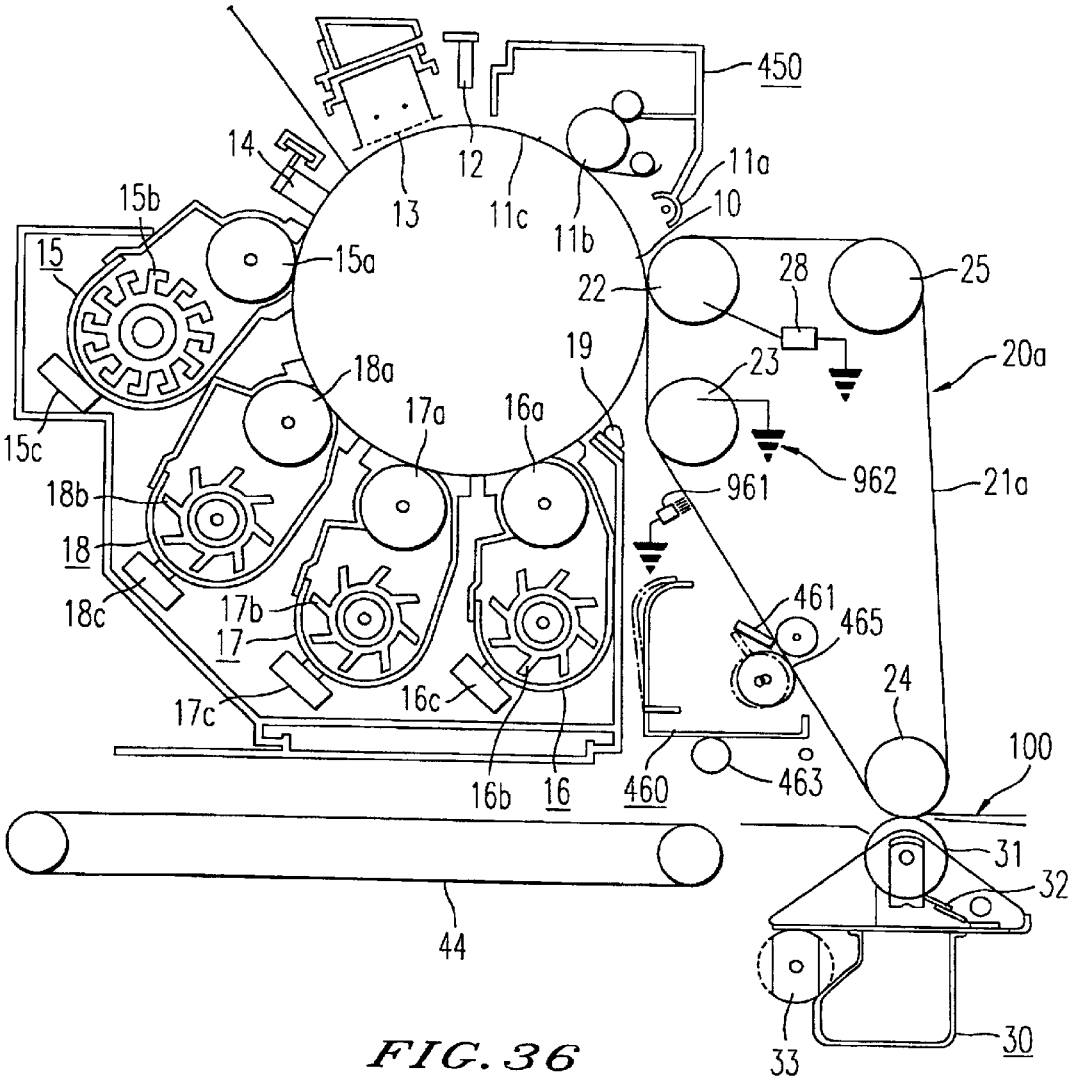
FIG. 36 illustrates an exemplary structure around a photosensitive drum with respect to a first modification made on the image forming apparatus of FIG. 34.

Next, a modification to the fifteenth embodiment will be described with reference to FIG. 36. FIG. 36 is an enlarged view schematically illustrating a modified structure around a photosensitive drum in the copier of the fifteenth embodiment. This modification employs a contact-type discharger instead of the corona charger 960, and a discharging brush 961 as a discharging member of the contact-type discharger. An intermediate transfer belt 21*a* used in this modification has a volume resistivity ρv of $10^{12}$ Ωcm or less. A ground roller 23 for tensioning the intermediate transfer belt 21*a* is positioned such that the resistance from a portion of the intermediate transfer belt 21*a* contacting the discharging brush 961 to a ground 962 of the ground roller 23 is $10^8$ Ω or less, and preferably $10^7$Ω or less. In this modification, the discharging brush 961 is not connected to a discharge power supply for applying the same with a discharging bias.

The volume resistivity ρv of the intermediate transfer belt 21*a* is set to be $10^{12}$ Ωcm or less such that a charge can move within the intermediate transfer belt 21*a*. In this way, a residual charge remaining within the intermediate transfer belt 21*a* after secondary transfer, which cannot be discharged by the discharging brush 961, can move to the ground 962 of the ground roller 23, thus preventing a residual potential from affecting an image to be formed next time. In this case, even without applying a discharging bias, the surface potential on the intermediate transfer belt 21*a* can be driven to −100 volts or less.

Figure 37:
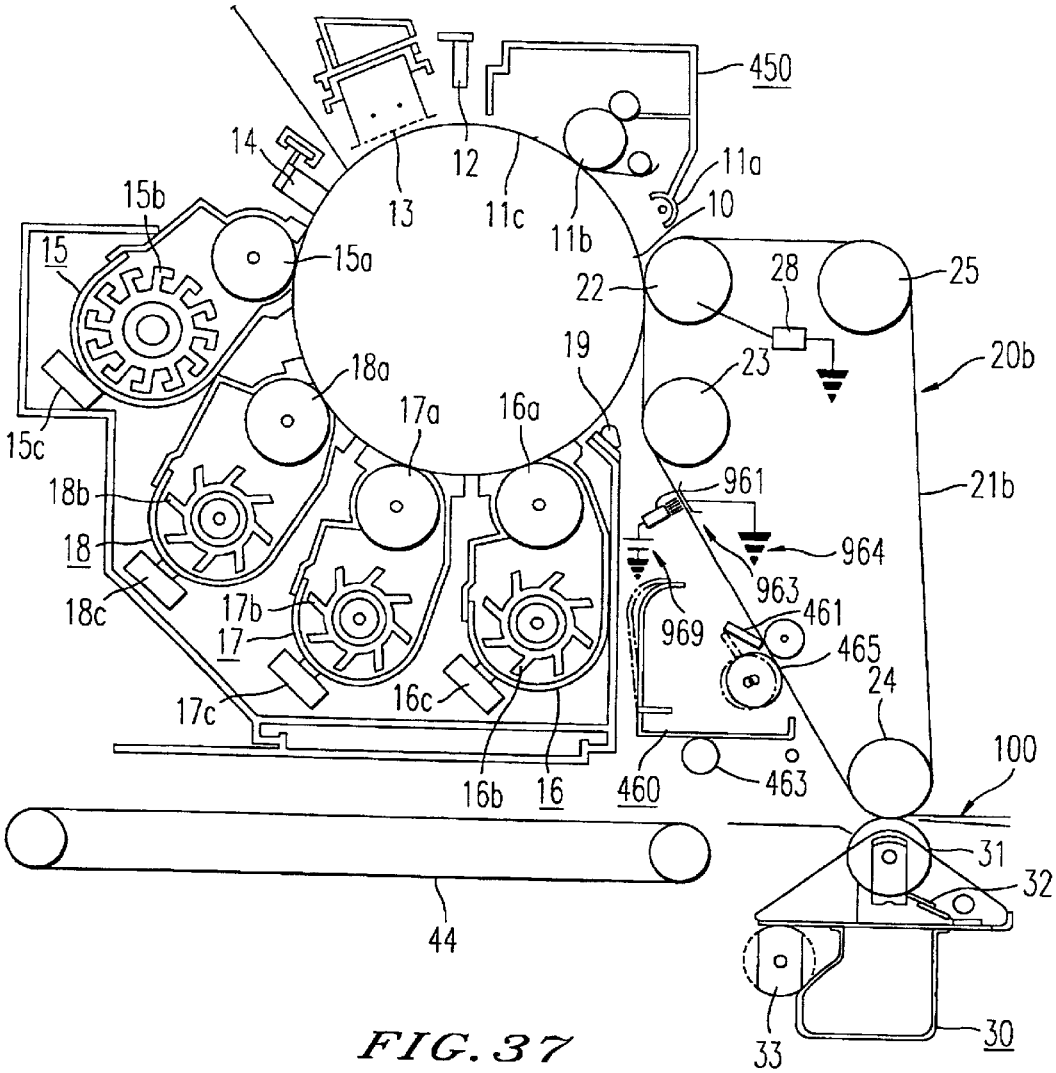
FIG. 37 illustrates an exemplary structure around a photosensitive drum with respect to a second modification made on the image forming apparatus of FIG. 34.

Next, another modification to the fifteenth embodiment will be described with reference to FIG. 37. FIG. 37 is an enlarged view schematically illustrating a modified structure around a photosensitive drum in the copier of the fifteenth embodiment. While this modification is substantially similar to the foregoing modification, there are several differences between them. First, the discharging brush 961 is connected to a discharge power supply 969 for applying the same with a discharging bias. Also, an intermediate transfer belt 21*b* used in the second modification has a volume resistivity ρv in a range of $10^{11}$ Ωcm to $10^{14}$ Ωcm. Further, a conductive plate 963 is disposed, as a grounding member, opposite to the discharging brush 61 through the intermediate transfer belt 21*b*. As the grounding member, a conductive roller or the like, for example, may be used instead of the conductive plate 963. The conductive plate 963 is in contact with the rear surface of the intermediate transfer belt 21*b* with which the discharging brush 961 comes into contact. The structure as described enables an electric field to be concentrically formed between the discharging brush 961 and the conductive plate 963. The electric field thus formed allows for stable discharging of not only a charge on the surface of the intermediate transfer belt 21*b* but also a charge internal to the intermediate transfer belt 21*b*, so that the entire intermediate transfer belt 21*b* can be uniformly discharged.

Figure 38:
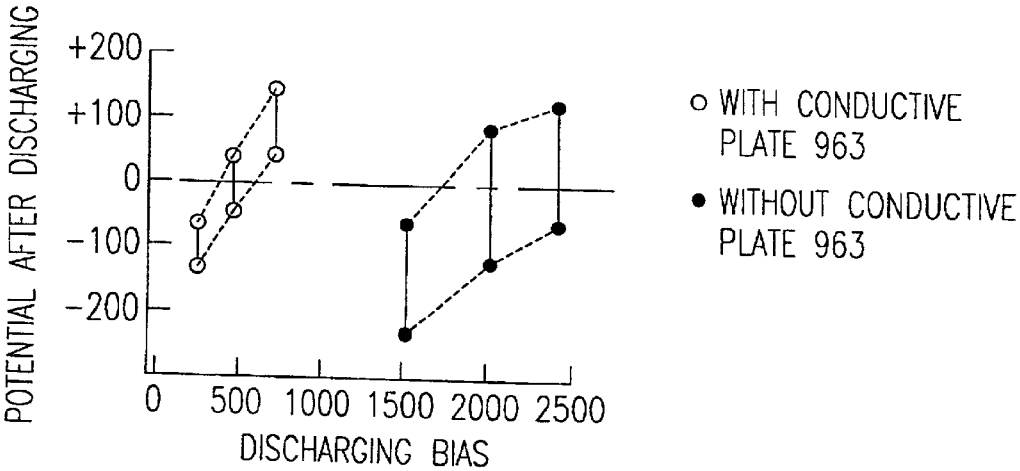
FIG. 38 is a graph for explaining a relationship between a discharging bias of a discharging brush and a surface voltage on the intermediate transfer belt when a conductive plate is provided and when a conductive plate is not provided.

FIG. 38 shows relationships between a discharging bias applied to the discharging brush 961 and the surface potential on the intermediate transfer belt 21*b* after discharging (hereinafter referred to as the "post-discharge potential") when the conductive plate 963 is disposed opposite to the discharging brush 961, and when the conductive plate 963 is not disposed. In FIG. 38, solid lines connecting two circles each indicate a range of variations in the surface potential on the intermediate transfer belt 21*b* when associated discharging biases are applied. As is apparent from this graph, for discharging the intermediate transfer belt 21*b* to be at such a surface potential that will not affect an image to be formed next time, i.e., in a range of −100 to +100 volts, a far less discharging bias is required for the discharging when the conductive plate 963 is disposed opposite to the discharging brush 961. In addition, it can be seen that variations in potential on the intermediate transfer belt 21*b* after discharging are smaller when the conductive plate 963 is disposed.

Further, also in this modification, resistance between a contacting portion of the conductive plate 963 with the intermediate transfer belt 21*b* and the ground 964 of the conductive plate 963 is preferably $10^8$ Ω or less, and preferably $10^7$ Ω or less to improve the discharging efficiency.

Figure 39:
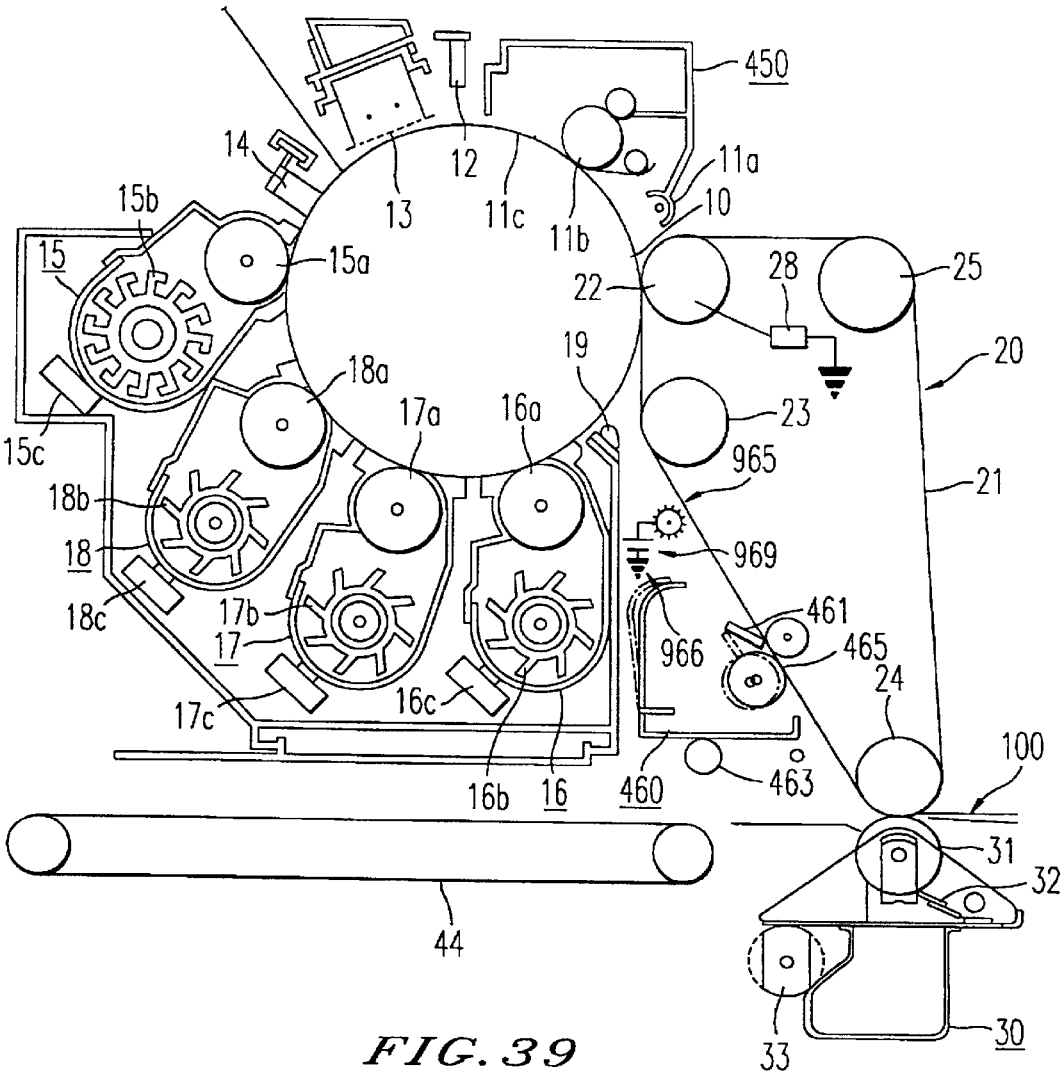
FIG. 39 illustrates an exemplary structure around a photosensitive drum with respect to a third modification made on the image forming apparatus of FIG. 34.
Figure 40:
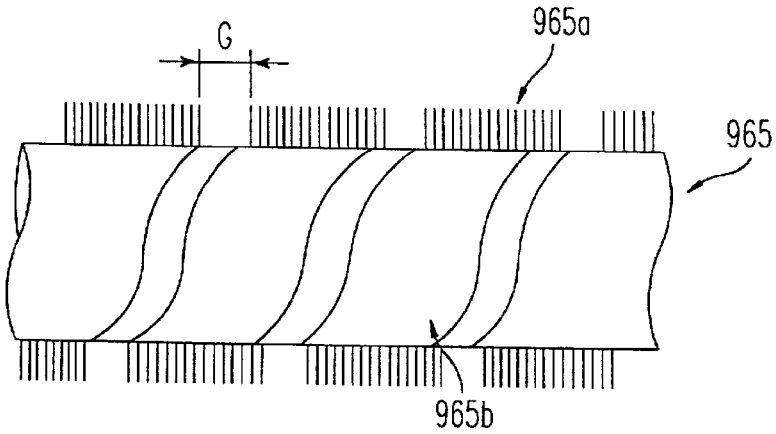
FIG. 40 illustrates a discharging brush roller of the third modification made on the image forming apparatus of FIG. 34.

Next, a further modification to the fifteenth embodiment will be described with reference to FIGS. 39 and 40. FIG. 39 is an enlarged view schematically illustrating a modified structure around a photosensitive drum in the copier of the fifteenth embodiment, and FIG. 40 is a front view of a discharging brush roller for use in the copier. This modification employs a discharging brush roller 965 instead of the discharging brush 961 in the foregoing modifications. The discharging brush roller 965 is formed of a conductive roller and a conductive fabric sheet 965*b* having brush bristles 965*a* wrapped around the conductive roller. The conductive fabric sheet 965*b* is made, for example, of acrylic fiber dispersed with carbon, or the like. In a contact-type discharger having the discharging brush roller 965 of this modification, the discharging brush roller 965 may be fabricated such that the resistance between a portion contacting the intermediate transfer belt 21, i.e., the tip of the brush bristles 986*a* and a ground 966 connected to the discharging brush roller 965 is $10^8$ Ω or less, and preferably, $10^7$ Ω or less to improve a discharging efficiency. Essentially, this resistance means the resistance of the conductive fabric sheet since the roller serving as a core bar of the discharging brush roller 965 is conductive.

Figure 41:
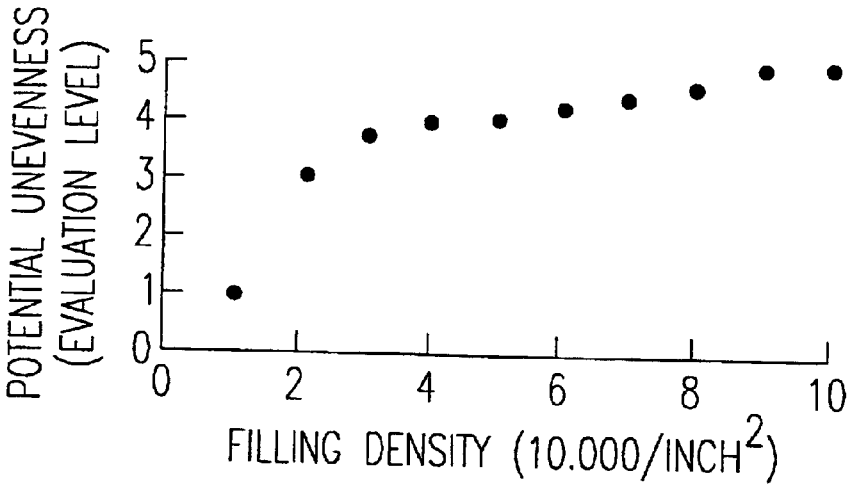
FIG. 41 is a graph for explaining a relationship between a filling density of the discharging brush roller and the surface voltage of the intermediate transfer belt in the third modification made on the image forming apparatus of FIG. 34.

FIG. 41 is a graph showing the relationship between a filling density of the discharging brush roller 965 and an evaluation of potential unevenness on the intermediate transfer belt 21 after discharging. The evaluation of potential unevenness is made on a five-level basis, where the least potential unevenness is evaluated as level 5. Generally, the potential unevenness on the surface of the intermediate transfer belt 21 evaluated as level 3 or higher will not affect an image to be formed next time. It can therefore be understood from the graph that the filling density of the discharging brush roller 965 is preferably 20,000 per square inch or more. With the discharging brush roller 965 thus formed, an increased number of bristles can be in contact with the surface of the intermediate transfer belt 21 per unit area, so that the potential unevenness can be effectively suppressed on the intermediate transfer belt 21 after discharging.

Figure 42:
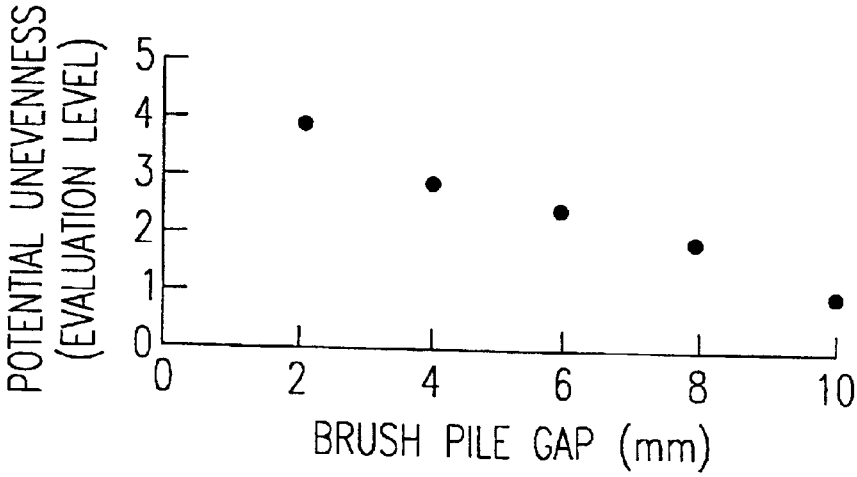
FIG. 42 is a graph for explaining a relationship between a brush pile gap of the discharging brush roller and the surface voltage of the intermediate transfer belt in the third modification made on the image forming apparatus of FIG. 34.

When the discharging brush roller 965 is fabricated, the conductive fabric sheet 965*b* is wrapped around the conductive roller as mentioned above, in which case the potential unevenness also varies largely depending on a gap G between edges of the wrapped conductive fabric sheet 965*b*. FIG. 42 shows the relationship between the gap G between edges of the wrapped conductive fabric sheet 965*b* and the evaluation of potential unevenness on the surface of the intermediate transfer belt 21 after discharging. The same five-level evaluation is also applied in FIG. 42. To achieve level 3 or higher for the evaluation of potential unevenness, the discharging brush roller 965 should be fabricated such that the gap G is at least 2 mm or less. In other words, the gap G of 2 mm or less is effective in suppressing the potential unevenness on the surface of the intermediate transfer belt 21 after discharging.

In this modification, the discharge coating brush roller 965 is driven to rotate in the same direction as the intermediate transfer belt 21 in order to prevent the discharging performance from degrading and its brush bristles from lying down. In addition, the discharging brush roller 965 is controlled such that it rotates at a line velocity higher than that of the intermediate transfer belt 21 in a discharge region in which the discharging brush roller 965 contacts the intermediate transfer belt 21.

Embodiment 16

Figure 43:
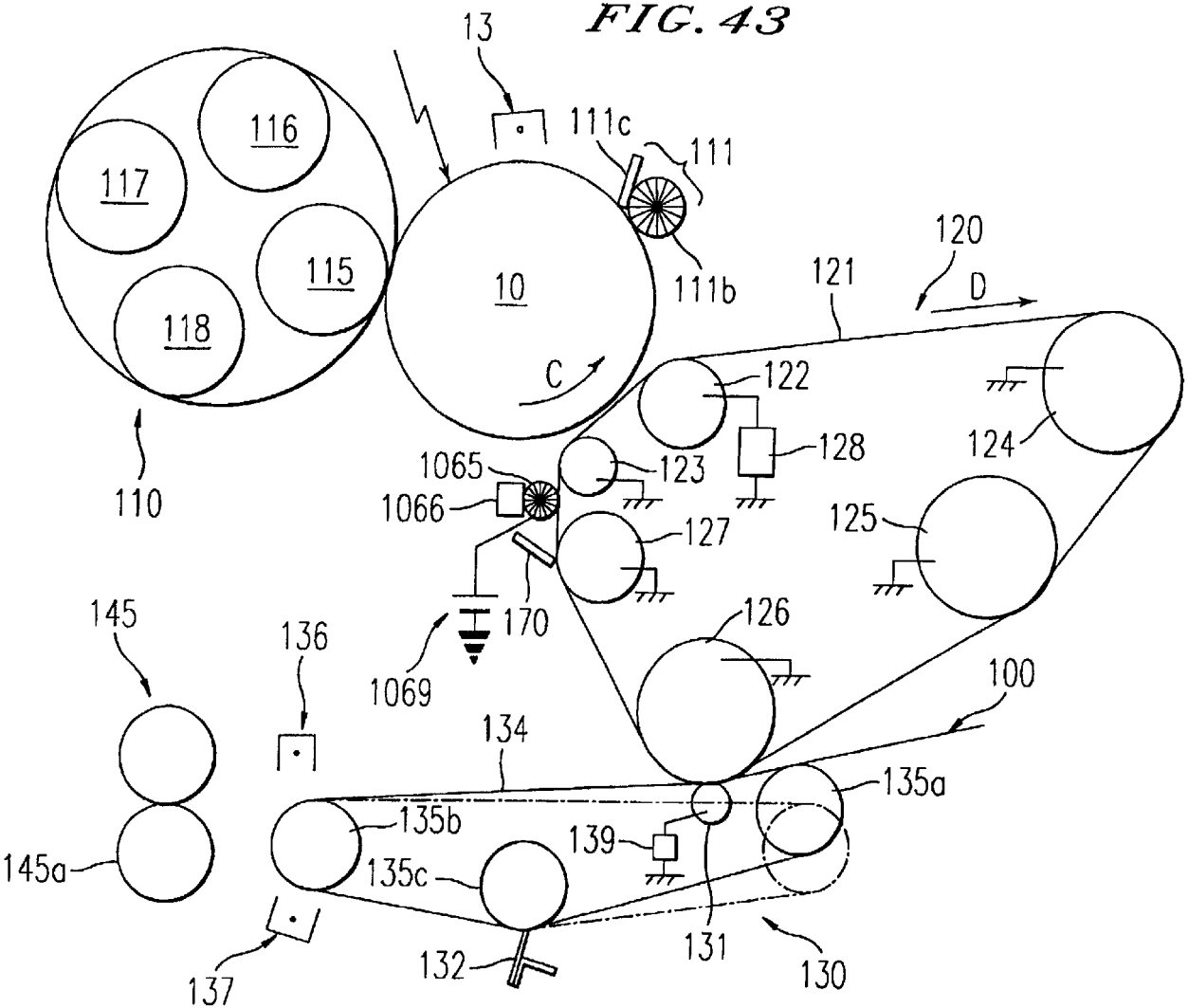
FIG. 43 illustrates a main portion of a printer of an image forming apparatus according to a sixteenth embodiment of the present invention.

Referring next to FIG. 43, a sixteenth embodiment of the present invention will be described in connection with a full color electronic photocopier (hereinafter simply referred to as the "copier"), that is, an image forming apparatus in which the present invention is applied. FIG. 43 schematically illustrates the configuration of a main portion of a printer unit in the copier according to the sixteenth embodiment. The illustrated copier includes a scanner unit, not shown, which has the same configuration as that of the fifteenth embodiment, and performs image forming operations basically in the same manner as the copier of FIG. 34. The sixteenth embodiment differs from the fifteenth embodiment mainly in the structure and operation of the printer unit. FIG. 34 corresponds to FIG. 9, so that the following description will be mainly focused on only those portions which are different from FIG. 9.

Around an intermediate transfer belt 121, there are disposed a lubricant coating and discharging brush roller 1065 for coating a lubricant on and discharging the surface of the intermediate transfer belt 121; a belt cleaning blade 170; and a transfer unit 130. These components can be moved into and out of contact with the intermediate transfer belt 121 by respective contact/separation mechanisms, not shown, associated therewith.

As mentioned above, the image forming surface on the intermediate transfer belt 121, on which a Bk toner image has been transferred, is again returned to the primary transfer region. In this event, the lubricant coating and discharging brush roller 1065 and the belt cleaning blade 170 are moved away from the intermediate transfer belt 121 by respective contact/separation mechanisms associated therewith so as not to disturb the toner image.

After secondary transfer, residual toner remaining on the surface of the intermediate transfer belt 121 is removed by pressing the belt cleaning blade 170 against the intermediate transfer belt 121 by the associated contact/separation mechanism, not shown. Then, a lubricant contained in a lubricant container 1066 is coated on the surface of the intermediate transfer belt 121 by the lubricant coating and discharging brush roller 1065 pressed against the intermediate transfer belt 121 by the associated contact/separation mechanism, not shown, in order to improve the cleaning performance and the secondary transfer operability. The lubricant for use in this application may be, for example, a plate formed of fine particles of zinc stearate.

In the following, description will be made on the structures and operations of the lubricant coating and discharging brush roller 1065 and the belt cleaning blade 170 which constitute characterizing portions of the sixteenth embodiment. In the sixteenth embodiment, the lubricant coating and discharging brush roller 1065 functions to coat a lubricant on and discharge the surface of the intermediate transfer belt 121. It should be noted that while the lubricant coating and discharging brush roller 1065 may be substantially similar to the discharging brush roller 965 previously described in the third modification of the fifteenth embodiment, the conductive fabric sheet forming the brush bristles has the resistance of approximately $10^6$ Ω. The lubricant coating and discharging brush roller 1065 is connected to a variable discharge power supply 1069 for applying the same with a discharging bias. Also, the lubricant coating and discharging brush roller 1065 is disposed upstream of a primary transfer region and downstream of the belt cleaning blade 170 in a direction of movement of the intermediate transfer belt 121.

The lubricant coating and discharging brush roller 1065 is formed of a metal roller and a conductive fabric sheet wrapped around the metal roller. The conductive fabric sheet is made of acrylic fiber dispersed with carbon and having a size of 6.5 deniers, and wrapped around the metal roller such that a gap G between edges of the wrapped sheet is 1 mm or less. The lubricant coating and discharging brush roller 1065 has a filling density of 100,000 per square inch. The resistance from the brush tip to the ground of the lubricant coating and discharging brush roller 1065 is set at $10^6$ Ω.

A direct current voltage applied to the lubricant coating and discharging brush roller 1065 is calculated in accordance with the temperature and humidity around the intermediate transfer belt 121, surface potential on the intermediate transfer belt 121 based on the copy mode information, and a surface moving speed of the intermediate transfer belt 121 based on transfer paper information, and the variable discharge power supply 1069 is controlled to generate the calculated direct current voltage. Specifically, the discharging bias is set as shown in Tables 4, 5, and 6.

Since the structure and operation of the contact/separation mechanisms associated with the lubricant coating and discharging brush roller 1065 and the belt cleaning blade 170 are identical to those previously described with reference to FIGS. 30, 31A, 31B, description thereon is omitted here.

Embodiment 17

Figure 44:
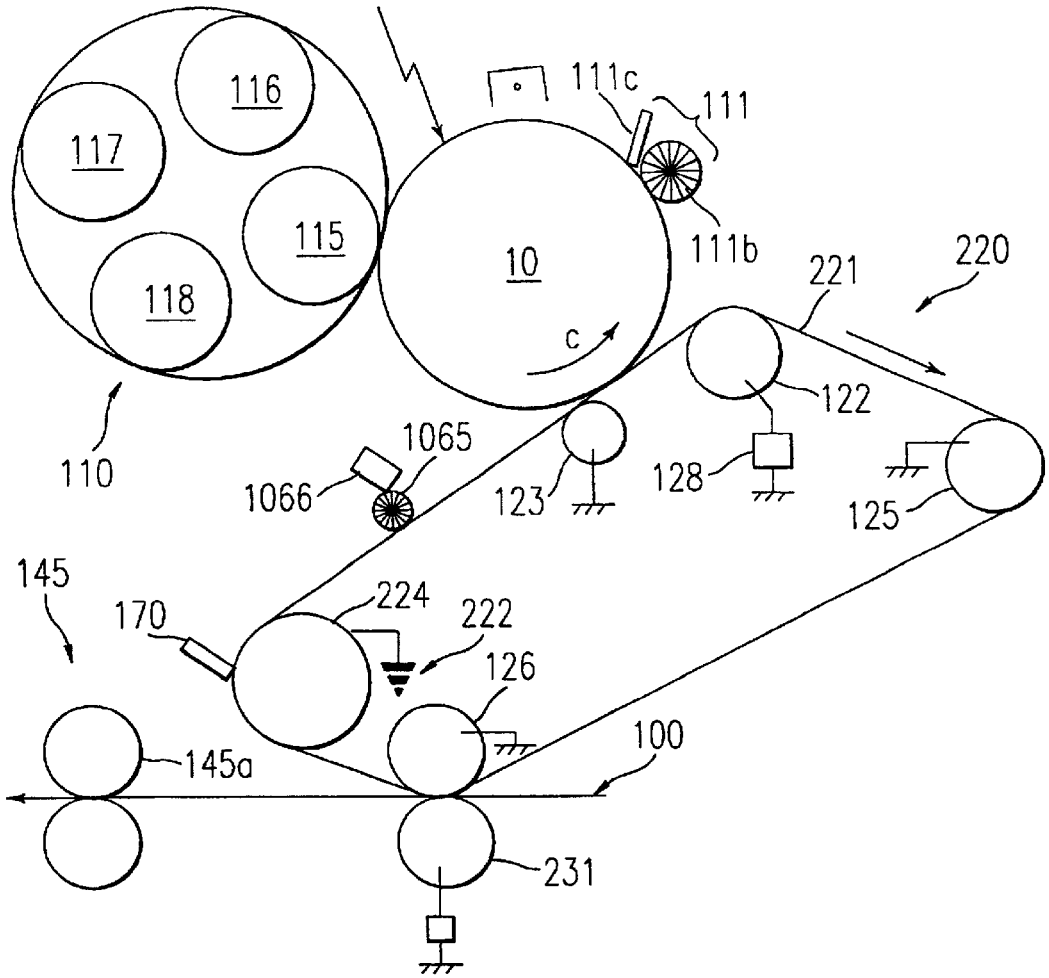
FIG. 44 illustrates a main portion of a printer of an image forming apparatus according to a seventeenth embodiment of the present invention.

Referring next to FIG. 44, a seventeenth embodiment of the present invention will be described in connection with a full color electronic photocopier (hereinafter simply referred to as the "copier"), that is, an image forming apparatus in which the present invention is applied.

FIG. 44 schematically illustrates the configuration of a main portion of a printer unit in the copier according to the seventeenth embodiment. In general, the illustrated copier is intended for a reduction in cost, and differs from the copier according to the sixteenth embodiment only in the following aspects. Therefore, similar constituent members in the seventeenth embodiment are designated the same reference numerals as those in the sixteenth embodiment, and description thereon is omitted. FIG. 44 corresponds to FIG. 11 so that the following description will be mainly focused on only those portions which are different from FIG. 11.

Description will be made on the structures and operations of a lubricant coating and discharging brush roller 1065 and a belt cleaning roller 170 which constitute characterizing portions of the seventeenth embodiment. Like the foregoing sixteenth embodiment, the lubricant coating and discharging brush roller 1065 is used also as a discharging member. The seventeenth embodiment differs from the sixteenth embodiment in the positioning of the lubricant coating and discharging brush roller 1065 and the belt cleaning roller 170.

Specifically, the lubricant coating and discharging brush roller 1065 is disposed opposite to a driving roller 224 which also serves as a cleaning opposed roller associated with the cleaning blade 170, as can be seen in FIG. 44.

The lubricant coating and discharging brush roller 1065 is formed of a metal roller and a conductive fabric sheet wrapped around the metal roller. The conductive fabric sheet is made of acrylic fiber dispersed with carbon and having a size of 6.5 deniers, and wrapped around the metal roller such that a gap G between edges of the wrapped sheet is 1 mm or less. The lubricant coating and discharging brush roller 1065 has a filling density of 100,000 per square inch.

The driving roller 224 opposing the lubricant coating and discharging brush roller 1065 is formed of a metal roller coated with conductive rubber thereon. The resistance from the surface of the driving roller 224 to the ground 222 is set at $10^7$ Ω.

Embodiment 18

Next, an eighteenth embodiment of the present invention will be described in connection with an image forming apparatus which employs a transfer material carrier such as a belt for carrying and conveying a transfer material such as a paper, an OHP sheet or the like, and to which the present invention is applied.

Figure 45:
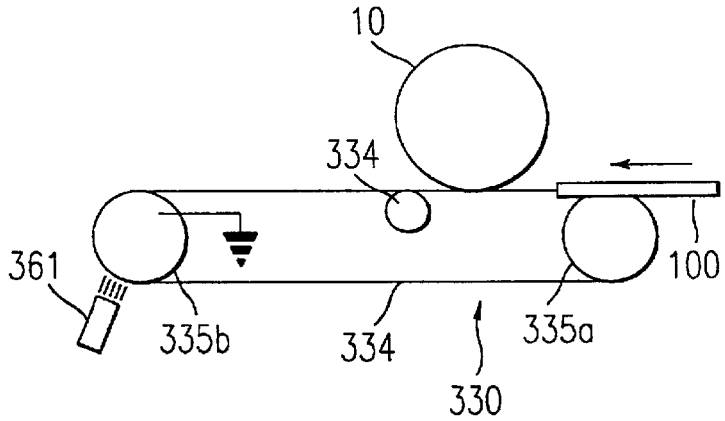
FIG. 45 illustrates a main portion of a printer of an image forming apparatus according to an eighteenth embodiment of the present invention.

FIG. 45 schematically illustrates a transfer unit of a copier according to the eighteenth embodiment. In the eighteenth embodiment, the present invention is utilized in a transfer material carrier for carrying and conveying a transfer material rather than in an intermediate transfer unit as in the foregoing embodiments. FIG. 45 corresponds to FIG. 12 so that the following description will be mainly focused on only those portions which are different from FIG. 12.

A paper transfer belt 332 of the eighteenth embodiment is passed over a ground roller 335*a* positioned at one end of a sheet feed unit, not shown, and serving as a pre-transfer discharging means, and a tension roller 335*b* positioned at one end of a fixing unit, not shown.

A transfer paper 100, on which a toner image has been transferred as described above, is separated from the paper transfer belt 332, and conveyed to the fixing unit, not shown. The paper transfer belt 332, after the transfer paper 100 has been separated therefrom, passes a region in which a discharging brush 361 disposed opposite to the tension roller 335*b* is brought into contact therewith, and is discharged by the discharging brush 361.

Obviously, numerous additional modifications and variations of the present invention are possible in light of the above teachings. It is therefore to be understood that within the scope of the appended claims, the present invention may be practiced otherwise than as specifically described herein.

What is claimed as new and is desired to be secured by Letters Patent of the United States is:

1. An image forming apparatus, comprising:

an image carrying member configured to rotate and carry a toner image on a rotating surface thereof;

an intermediate transfer member, facing and in contact with said image carrying member, configured to rotate and receive said toner image from said image carrying member during a first transfer operation which is performed one time in a mono color mode and which is repeated a plurality of times in a multiple color mode to overlay a plurality of mono color toner images in turn on said intermediate transfer member;

a charging member configured to apply a charge to said intermediate transfer member to generate an electric field at a region where said image carrying member and said intermediate transfer member contact each other, said electric field generating a force for initiating said first transfer operation;

a transfer mechanism, facing and in contact with said intermediate transfer member, configured to perform a second transfer operation for transferring said toner image from said intermediate transfer member to a transfer sheet;

a discharging member, in contact with said intermediate transfer member, configured to discharge a charge remaining on said intermediate transfer member after a completion of said second transfer operation; and a grounding member in contact with said intermediate transfer member and connected to a ground, wherein a resistance between a contacting portion of said grounding member and said intermediate transfer member and the ground connected to the grounding member is $10^8$ Ωm or less.

2. An image forming apparatus, comprising:

an image carrying member configured to rotate and carry a toner image on a rotating surface thereof;

an intermediate transfer member, facing and in contact with said image carrying member, configured to rotate and receive said toner image from said image carrying member during a first transfer operation which is performed one time in a mono color mode and which is repeated a plurality of times in a multiple color mode to overlay a plurality of mono color toner images in turn on said intermediate transfer member;

a charging member configured to apply a charge to said intermediate transfer member to generate an electric field at a region where said image carrying member and said intermediate transfer member contact with each other, said electric field generating a force for initiating said first transfer operation;

a transfer mechanism, facing and in contact with said intermediate transfer member, configured to perform a second transfer operation for transferring said toner image from said intermediate transfer member to a transfer sheet;

a discharging member, in contact with said intermediate transfer member, at least one of a direct current, an alternating current, and direct and alternating currents, configured to discharge a charge remaining on said intermediate transfer member after a completion of said second transfer operation; and a grounding member in contact with said intermediate transfer member and connected to a ground, wherein a resistance between a contacting portion of said grounding member and said intermediate transfer member and the ground connected to the grounding member is $10^8$ Ωm or less.

3. An image forming apparatus as defined in claim 2, wherein a region between a point where said grounding member contacts said intermediate transfer member and a grounding part of said discharging member has a resistance of $10^8$ Ωm or less.

4. An image forming apparatus as defined in claim 2, wherein said intermediate transfer member includes an endless belt extended between a plurality of rollers including a supporting roller used as said grounding member.

5. An image forming apparatus as defined in claim 4 wherein said supporting roller faces said discharging member.

6. An image forming apparatus as defined in claim 4, wherein said supporting roller drives said intermediate transfer member.

7. An image forming apparatus as defined in claim 4, wherein said supporting roller has a resistance of $10^8$ Ωm or less at a region between a point in contact with said intermediate transfer member and a grounding portion thereof.

* * * * *